US010541465B2

(12) United States Patent
Tinaphong et al.

(10) Patent No.: US 10,541,465 B2
(45) Date of Patent: Jan. 21, 2020

(54) OMNI-DIRECTIONAL TELEVISION ANTENNA WITH WIFI RECEPTION CAPABILITY

(71) Applicant: VOXX International Corporation, Hauppauge, NY (US)

(72) Inventors: Prapan Paul Tinaphong, Carmel, IN (US); James K. Rinehart, Indianapolis, IN (US); Chung Hua Hung, Kaohsiung Hsien (TW)

(73) Assignee: VOXX International Corporation, Hauppauge, NY (US)

( * ) Notice: Subject to any disclaimer, the term of this patent is extended or adjusted under 35 U.S.C. 154(b) by 390 days.

(21) Appl. No.: 15/228,302

(22) Filed: Aug. 4, 2016

(65) Prior Publication Data

US 2017/0133764 A1 May 11, 2017

Related U.S. Application Data

(60) Provisional application No. 62/254,012, filed on Nov. 11, 2015.

(51) Int. Cl.
*H01Q 1/22* (2006.01)
*H01Q 1/08* (2006.01)
(Continued)

(52) U.S. Cl.
CPC ..... *H01Q 1/2291* (2013.01); *H01Q 1/084* (2013.01); *H01Q 1/362* (2013.01); *H01Q 9/32* (2013.01); *H01Q 21/28* (2013.01)

(58) Field of Classification Search
CPC ..... H01Q 1/084; H01Q 1/10; H01Q 1/362; H01Q 1/2291; H01Q 9/08; H01Q 9/16; H01Q 9/30; H01Q 9/32
See application file for complete search history.

(56) References Cited

U.S. PATENT DOCUMENTS 2,657,312 A 10/1953 Saranga ..... 343/727
2,700,105 A 1/1955 Winegard ..... 343/795
(Continued)

FOREIGN PATENT DOCUMENTS

CN 3021824 11/1993 ..... 14/3
CN 2166524 5/1994 ..... H01Q 1/32
(Continued)

OTHER PUBLICATIONS

Notification of Transmittal of the International Search Report and the Written Opinion of the International Searching Authority, or the Declaration, dated Oct. 20, 2016, which was issued by the International Bureau of WIPO in Applicant's corresponding international PCT application having Serial No. PCT/US2016/045545, filed on Aug. 4, 2016.
(Continued)

*Primary Examiner* — Robert Karacsony
(74) *Attorney, Agent, or Firm* — Bodner & O'Rourke, LLP; Gerald T. Bodner; Christian P. Bodner

(57) ABSTRACT

An antenna device includes a housing defining an interior cavity, a UHF antenna element, two VHF antenna elements and two WiFi antenna elements. The antenna elements are mounted to the housing and are selectively adjustable between a vertical, upright position and a folded, horizontal position. The antenna elements are situated on the housing to provide an omni-directional antenna pattern for receiving broadcast signals. Antenna circuitry provided within the interior cavity of the housing receives signals from the antenna elements and generates an output signal that is provided to at least one output connector mounted on the housing or on one or more signal cables extending therefrom and to an external electronic device connected thereto.

28 Claims, 45 Drawing Sheets

(51) Int. Cl.

| | |
|---|---|
| ***H01Q 9/32*** | (2006.01) |
| ***H01Q 21/28*** | (2006.01) |
| ***H01Q 1/36*** | (2006.01) |

(56) References Cited

U.S. PATENT DOCUMENTS

| | | | | |
|---|---|---|---|---|
| 3,324,476 | A | 6/1967 | Smith, Jr. et al. | 343/830 |
| 3,478,361 | A | 11/1969 | Middlemark | 343/730 |
| D294,026 | S | 2/1988 | Shinkawa | D14/230 |
| D306,862 | S | 3/1990 | Kent | D14/230 |
| D310,224 | S | 8/1990 | Cooper | D14/230 |
| D332,262 | S | 1/1993 | Borchardt | D14/230 |
| D345,982 | S | 4/1994 | Lucey | D14/230 |
| D347,010 | S | 5/1994 | Emmerling | D14/230 |
| D371,560 | S | 7/1996 | Fenton et al. | D14/230 |
| D372,545 | S | 8/1996 | Schultz | D25/138 |
| D391,965 | S | 3/1998 | Kimura | D14/230 |
| D391,966 | S | 3/1998 | Mischenko et al. | D14/230 |
| 5,805,112 | A | 9/1998 | Cassel | 343/702 |
| D414,777 | S | 10/1999 | Tsai | D14/230 |
| D421,017 | S | 2/2000 | Phipps | D14/230 |
| D472,892 | S | 4/2003 | Tourres | D14/230 |
| D490,424 | S | 5/2004 | Yamanashi | D14/358 |
| D491,926 | S | 6/2004 | Tai et al. | D14/230 |
| 7,006,053 | B2 | 2/2006 | Zigler et al. | 343/878 |
| D517,535 | S | 3/2006 | Wu | D14/230 |
| D520,498 | S | 5/2006 | Lin et al. | D14/230 |
| D525,967 | S | 8/2006 | Hsiau | D14/230 |
| D579,446 | S | 10/2008 | Imano et al. | D14/230 |
| D585,435 | S | 1/2009 | Wafer | D14/230 |
| D596,177 | S | 7/2009 | Steele et al. | D14/358 |
| D598,577 | S | 8/2009 | Li | D25/138 |
| D637,837 | S | 5/2011 | Kubota | D25/138 |
| 8,174,457 | B1 | 5/2012 | Lam | 343/828 |
| 8,269,672 | B2 | 9/2012 | Tinaphong et al. | 343/700 MS |
| 8,427,337 | B2 | 4/2013 | Wilbur et al. | 340/870.02 |
| D710,834 | S | 8/2014 | Jeon et al. | D14/230 |
| D712,568 | S | 9/2014 | Canales | D25/104 |
| D740,449 | S | 10/2015 | Huang | D25/151 |
| D748,079 | S | 1/2016 | Dinsdale et al. | D14/230 |
| D751,054 | S | 3/2016 | Chou et al. | D14/230 |
| 2002/0149536 | A1 | 10/2002 | Safakhah | 343/882 |
| 2003/0146876 | A1 | 8/2003 | Greer et al. | 343/702 |
| 2004/0239567 | A1 | 12/2004 | Van Der Poel | 343/700 MS |
| 2005/0259022 | A1 | 11/2005 | Wang | 343/764 |
| 2005/0259023 | A1 | 11/2005 | Wang | 343/764 |
| 2007/0285328 | A1 | 12/2007 | Mariola | 343/767 |
| 2008/0111761 | A1 | 5/2008 | Kan et al. | 343/873 |
| 2010/0182206 | A1 | 7/2010 | Barbieri et al. | 343/702 |
| 2011/0130163 | A1 | 6/2011 | Saban et al. | 455/517 |
| 2012/0229358 | A1 | 9/2012 | Doneker et al. | 343/848 |
| 2014/0062787 | A1 | 3/2014 | Nazarov | 342/378 |
| 2014/0266971 | A1 | 9/2014 | Bedicks, Jr. et al. | 343/888 |
| 2014/0368400 | A1 | 12/2014 | Lin et al. | 343/843 |
| 2015/0054705 | A1 | 2/2015 | Tinaphong et al. | 343/834 |

FOREIGN PATENT DOCUMENTS

| | | | |
|---|---|---|---|
| CN | 1913227 A | 2/2007 | H01Q 13/08 |
| CN | 102859871 A | 1/2013 | H03K 9/00 |
| CN | 303409202 | 10/2015 | 14/3 |

OTHER PUBLICATIONS

Written Opinion of the International Searching Authority, dated Oct. 20, 2016, which was issued by the International Bureau of WIPO in Applicant's corresponding international PCT application having Serial No. PCT/US2016/045545, filed on Aug. 4, 2016.

International Search Report, dated Oct. 20, 2016, which was issued by the International Bureau of WIPO in Applicant's corresponding international PCT application having Serial No. PCT/US2016/045545, filed on Aug. 4, 2016.

A first Office Action (in Chinese) and an English translation thereof, dated Sep. 3, 2019, issued by the State Intellectual Property Office of the People's Republic of China for Applicant's corresponding Chinese Patent Application No. 201680066121.3, filed on Aug. 4, 2016.

177MHz

183MHz

189MHz

195MHz

201MHz

207MHz

213MHz

473MHz

509MHz

545MHz

581MHz

617MHz

653MHz

693MHz

OMNI-DIRECTIONAL TELEVISION ANTENNA WITH WIFI RECEPTION CAPABILITY

CROSS-REFERENCE TO RELATED APPLICATIONS

This application is related to U.S. Provisional Patent Application Ser. No. 62/254,012, filed on Nov. 11, 2015, and entitled "Omni-Directional Television Antenna With WiFi Reception Capability", the disclosure of which is hereby incorporated by reference and on which priority is hereby claimed.

BACKGROUND OF THE INVENTION

Field of the Invention

The present invention generally relates to antennas for receiving broadcast signals such as television signals, and more specifically relates to television antennas for receiving digitally formatted broadcast signals.

Description of the Prior Art

Conventional indoor TV antenna systems generally include two separate antennas for respective VHF and UHF reception. The antenna for receiving the VHF bands employs a pair of telescopic elements forming a dipole with each of the elements having a maximum length of from four to six feet (1.5 to 2.5 meters). The two elements usually are mounted to permit the elements to be spread apart to increase or shorten the dipole length and those elements are commonly referred to as "rabbit ears". The indoor UHF antenna typically is a loop having a diameter of about seven and a half inches (20 centimeters).

One problem associated with the conventional indoor antenna systems is that the physical dimension of the VHF dipole is undesirably long for the ordinary setting in a living room and that the length as well as the direction of the dipole elements may need to be adjusted depending upon the receiving channels. The second problem is that the performance of such conventional indoor VHF/UHF antennas changes in response to changes of the physical conditions around the antenna elements. For example, it is difficult for a user to make proper adjustment of the antennas since a human body coming into contact with an antenna changes the electromagnetic conditions associated with the antenna elements. The third problem is that the conventional indoor antenna systems do not always provide a sufficient signal level for good reception.

Most indoor television antennas include either two telescopic antenna elements, forming a dipole antenna or as a monopole antenna with one ground reflector element, or a printed circuit board with conductive patterns defining a planar antenna, such as disclosed in U.S. Pat. No. 8,269,672 (Tinaphong, et al.), the disclosure of which is incorporated herein by reference, or a thin film with a conductive circuit path printed thereon to define a flexible planar antenna, such as disclosed in U.S. Patent Application Publication No. 2015/0054705 (Tinaphong, et al.), the disclosure of which is incorporated herein by reference.

As mentioned previously, with a conventional "rabbit ears" antenna, the user must adjust the two telescopic antenna elements by length or direction in order to tune the antenna for best reception of broadcast television signals.

OBJECTS AND SUMMARY OF THE INVENTION

It is an object of the present invention to provide an antenna for the reception of digitally formatted television broadcast signals.

It is another object of the present invention to provide an indoor television antenna which is omni-directional and, therefore, needs no adjustment for receiving a broad range of television broadcast signals.

It is yet another object of the present invention to provide a television antenna which receives VHF and UHF television broadcast signals as well as having the capability of receiving and rebroadcasting WiFi signals using a WiFi repeater or WiFi range extender, so that a consumer may watch live streaming video content.

It is yet a further object of the present invention to provide a television antenna which overcomes the inherent disadvantages of conventional television antennas.

In one form of the present invention, a television antenna is constructed with three poles or antenna elements. Each antenna element is situated on a support housing that defines an internal cavity in which associated circuitry for the antenna elements, including a ground plane, is situated. Two antenna elements are preferably in the form of end fed helical antenna elements, which are provided for receiving broadcast television signals in the VHF band, and the third antenna element is preferably in the form of a modified coaxial sleeve antenna, which is provided for receiving broadcast television signals in the UHF band. Preferably, the two VHF band antenna elements are mutually coupled to provide an omni-directional antenna pattern for receiving broadcast signals, and the UHF antenna element is also electromagnetically coupled to the VHF antenna elements. All three antenna elements, when disposed in a vertically upright position on the housing of the antenna, provide omni-directional reception of broadcast television signals in both the VHF band and the UHF band.

In another form of the present invention, the television antenna may further include two additional antenna elements for receiving WiFi signals so that the antenna of the present invention provides a WiFi Access Point (AP), or alternatively a WiFi repeater or WiFi range extender circuit, whereby a user who connects the antenna of the present invention to his monitor or television, especially a "smart" television, may watch live streaming video content. Each of the WiFi antenna elements is preferably formed as a combination of helix antenna and coaxial sleeve antenna. The WiFi repeater or WiFi extender circuit, if included, rebroadcasts or retransmits the signals received by the WiFi antennas to extend the range of the WiFi signals.

Each of the antenna elements (VHF, UHF and WiFi) is preferably mounted on the top surface of the housing and is positionable thereon in either a first state, where it may be folded for compactness when not in use to a horizontal position to rest on or come in close proximity to the top surface of the supporting housing, or in a second state, where it may be selectively locked into place in a vertical position, extending upwardly and perpendicularly from the top surface of the antenna housing, for reception of broadcast television and WiFi signals. Of course, it should be realized that the antenna elements may be positioned elsewhere on the housing, for example, on the lateral side walls of the housing and may be raised to a vertical position for good signal reception or lowered against the side walls or top wall to be substantially planar with the housing when the antenna is not in use or is being stored, or is being shipped by the manufacturer in a substantially flat package.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
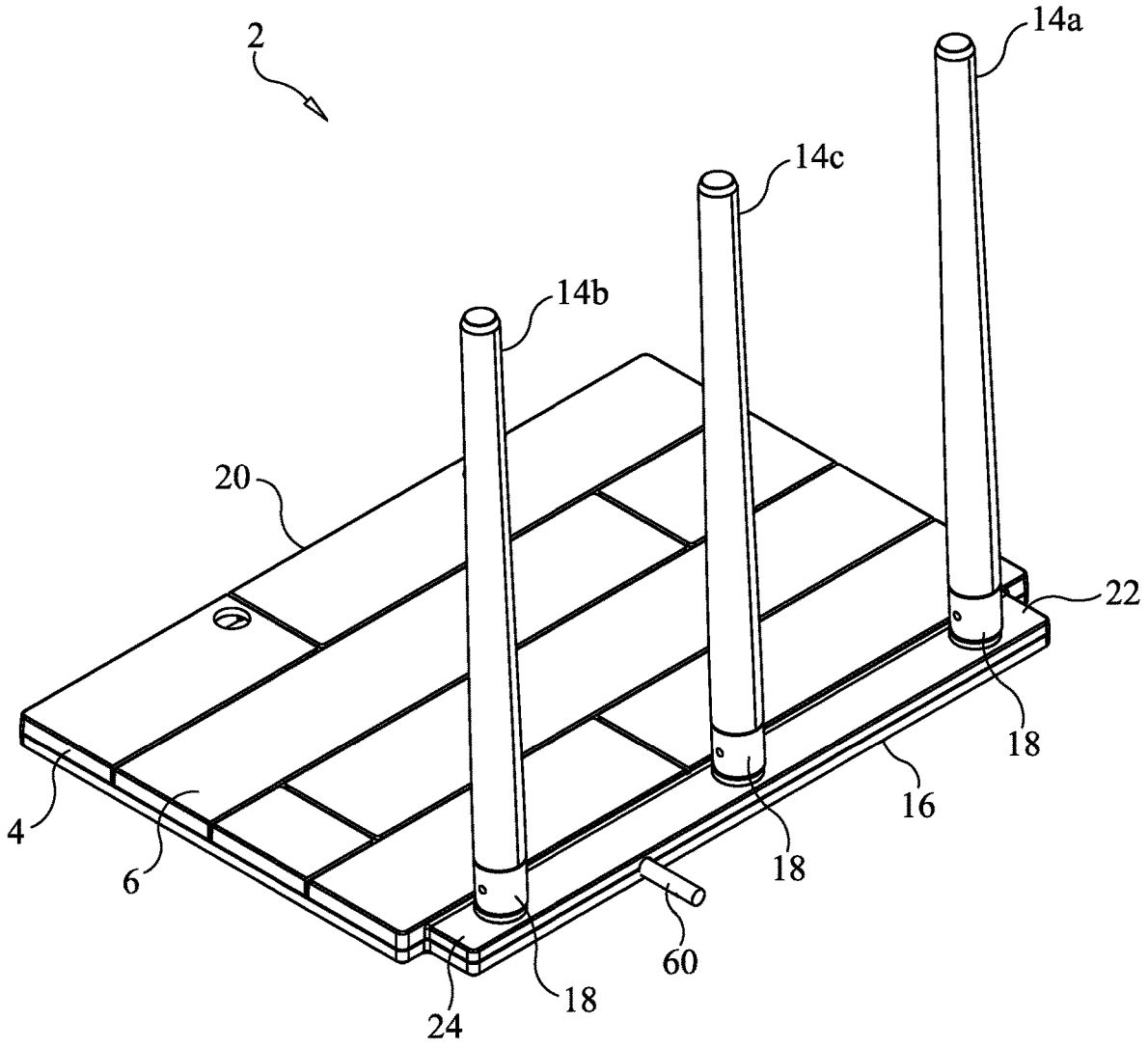
FIG. 1 is a top perspective view of an omni-directional television antenna constructed in accordance with a first form of the present invention and including three foldable antenna elements, and illustrating the antenna elements thereof in an upright position.
Figure 2:
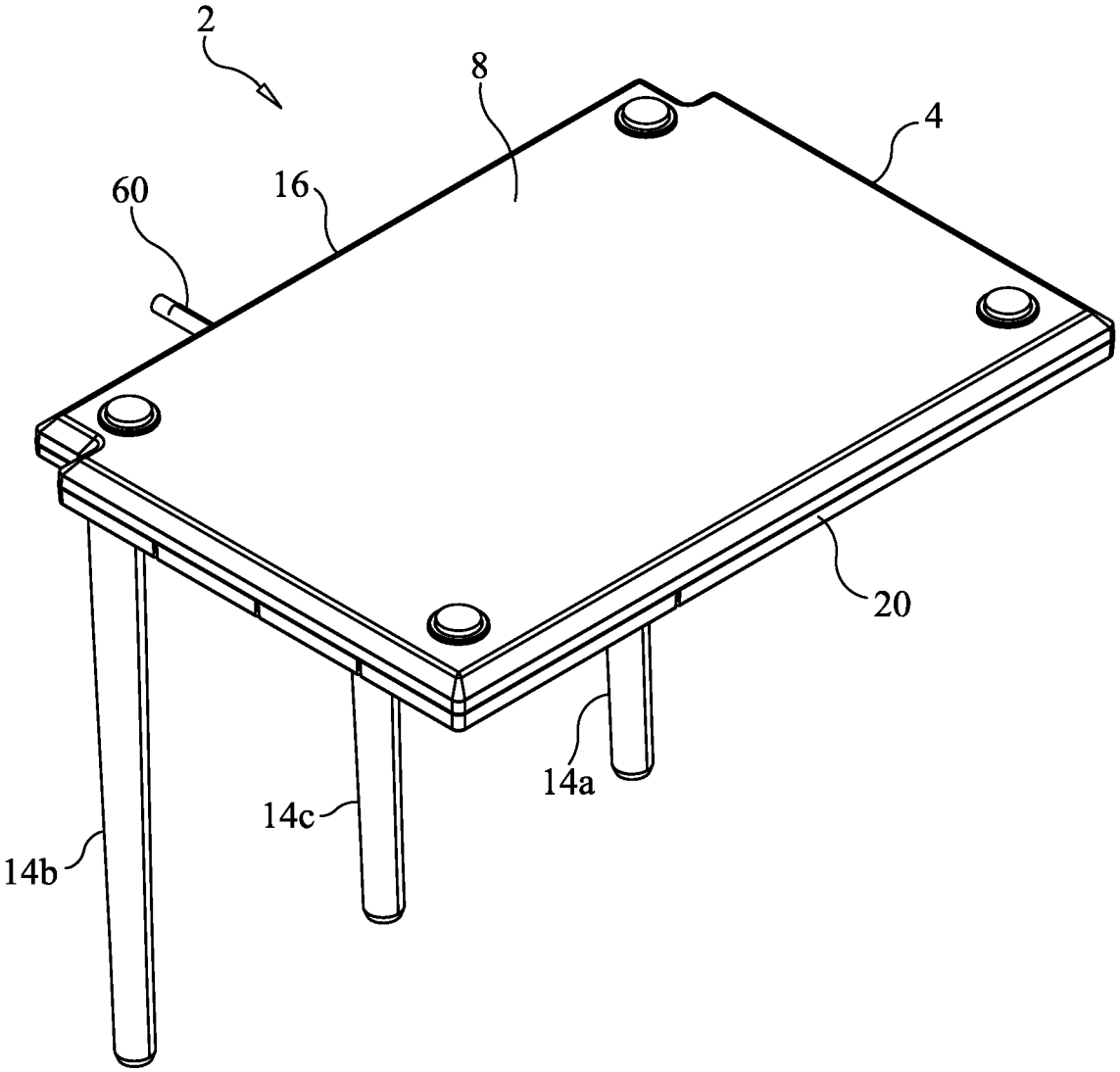
FIG. 2 is a bottom perspective view of the omni-directional television antenna of the present invention shown in FIG. 1.
Figure 3:
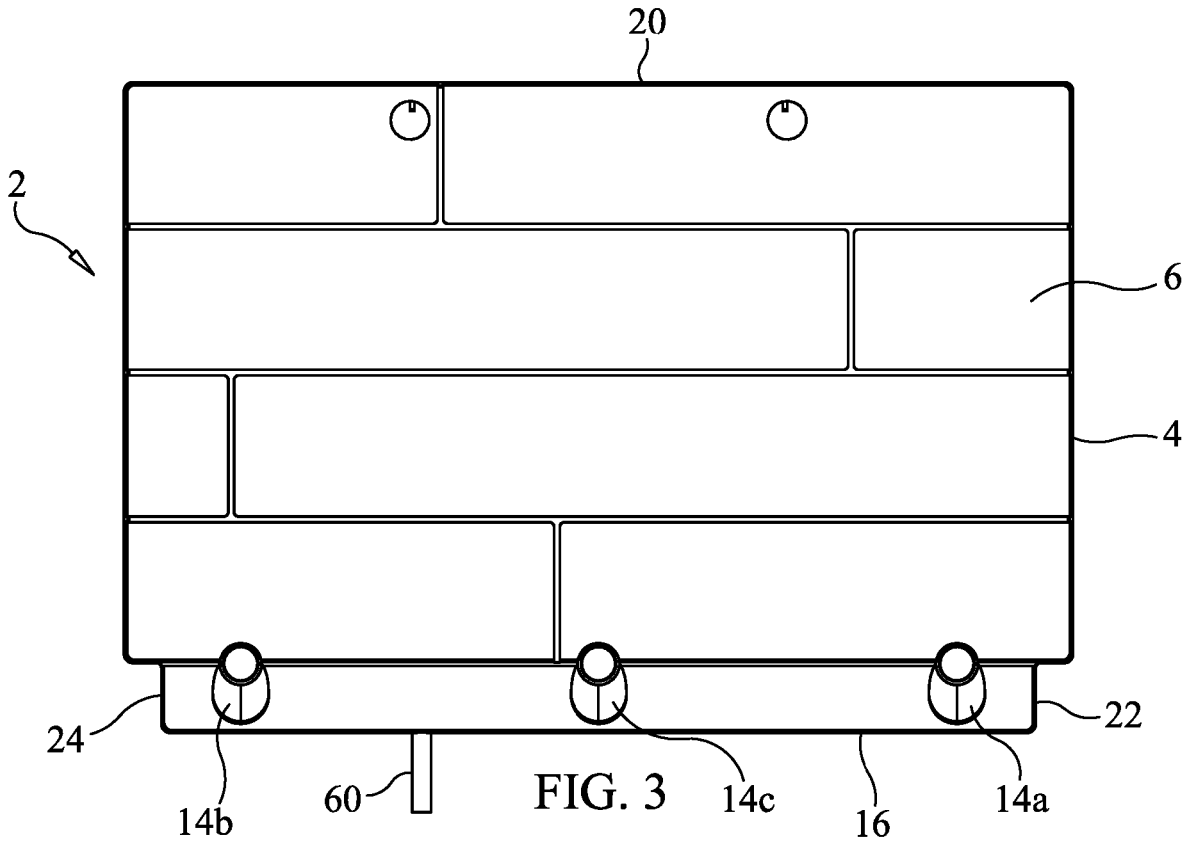
FIG. 3 is a top plan view of the omni-directional television antenna of the present invention shown in FIGS. 1 and 2.
Figure 4:
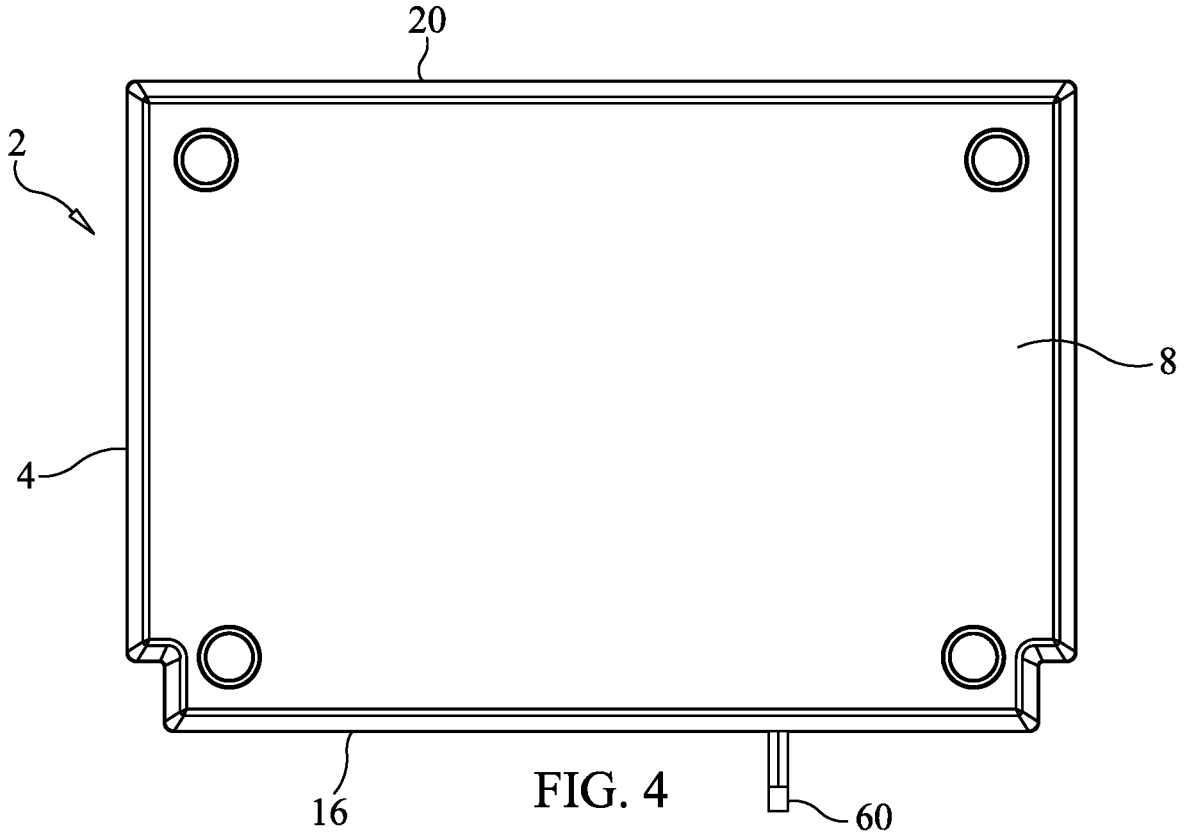
FIG. 4 is a bottom plan view of the omni-directional television antenna of the present invention shown in FIGS. 1-3.
Figure 5:
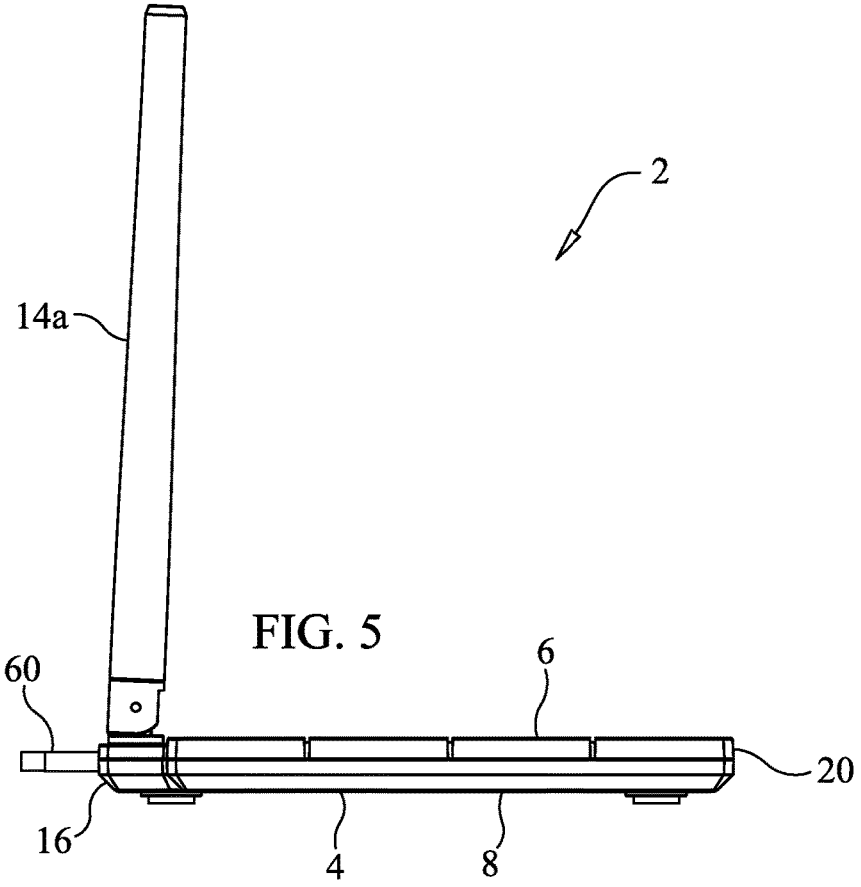
FIG. 5 is a right elevational view of the omni-directional television antenna of the present invention shown in FIGS. 1-4.
Figure 6:
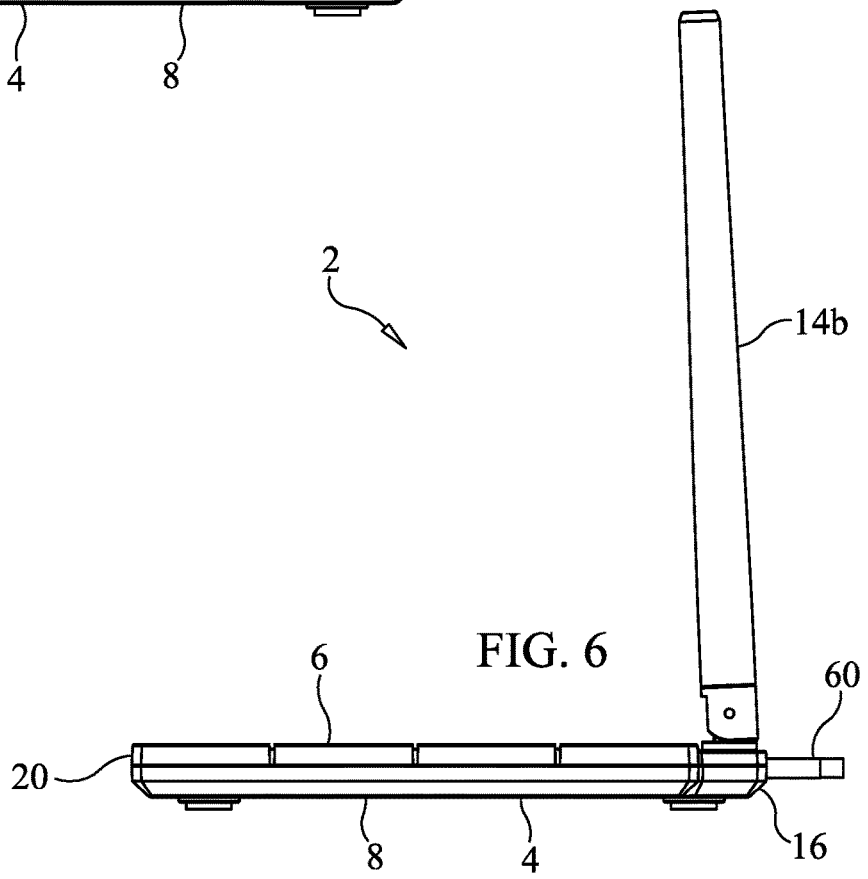
FIG. 6 is a left elevational view of the omni-directional television antenna of the present invention shown in FIGS. 1-5.
Figure 7:
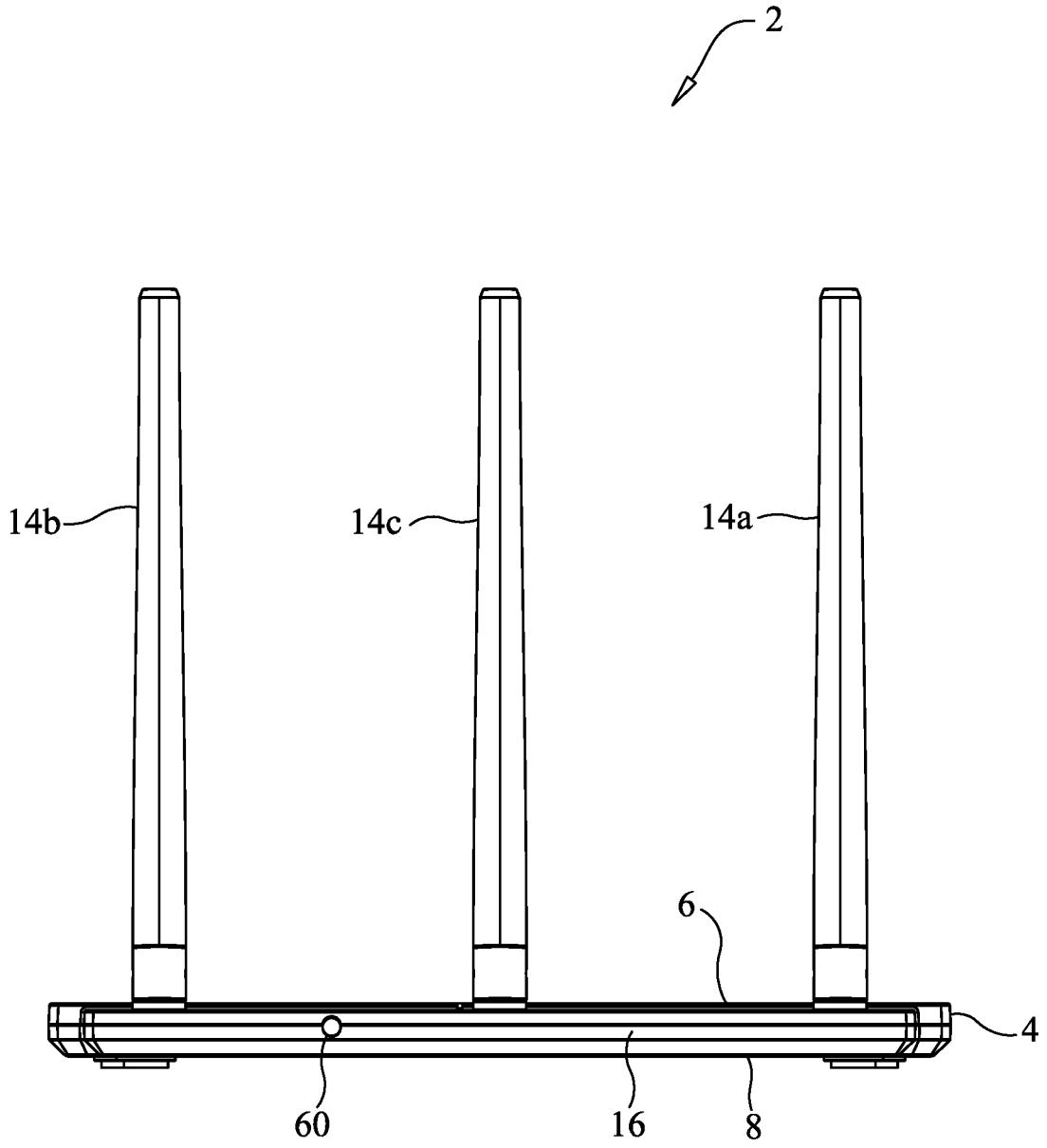
FIG. 7 is a rear elevational view of the omni-directional television antenna of the present invention shown in FIGS. 1-6.
Figure 8:
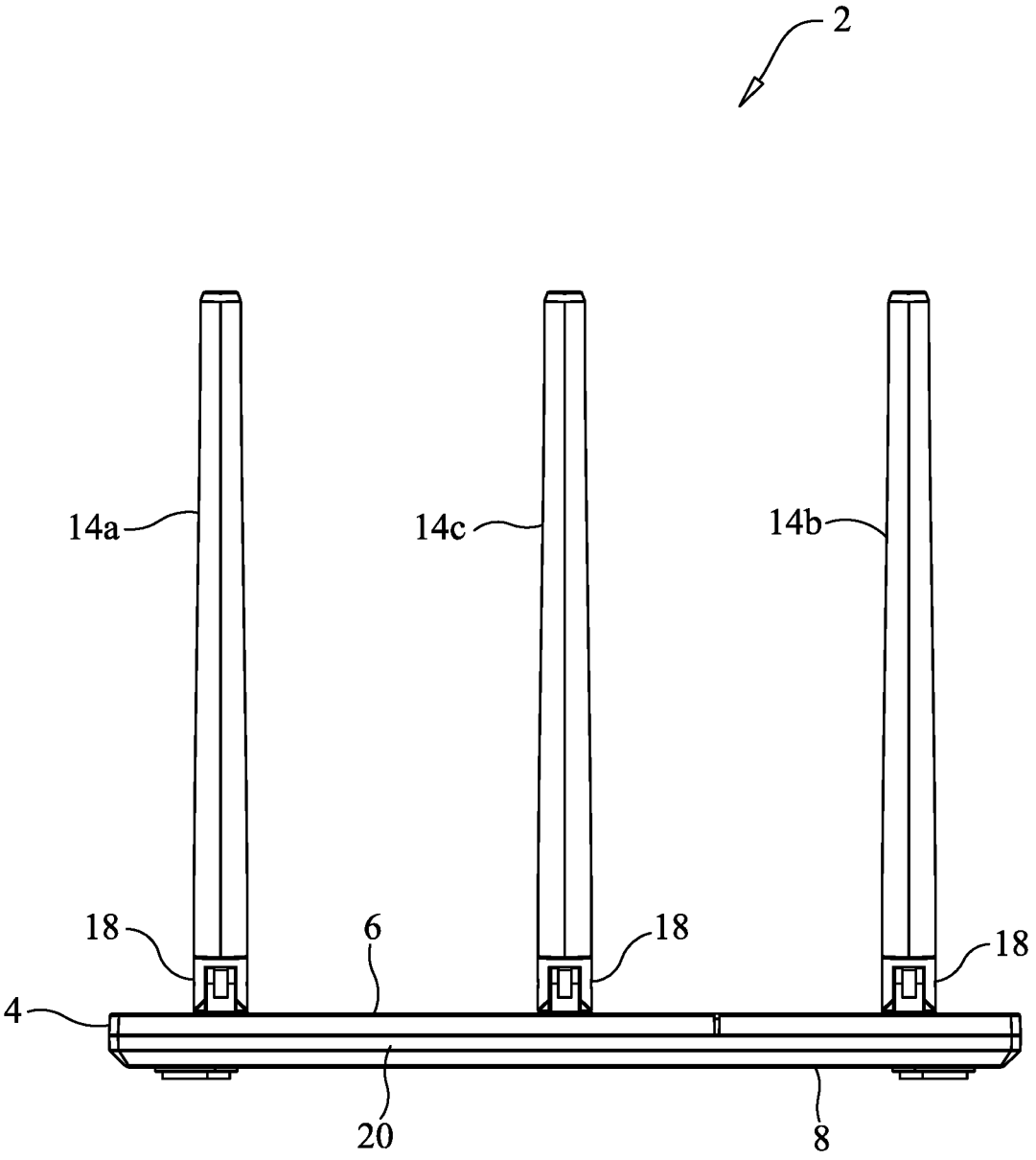
FIG. 8 is a front elevational view of the omni-directional television antenna of the present invention shown in FIGS. 1-7.
Figure 9:
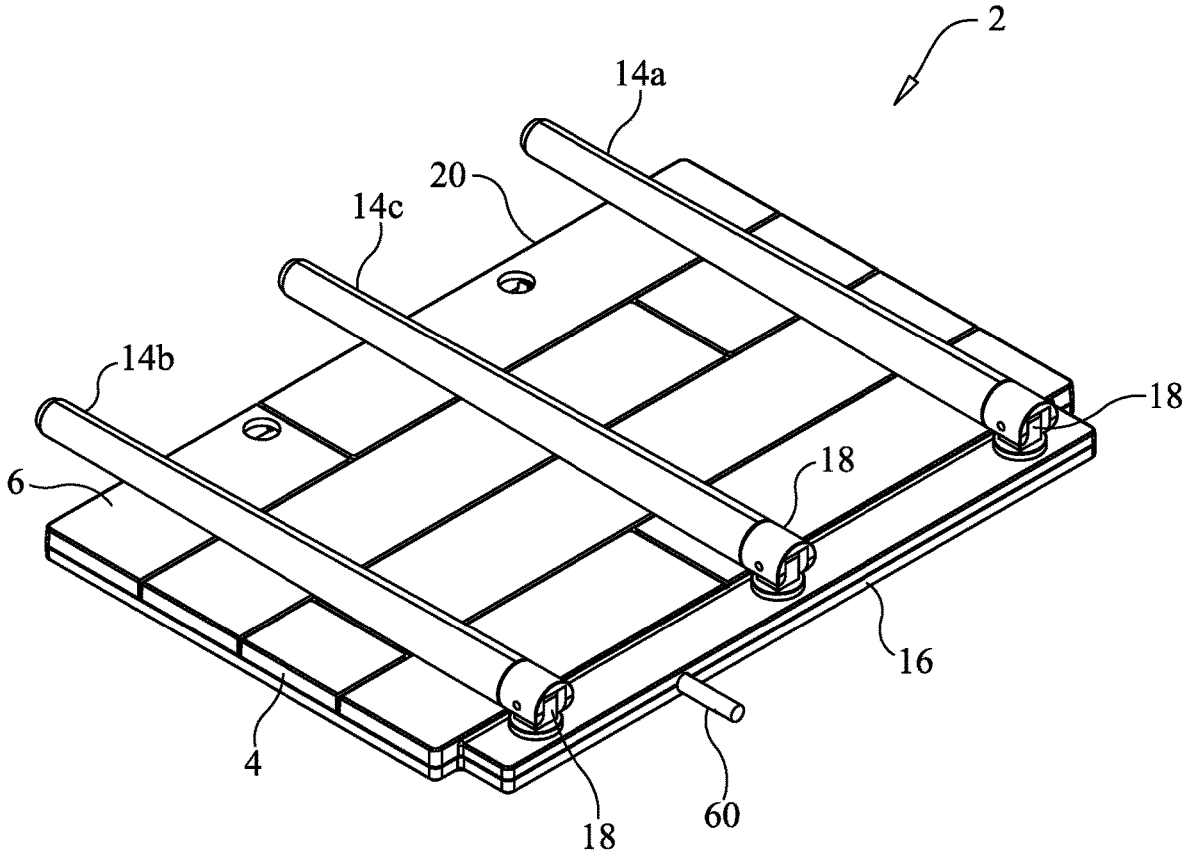
FIG. 9 is a top perspective view of the omni-directional television antenna shown in FIGS. 1-8, and illustrating the three antenna elements folded on or in close proximity to the top surface of the housing of the television antenna.
Figure 10:
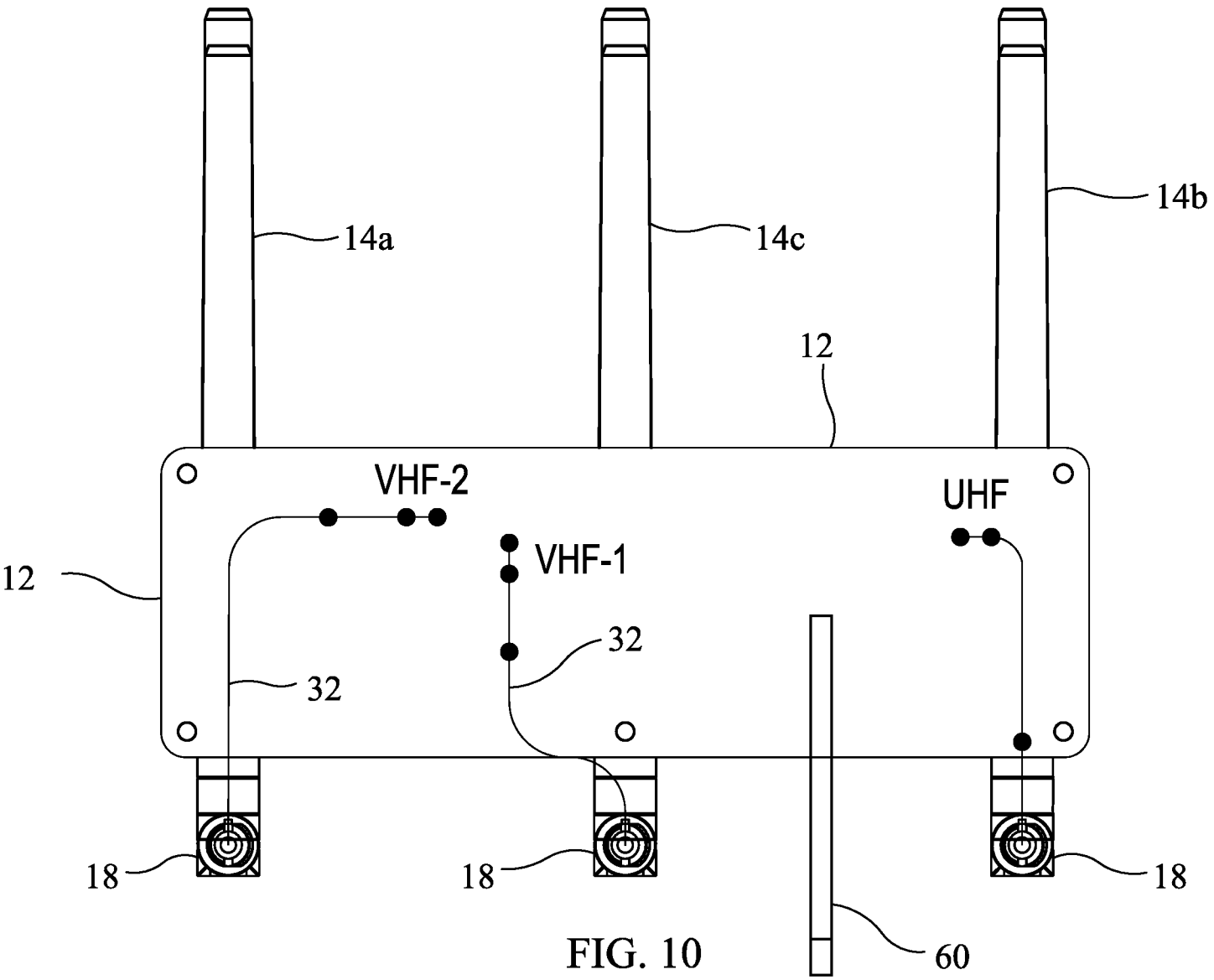
FIG. 10 is a top plan view of a printed circuit board used in the omni-directional television antenna of the present invention shown in FIGS. 1-9, and illustrating the connection of the printed circuit board to the three antenna elements.
Figure 11:
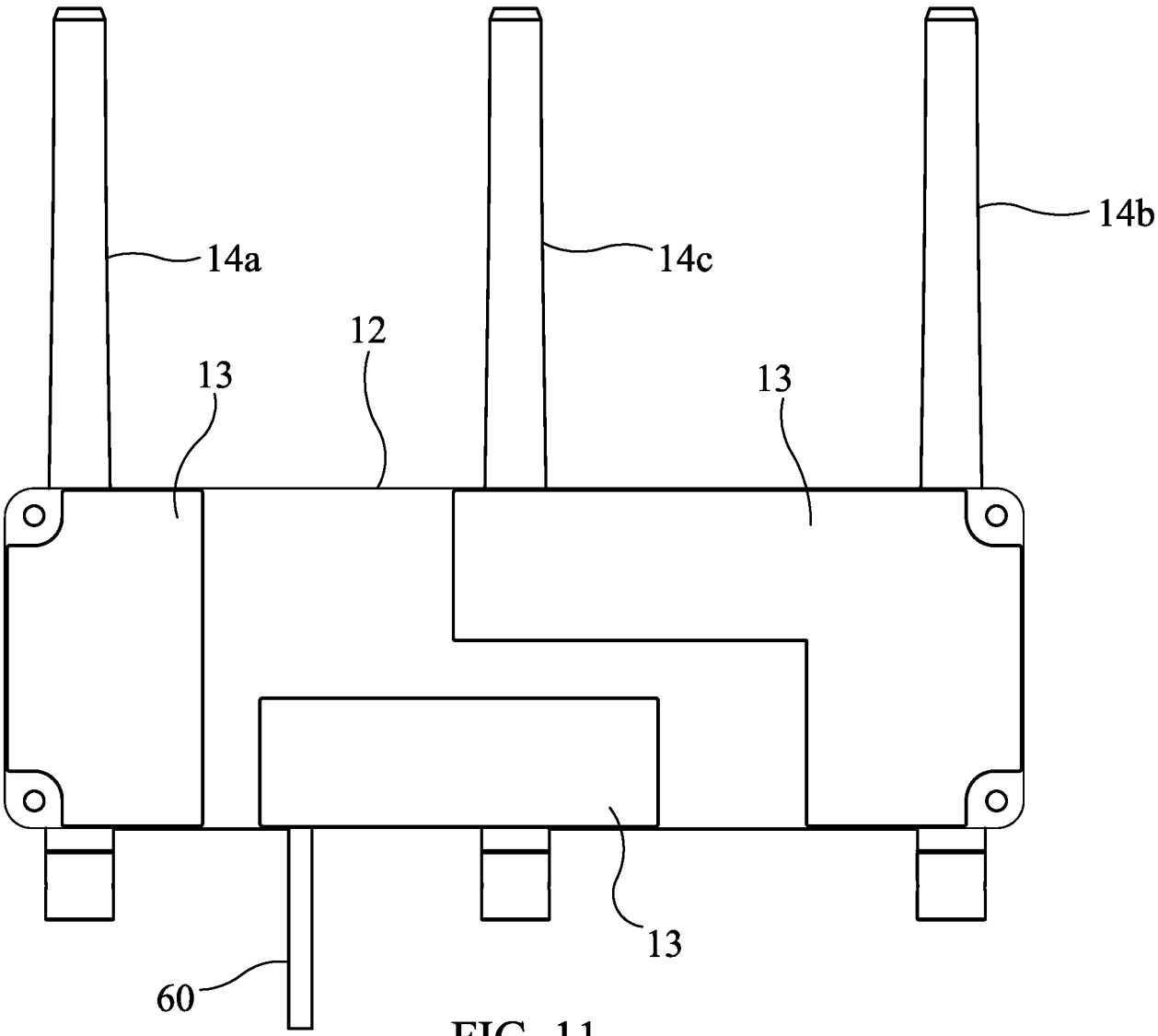
FIG. 11 is a bottom plan view of the printed circuit board shown in FIG. 10.

Referring initially to FIGS. 1-20 of the drawings, it will be seen that a three-pole version of an antenna 2 for receiving broadcast television signals in the VHF and UHF bands includes a substantially planar housing 4 having a top surface 6 and an opposite bottom surface 8 and defining an internal cavity in which the associated circuitry of the antenna is situated, as will be described in greater detail. The circuitry is mounted on a printed circuit board 12 situated within the internal cavity of the housing 4, which printed circuit board 12 includes one or more ground planes 13 which act as a reflective element for the UHF, VHF and WiFi antenna elements 14.

Mounted on the top surface 6 of the housing 4 of the antenna 2 are three spaced apart antenna elements 14, at least in the first form of the television antenna 2 being currently described. More specifically, the antenna elements 14 are mounted on the top surface 6 of the housing 4 in proximity to a first lateral side wall 16 of the housing 4. Each of the antenna elements 14 is mounted to the housing 4 through a hinge or pivot coupling 18 so that each antenna element 14 may be folded downwardly, against or in close proximity to the top surface 6 of the housing 4 in a horizontal state to provide the television antenna 2 with a compact form for shipping or when not in use. When the television antenna 2 is being used, each antenna element 14 may be pivoted on its coupling 18 to a vertical state, perpendicular to the top surface 6 of the antenna housing 4, for reception of broadcast television signals in the VHF and UHF bands. The VHF frequency band to which the antenna 2 is responsive is from about 174 MHz to about 216 MHz, and the UHF frequency band to which the antenna 2 is responsive is from about 470 MHz to about 698 MHz.

The three antenna elements 14 are preferably mounted in proximity to the first lateral side wall 16 of the antenna housing 4 so that, when folded over the top surface 6 of the housing 4, the antenna elements 14 extend up to or slightly beyond the opposite second lateral side wall 20 of the antenna housing 4.

The antenna elements 14 are preferably arranged linearly and spaced apart from one another along or near the first lateral side wall 16 of the antenna housing 4 on the top surface 6 thereof. A first VHF antenna element 14*a* is situated in proximity to one corner 22 of the housing 4, the UHF antenna element 14*b* is situated in proximity to another corner 24 of the antenna housing 4 laterally opposite the first corner 22 where the first VHF antenna element 14*a* is situated, and a second VHF antenna element 14*c* is situated in the middle of the length of the first lateral side wall 16 of the antenna housing 4 between the first VHF antenna element 14*a* and the UHF antenna element 14*b*.

Figure 12:
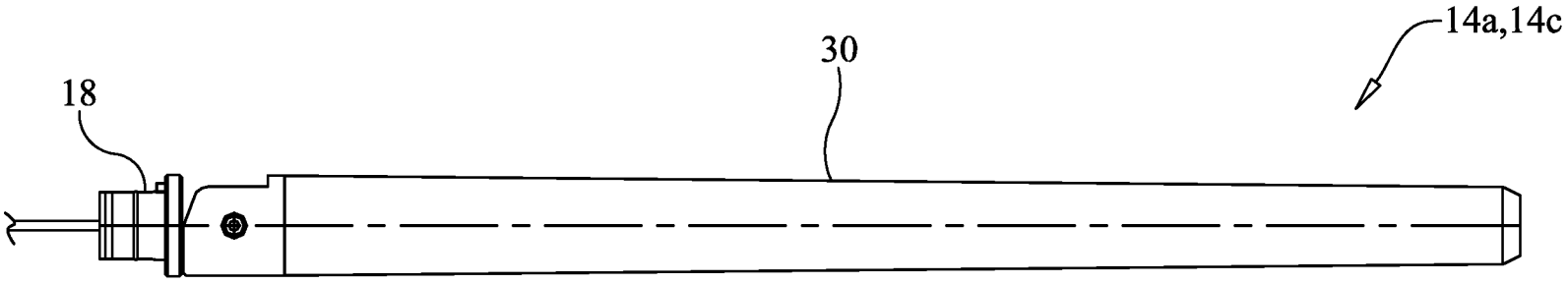
FIG. 12 is a side view of one of two VHF (Very High Frequency) antenna elements constructed in accordance with a first form of the present invention and forming part of the omni-directional television antenna of the present invention.
Figure 13:
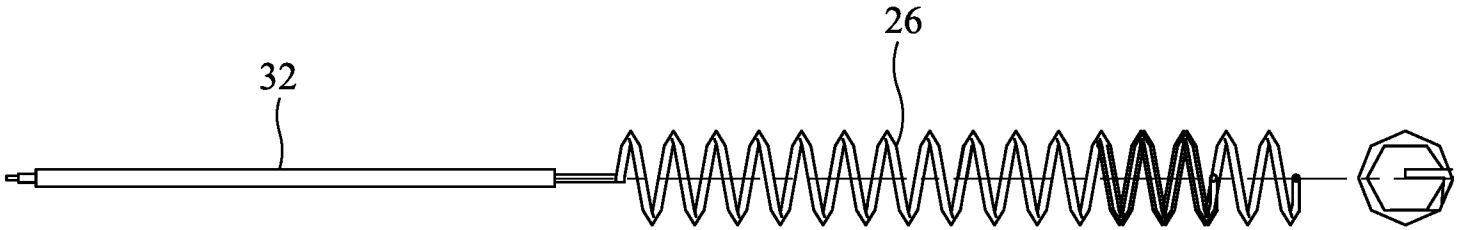
FIG. 13 is a side view of the VHF antenna element of the present invention shown in FIG. 12, with the cover of the antenna element removed.

The preferred structure of the VHF antenna elements 14*a*, 14*c* will now be described, and reference should be had to FIGS. 12 and 13 of the drawings. It will be seen from these figures that each VHF antenna element 14*a*, 14*c* is preferably formed as an end fed helical antenna. More specifically, the VHF antenna elements 14*a*, 14*c* are preferably formed as a coil 26 from helically wound magnet wire, the coil 26 having a transverse diameter of about 6.0 millimeters and being about 82.0 millimeters in length (which is about three inches), the element 14*a*, 14*c* having about 46 turns of magnet wire to form the coil 26. Preferably, a plastic or rubberized, non-conductive tube 28 is received within the helically wound coil 26 of the antenna element 14*a*, 14*c* to help support the element and act as a form, and the antenna element 14*a*, 14*c* is then encased in an outer covering 30 also formed from a plastic or rubberized, non-conductive material. The lowermost end of the helically wound coil 26 is connected to the inner conductor of an RG 178 cable 32 or its equivalent, the cable 32 preferably extending about 130.0 millimeters, the opposite end of the cable 32 being connected to the electrical circuitry on the printed circuit board 12 situated within the internal cavity of the housing 4.

Figure 14:
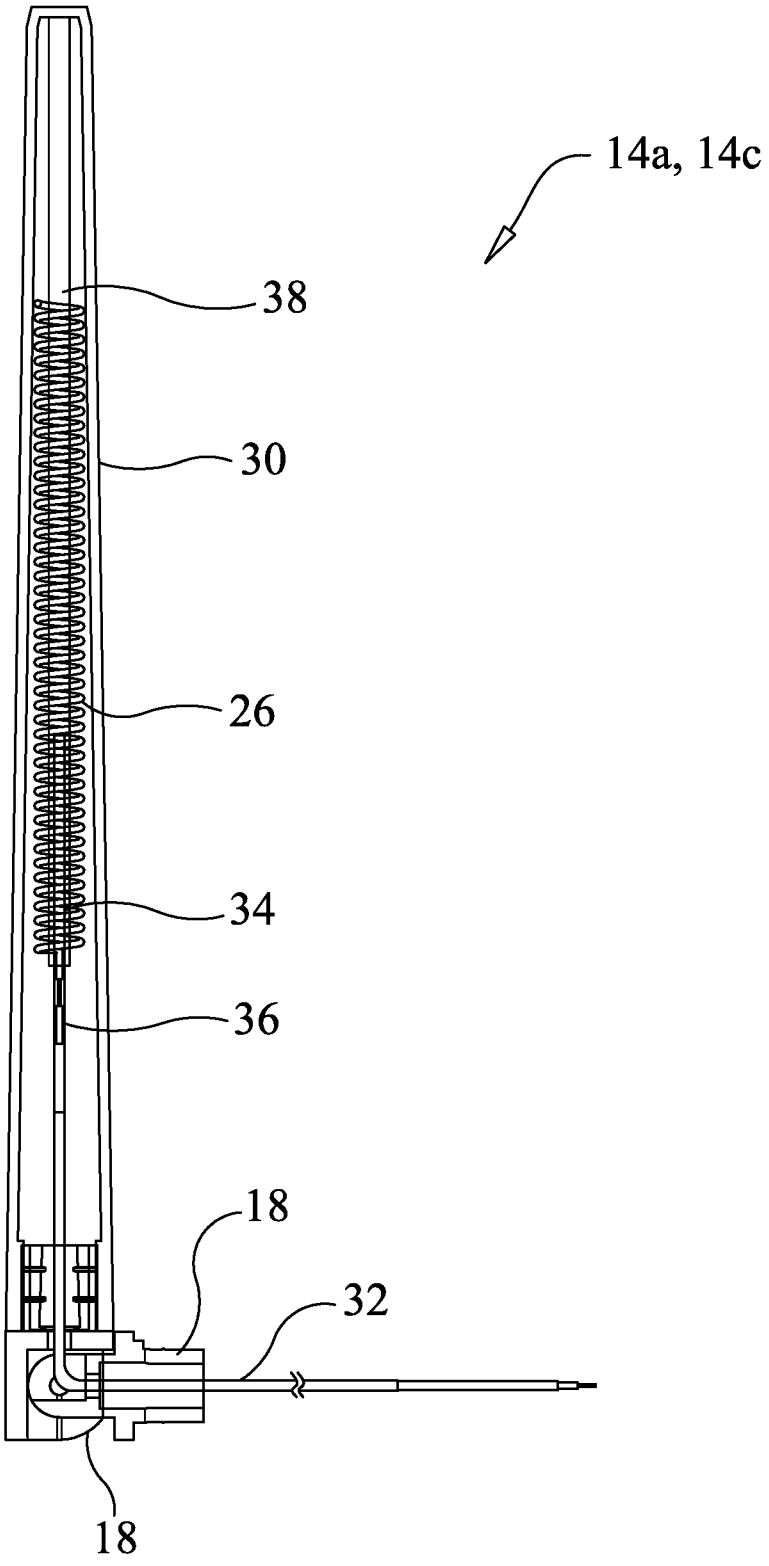
FIG. 14 is a longitudinal cross-sectional view of one of two VHF antenna elements constructed in accordance with a second form of the present invention and forming part of the omni-directional television antenna of the present invention.

An even more preferred form of each VHF antenna element 14*a*, 14*c* is shown in FIG. 14 of the drawings. From the base of its pivot coupling 18 (i.e., at the top surface 16 of the antenna housing 4) to its opposite free end, the VHF antenna element 14*a*, 14*c* preferably has a length of about 159 millimeters. The RG 178 coaxial cable 32 extends from its connection on the printed circuit board 12 through the pivot coupling 18 and into the open lower end of the outer cover 30. The outer cover 30 is preferably made from a rigid plastic material, such as a thermoplastic polyester elastomer (TPEE) having a tapered shape with an inner diameter near its top closed free end of about 8.1 millimeters and an axial length of about 146 millimeters from its closed top end to its open bottom end where it is mounted on the pivot coupling 18 (which has a height of about 12 millimeters).

The cable 32 passes through a lower section of shrink tubing 34 within the antenna element cover 30 which extends from into the pivot coupling 18 to near or into the beginning of the helically wound coil 26. This first shrink tubing 34 preferably has an inner diameter of about 5 millimeters and a length of about 45 millimeters, and provides support for the coaxial cable 32 within the antenna element cover 30.

The outer insulative sheath and shield of the coaxial cable 32 are terminated about one-fifth (⅕) to about one-quarter (¼) up the length of the antenna element cover 30, and the inner insulative cover of the cable 32 is removed slightly above where the shield and outer sheath are terminated to expose the inner conductor of the coaxial cable 32, which is electrically connected to the lowermost end of the helically wound coil 26. For protection, a second shrink tubing 36 covers the terminated end of the coaxial shield and extends up to and over the connection of the inner conductor and the helically wound coil 26, the second shrink tubing 36 having an inner diameter of about 1.5 millimeters and a length of about 16 millimeters.

The radiating coil 26 is preferably a pre-formed torsion spring made from bronze and having Part No. C5191 W-H, manufactured by Yangzhou Donva Electronic Spring Co., Ltd. of China. The helically wound coil 26 is preferably about 84 millimeters in length and about 80 millimeters in diameter, and has about 45.5 turns of wire.

A third shrink tubing 38 extends axially within the helically wound coil 26 and acts as a support form for the coil 26. Preferably, this third shrink tubing 38 has an inner diameter of about 2.5 millimeters and a length of about 105 millimeters.

Preferably, the two VHF antenna elements 14*a*, 14*c* are spaced apart from each other a distance of about 77 millimeters so that there is mutual coupling between them. The mutual coupling between the VHF antenna elements 14*a*, 14*c* provides the television antenna 2 of the present invention with an omni-directional signal reception antenna pattern, as can be seen from FIGS. 18A-18G, substantially over the entire VHF frequency band. The two VHF antenna elements 14*a*, 14*c* function as broadside helical antennas as opposed to an endfire helical antenna to provide omni-directionality when the VHF antenna elements 14*a*, 14*c* are disposed in a vertical position. But, each of the VHF antenna elements 14*a*, 14*c* possibly could be structured as a modified coaxial sleeve antenna, which will be described in detail in connection with the UHF antenna element 14*b*.

Figure 15:
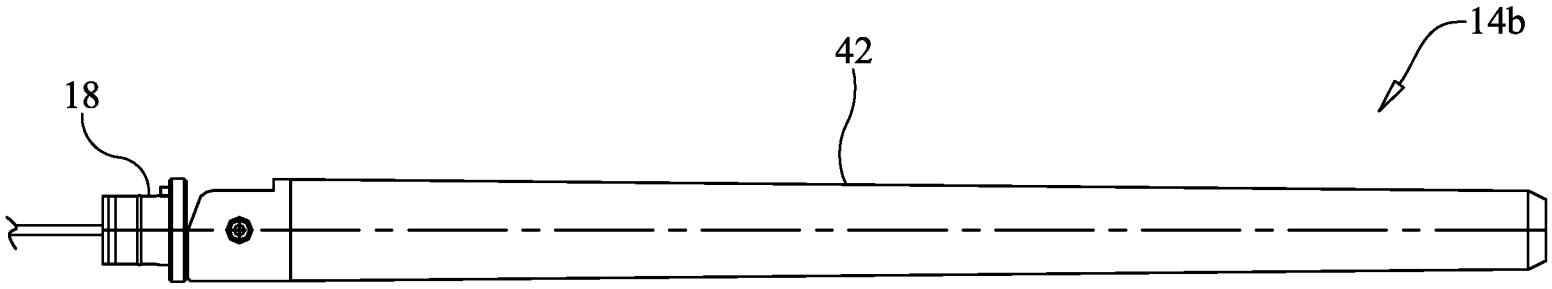
FIG. 15 is a side view of a UHF (Ultra High Frequency) antenna element constructed in accordance with a first form of the present invention and forming part of the omni-directional television antenna of the present invention.
Figure 16:
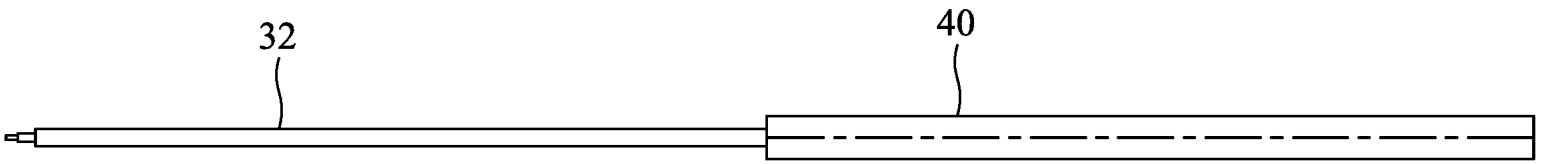
FIG. 16 is a side view of the UHF antenna element of the present invention shown in FIG. 15, with the cover of the antenna element removed.

The UHF antenna element 14*b* of the television antenna 2 of the present invention is preferably formed as a modified coaxial sleeve antenna, and reference should be had to FIGS. 15 and 16, which show the structure of this UHF antenna element 14*b*. More specifically, in one preferred form, the UHF antenna element 14*b* includes a brass tube 40 which acts like a sleeve radiator, situated inside an outer covering 42. The shield and outer insulated layer of the electrical signal cable 32 feeding the antenna element 14*b* are terminated to reduce capacitive loading over the UHF frequency band. The size of the brass tube 40, acting as a sleeve radiator, is preferably about 5.2 millimeters in diameter and about 72 millimeters in length. The feed point of the UHF antenna element 14*b* is on the printed circuit board 12 within the internal cavity of the housing 4 of the television antenna 2. The coaxial cable 32 which feeds the antenna element 14*b* is preferably an RG 178 cable or its equivalent and forms part of the UHF antenna element 14*b*. Also, the printed circuit board 12 includes a ground plane 13 as a copper-clad trace on the printed circuit board 12 and this, also, forms part of the UHF antenna element 14*b*.

In a typical coaxial sleeve antenna, the shield of the coaxial cable extends through the bore of the sleeve and is terminated at the top axial end of the sleeve, where the sleeve extends downwardly therefrom and acts as a radiating element. The inner conductor of the coaxial cable normally extends axially to the sleeve through the top end of the sleeve and beyond the top end by a selected distance, the inner conductor acting as a second radiating element.

The UHF antenna element 14*b* of the present invention is different in structure from a conventional coaxial sleeve antenna. The coaxial shield of the cable 32 is grounded on the printed circuit board 12 at the ground plane 13 thereon and extends upwardly into the open axial bottom end of the sleeve or tube 40 and axially at least partially along the length thereof without touching the sleeve or tube 40, the shield still being encased by the outer, non-conductive protective layer of the coaxial cable 32. The inner conductor of the coaxial cable 32 continues through the bore of the sleeve or tube 40 until it reaches the top closed axial end of the sleeve 40 to which it is electrically connected. Prior to its reaching the top closed end of the sleeve 40, the coaxial shield and outer insulative covering are terminated (i.e., sections above this point are removed), with the inner conductor and the inner insulative covering continuing upwardly through the sleeve bore. The insulative layer of the inner conductor is only removed at the cable end where the inner conductor is connected to the top closed axial end of the sleeve or tube 40 so that the inner conductor does not touch the inner side wall of the sleeve 40 as it passes through the bore thereof to the top closed end of the sleeve 40 to which it is connected. Thus, with this preferred form of the UHF antenna element 14*b*, the outer shield of the lower portion of the coaxial cable 32, below the sleeve 40, acts as a first lower vertical radiating element, and the sleeve 40 to which the inner conductor is connected acts as a second upper vertical radiating element. Accordingly, the UHF antenna element 14*b* is end fed at the printed circuit board 12 to which the coaxial cable 32 is connected, and the ground plane 13 formed as copper cladding on the printed circuit board 12 below the antenna element 14*b* and to which the outer shield of the coaxial cable 32 is connected acts as a reflective element and forms part of the structure of the UHF antenna element 14*b*.

Figure 17:
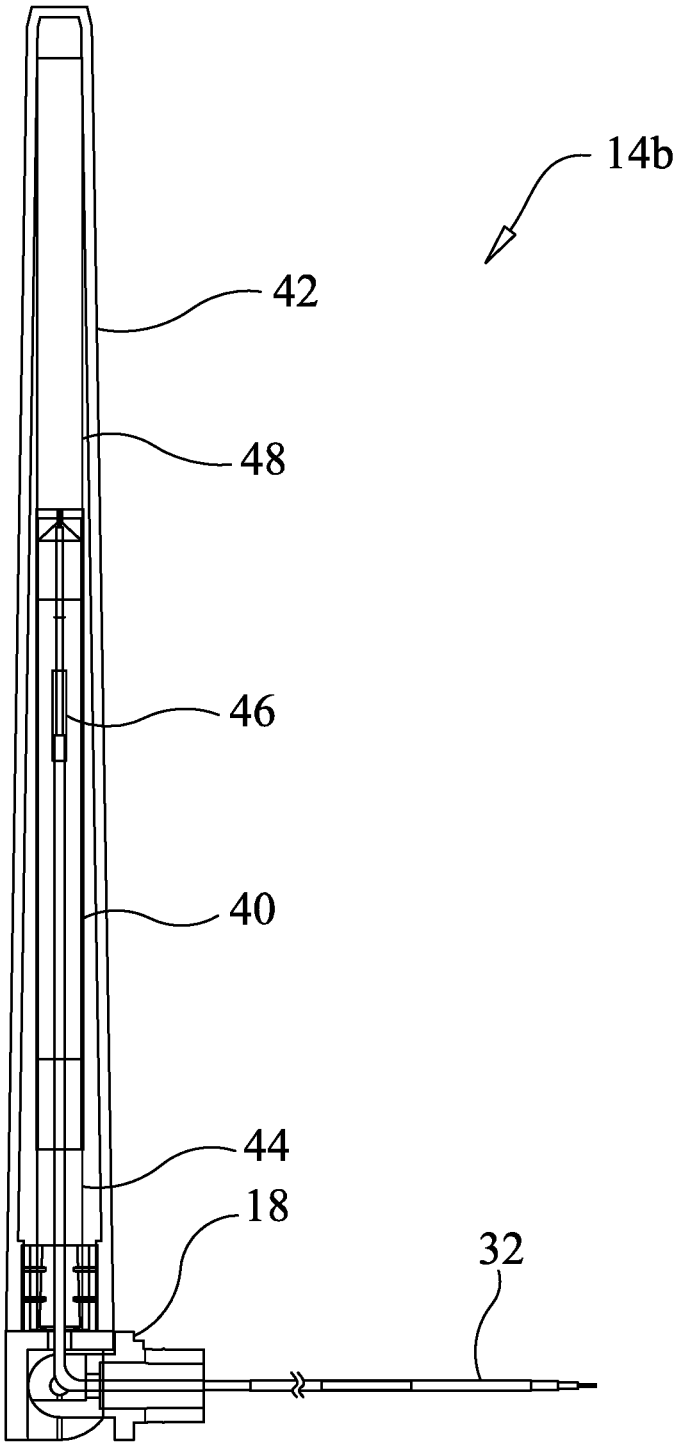
FIG. 17 is a longitudinal cross-sectional view of a UHF antenna element constructed in accordance with a second form of the present invention and forming part of the omni-directional television antenna of the present invention.
Figure 18A:
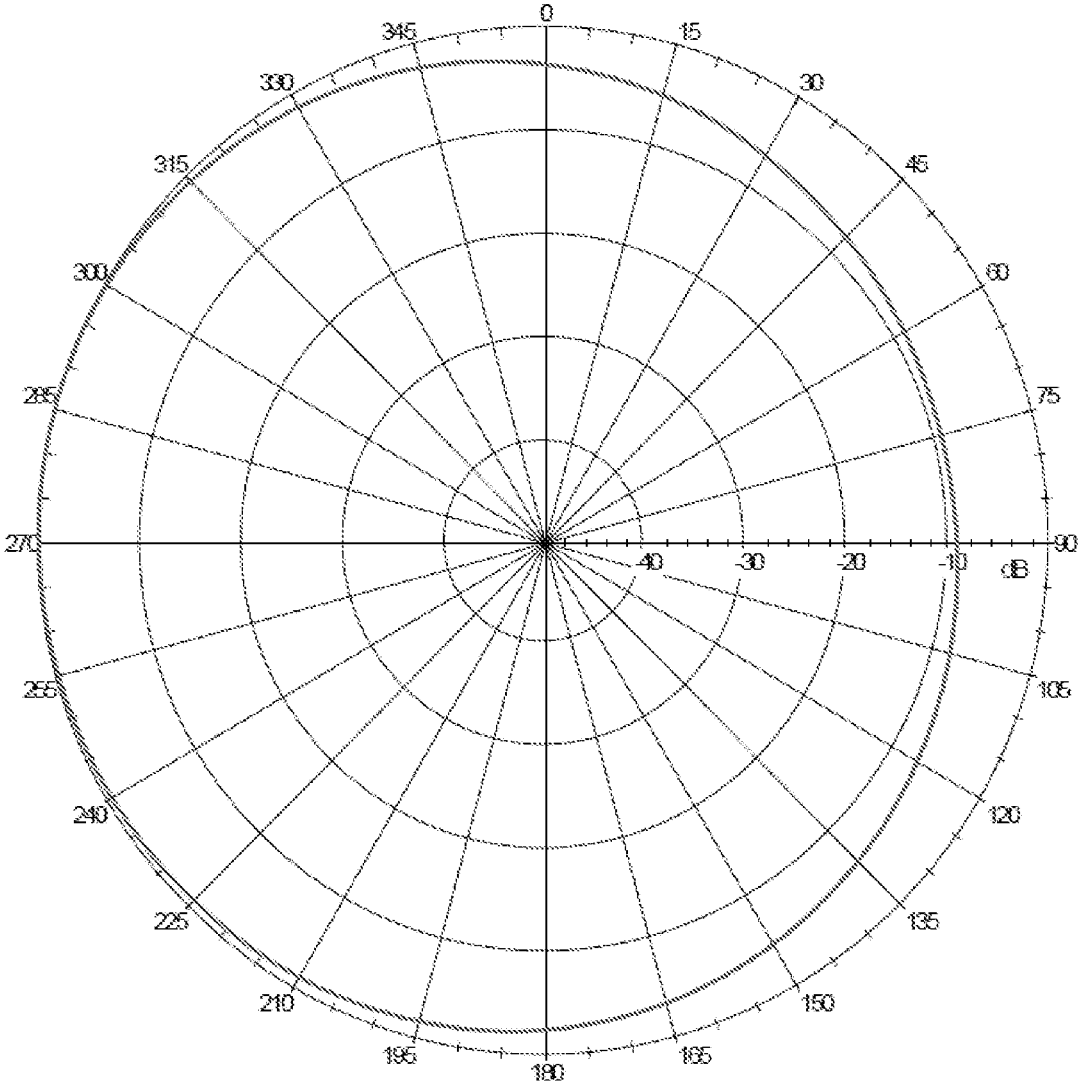
FIGS. 18A-18G are graphs of radiation patterns of the omni-directional television antenna of present invention shown in FIGS. 1-11 at various frequencies in the VHF band.
Figure 18B:
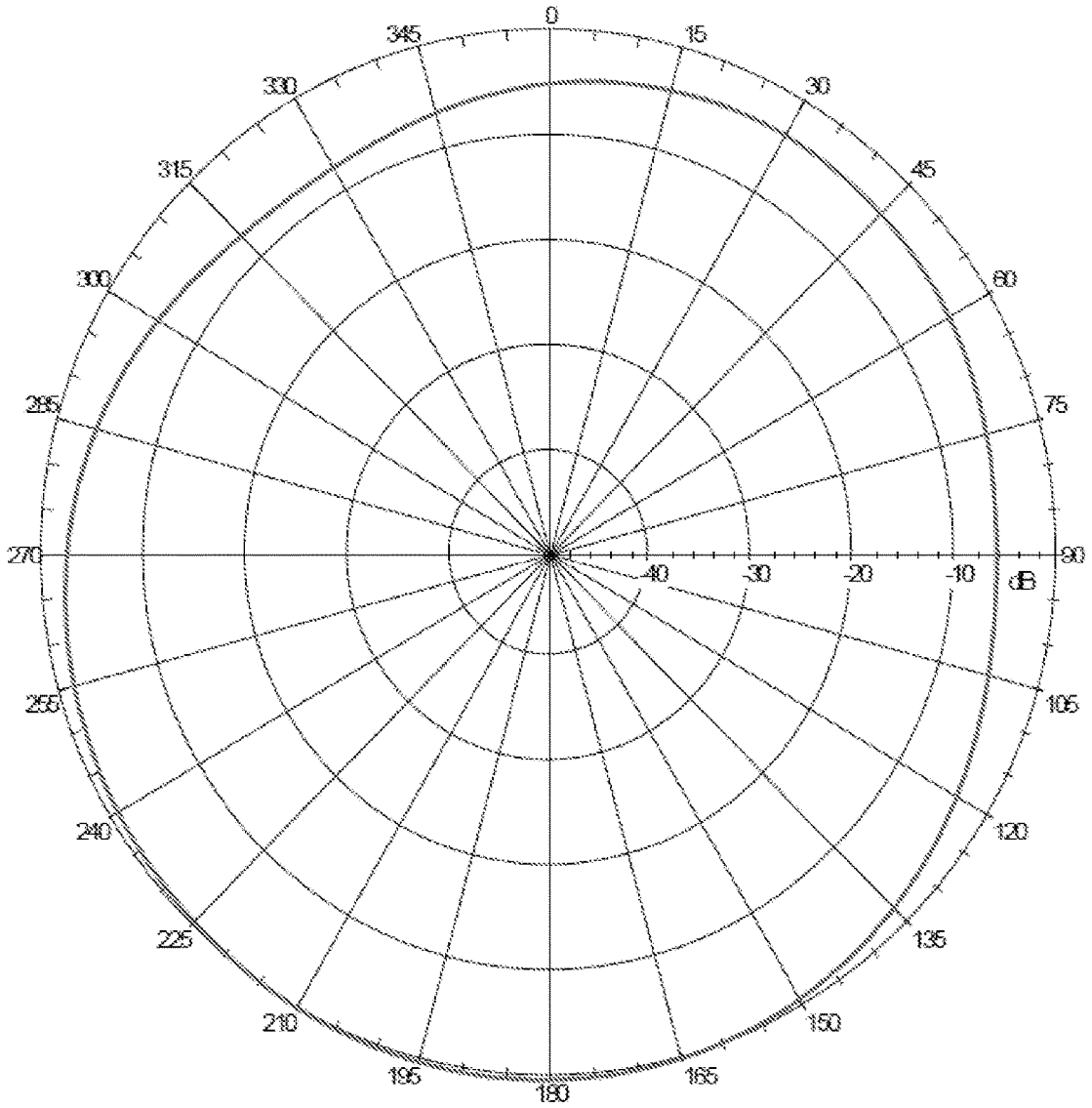
Figure 18C:
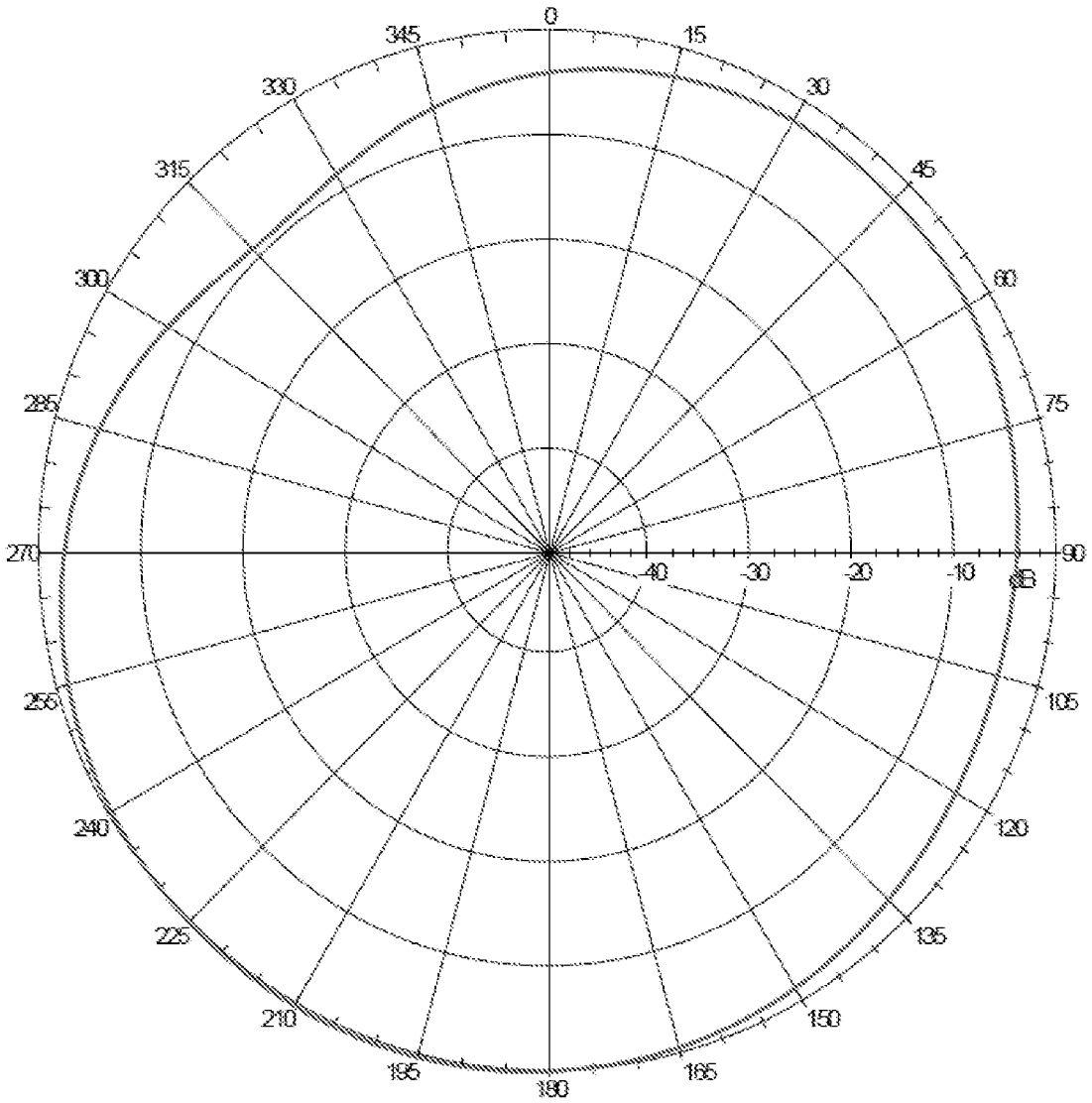
Figure 18D:
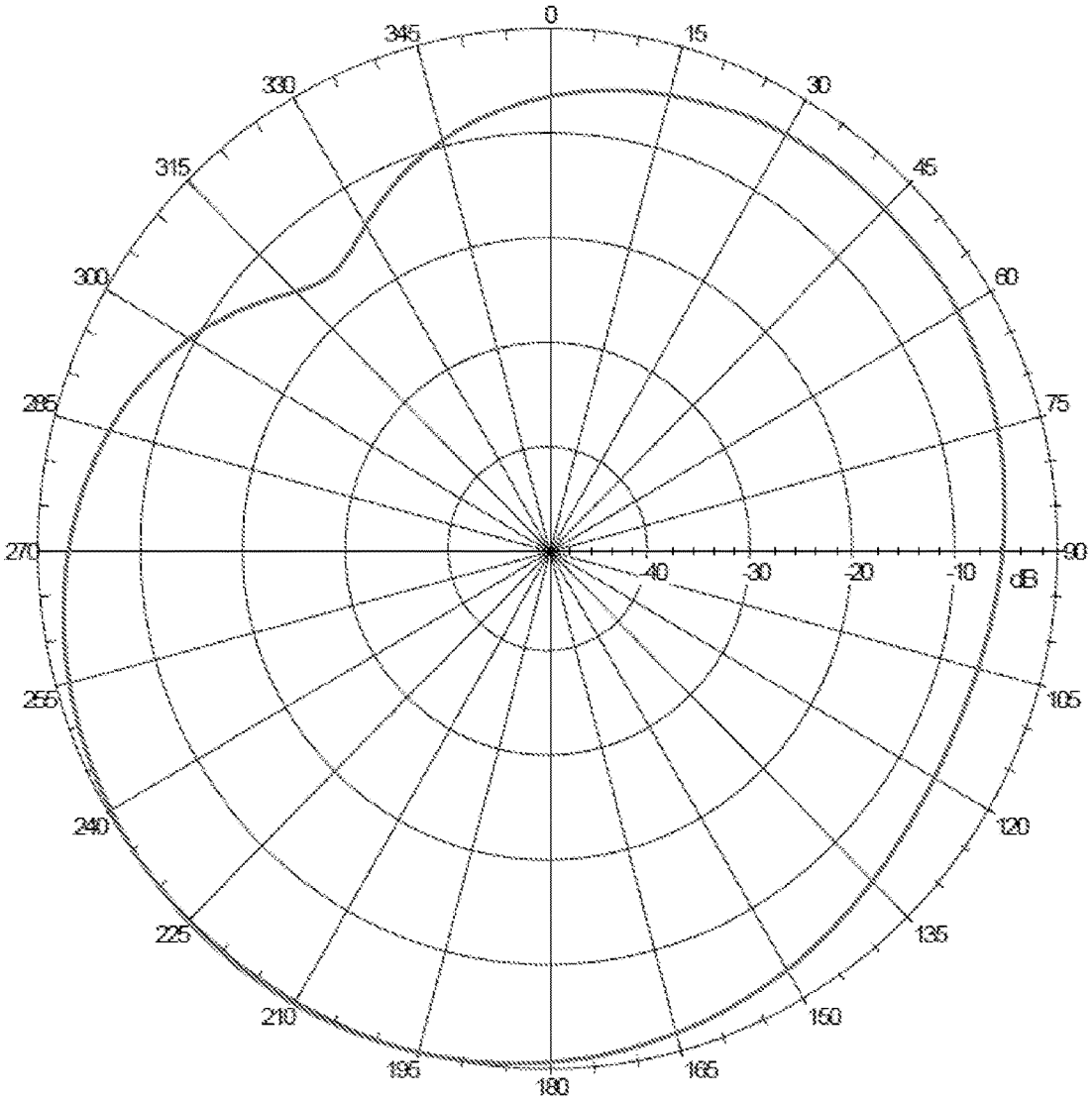
Figure 18E:
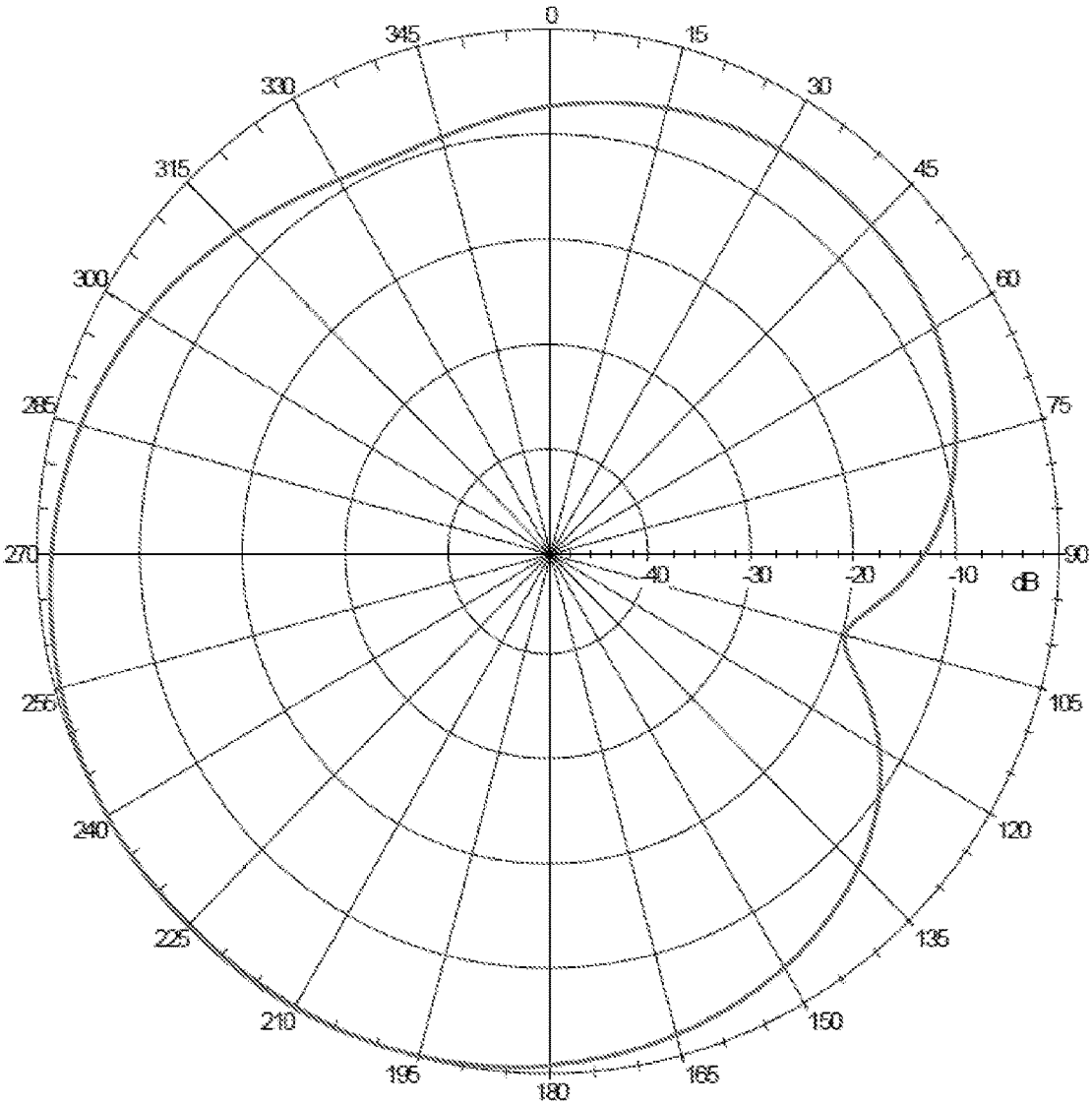
Figure 18F:
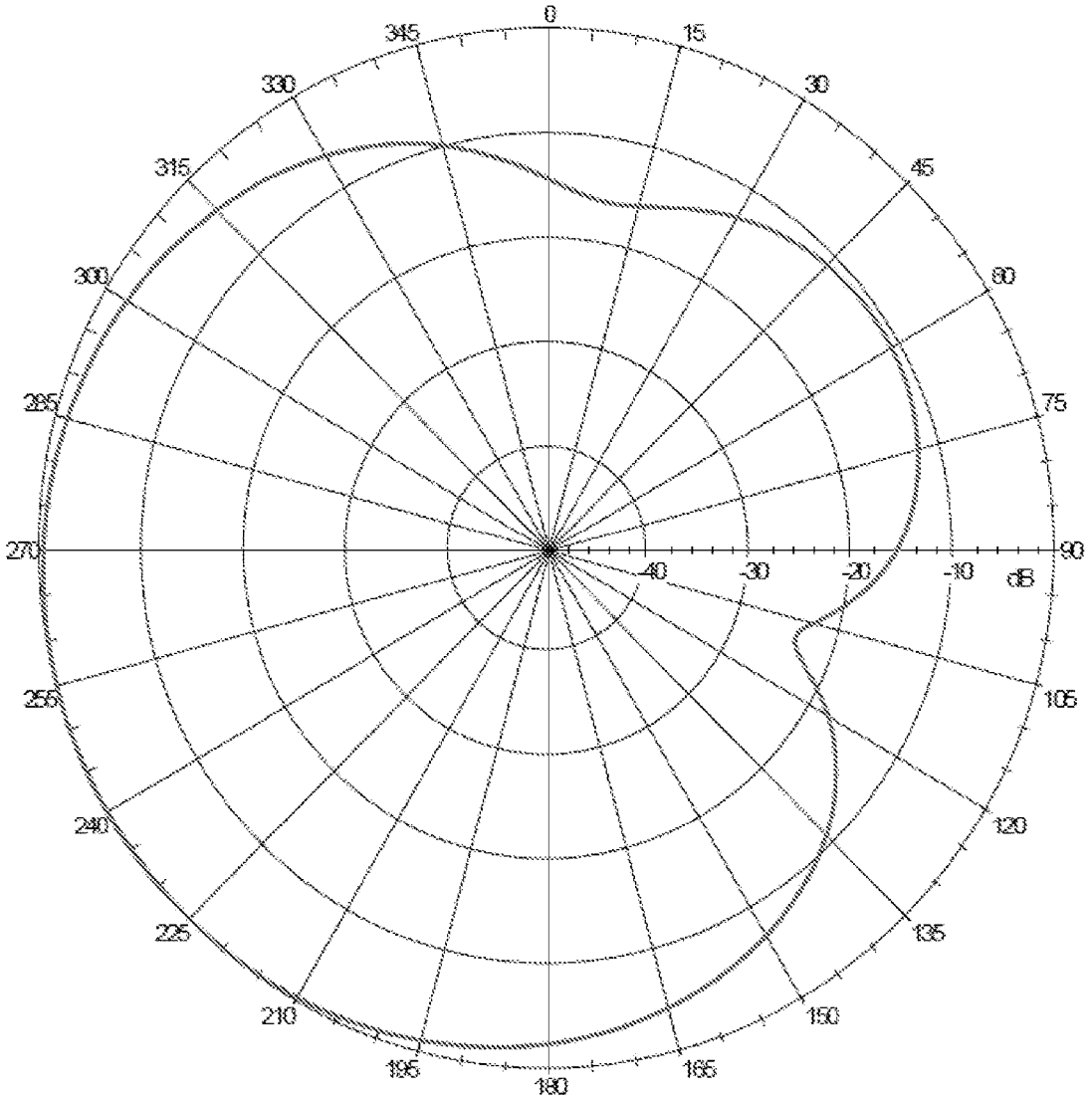
Figure 18G:
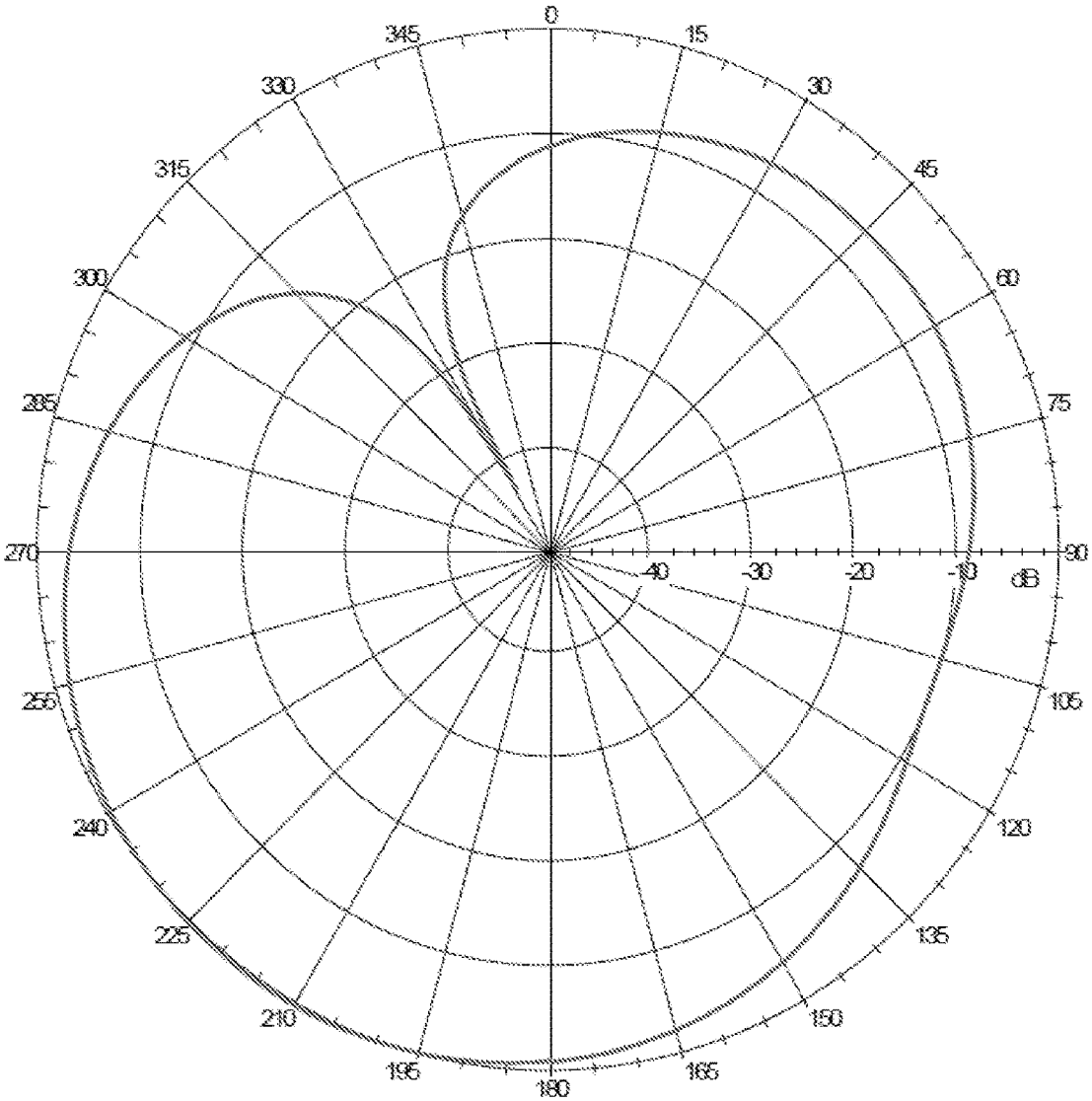
Figure 19A:
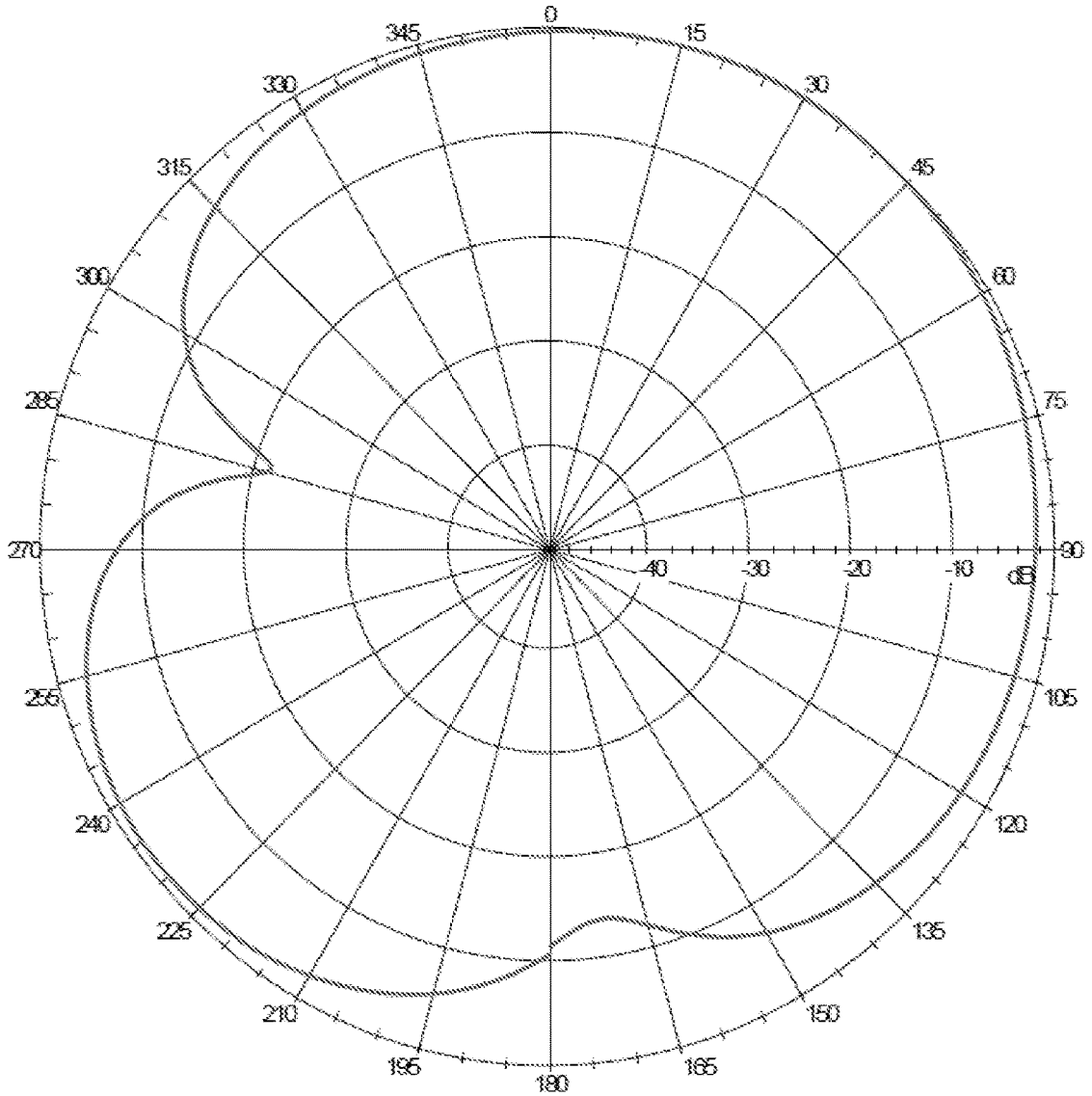
FIGS. 19A-19G are graphs of radiation patterns of the omni-directional television antenna of present invention shown in FIGS. 1-11 at various frequencies in the UHF band.
Figure 19B:
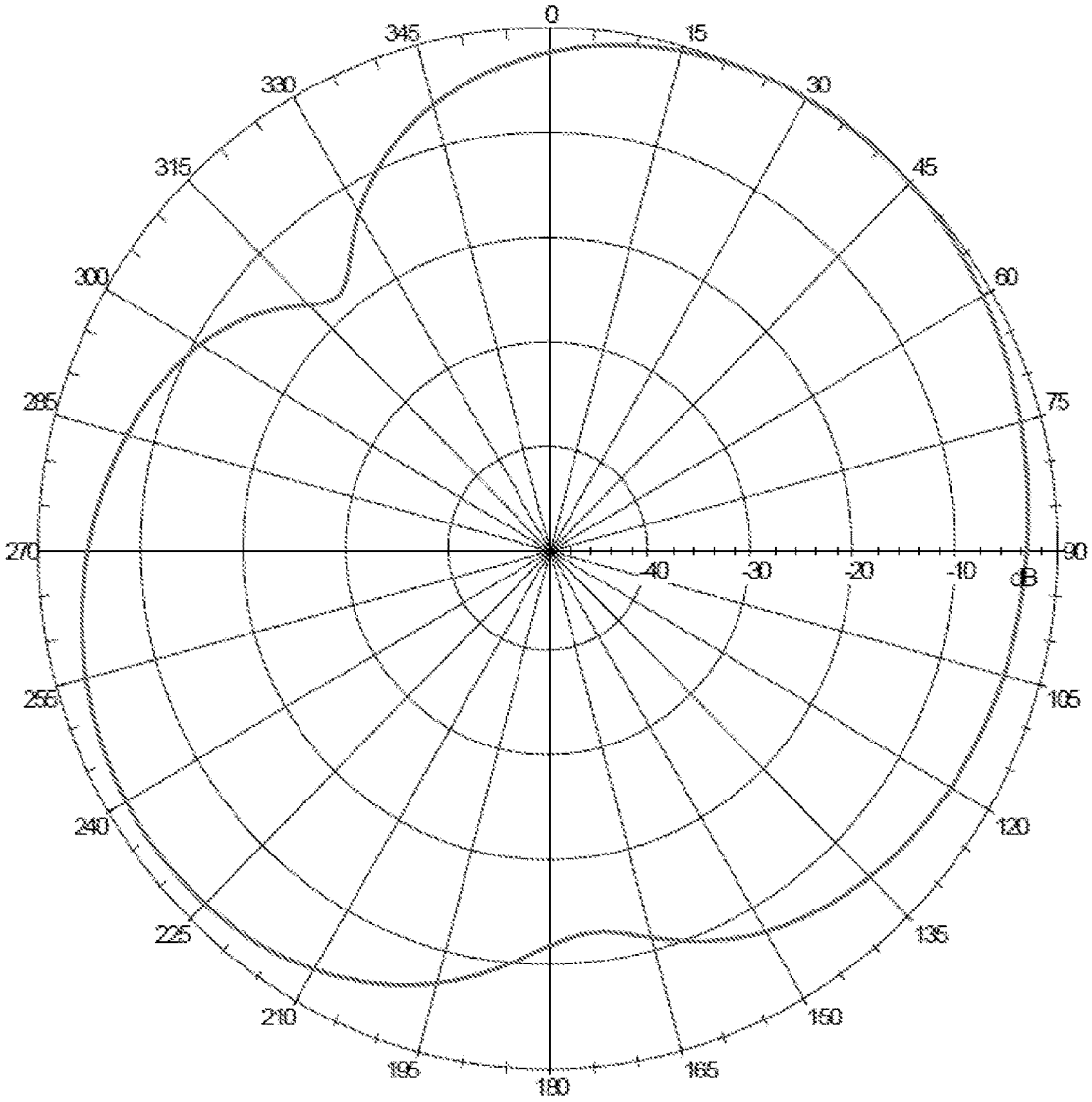
Figure 19C:
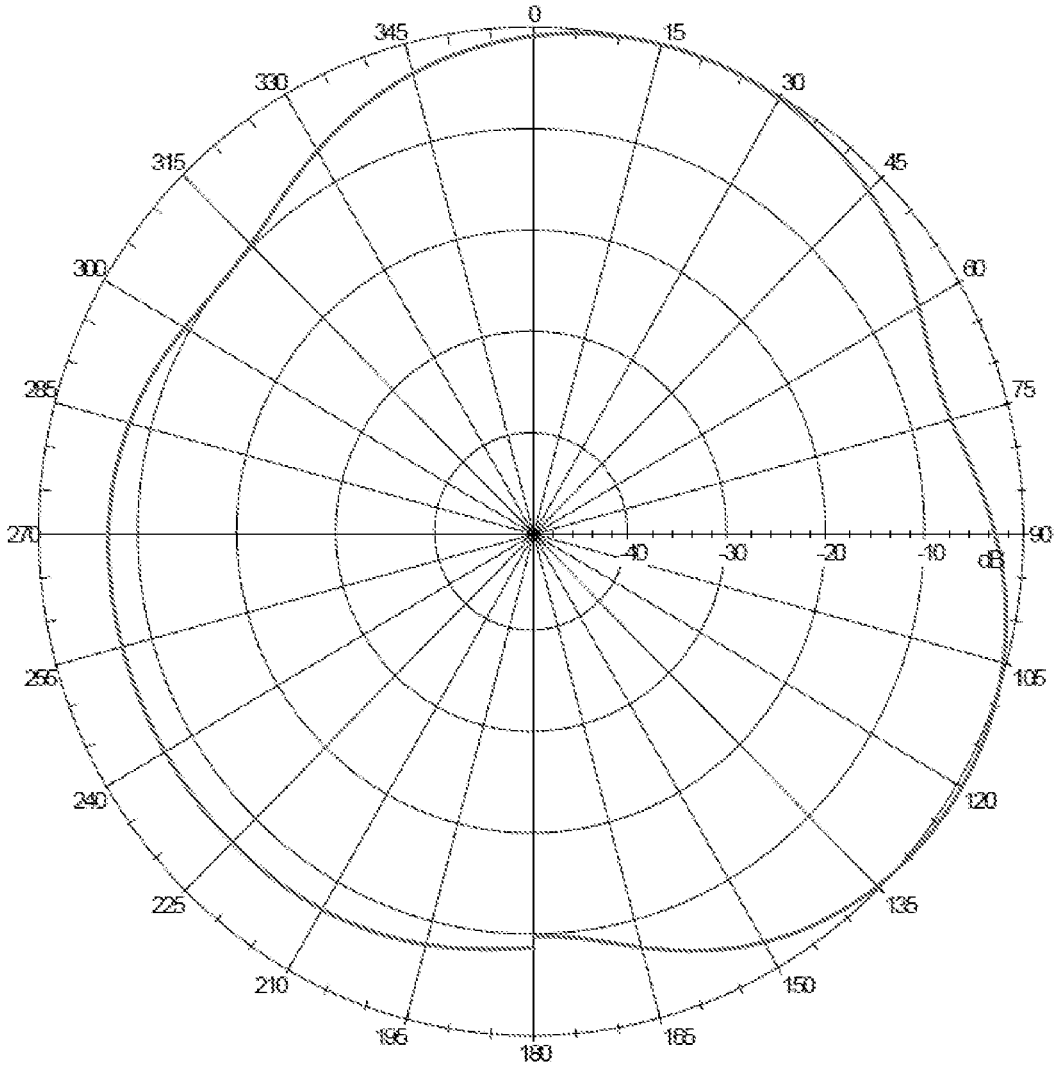
Figure 19D:
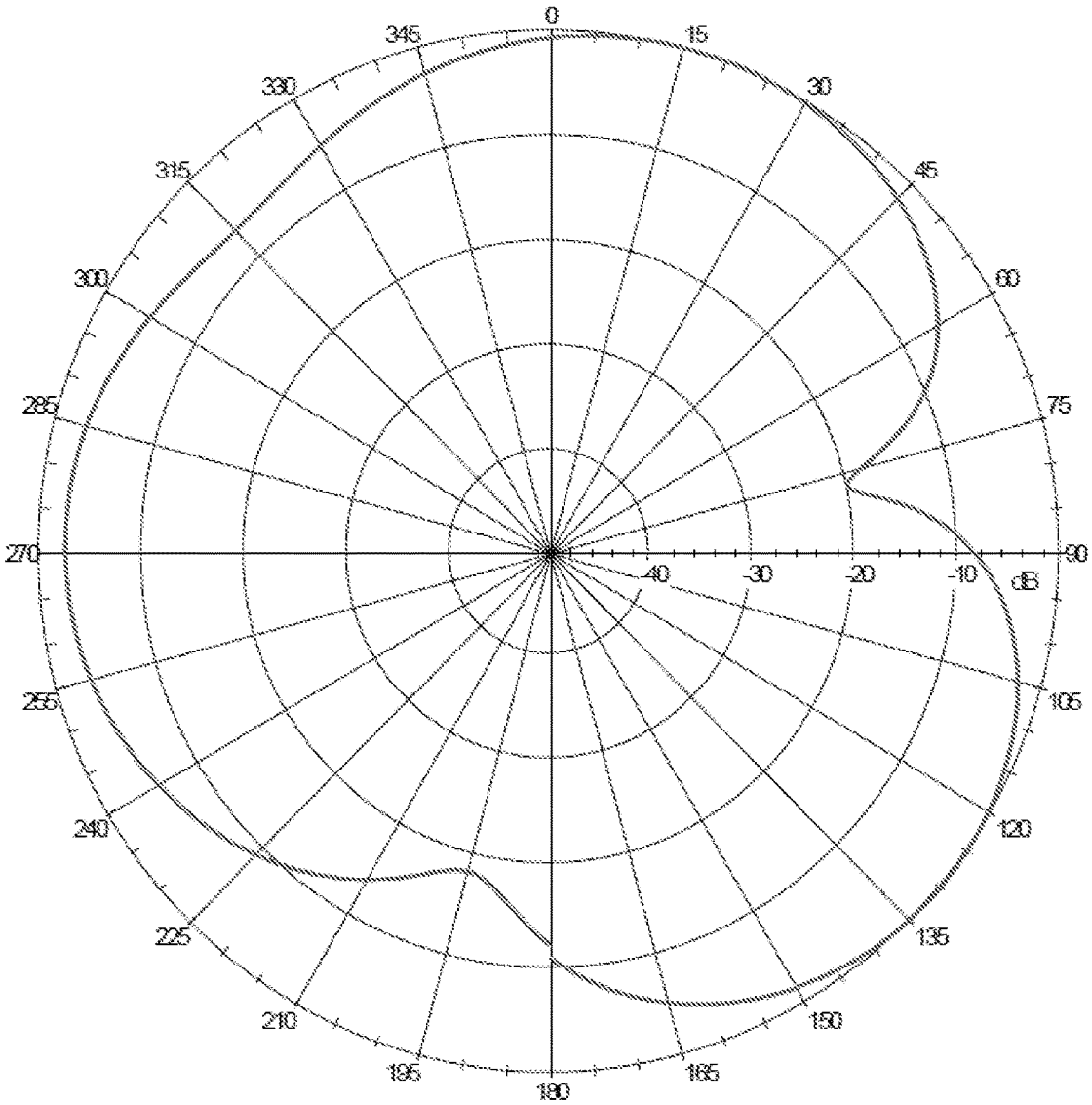
Figure 19E:
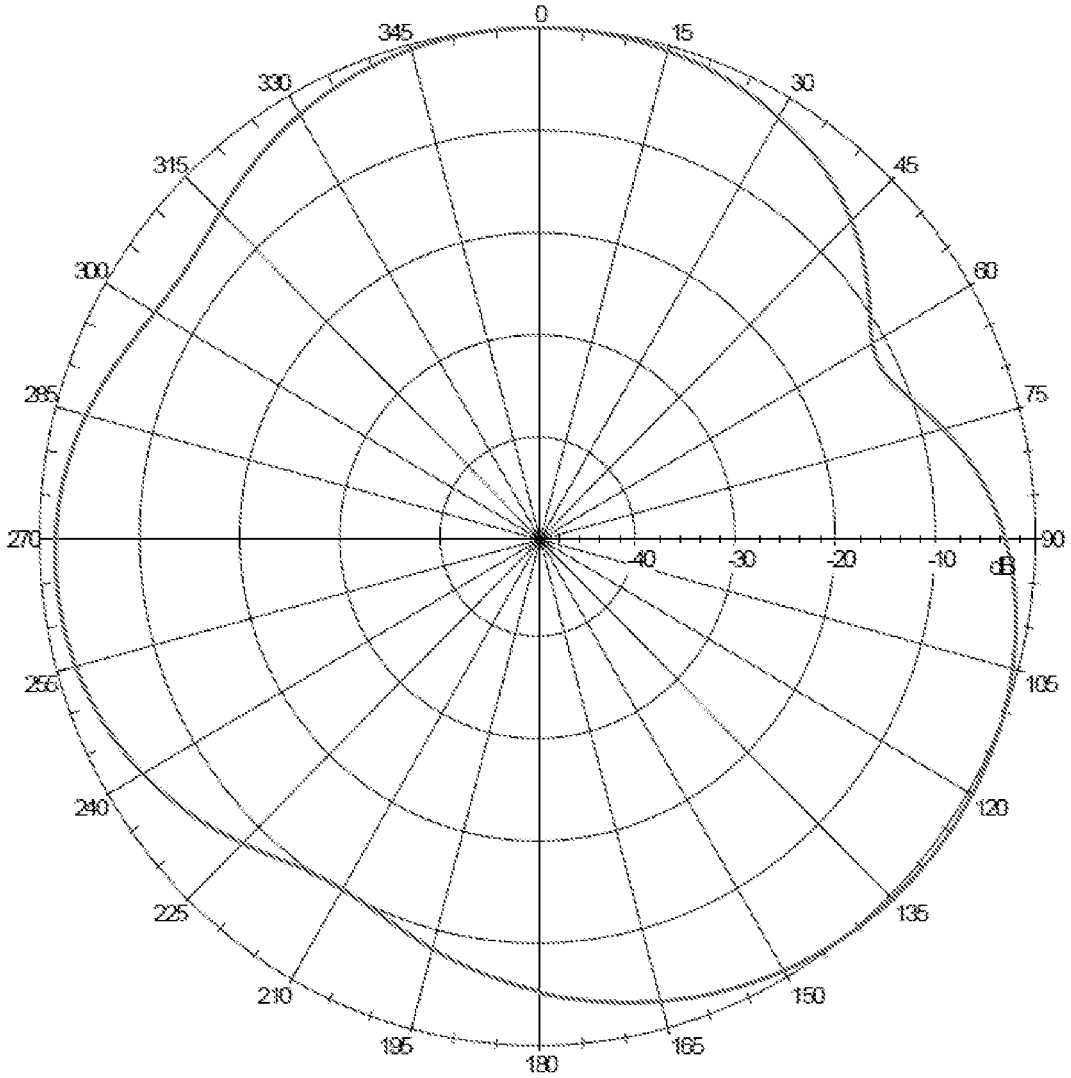
Figure 19F:
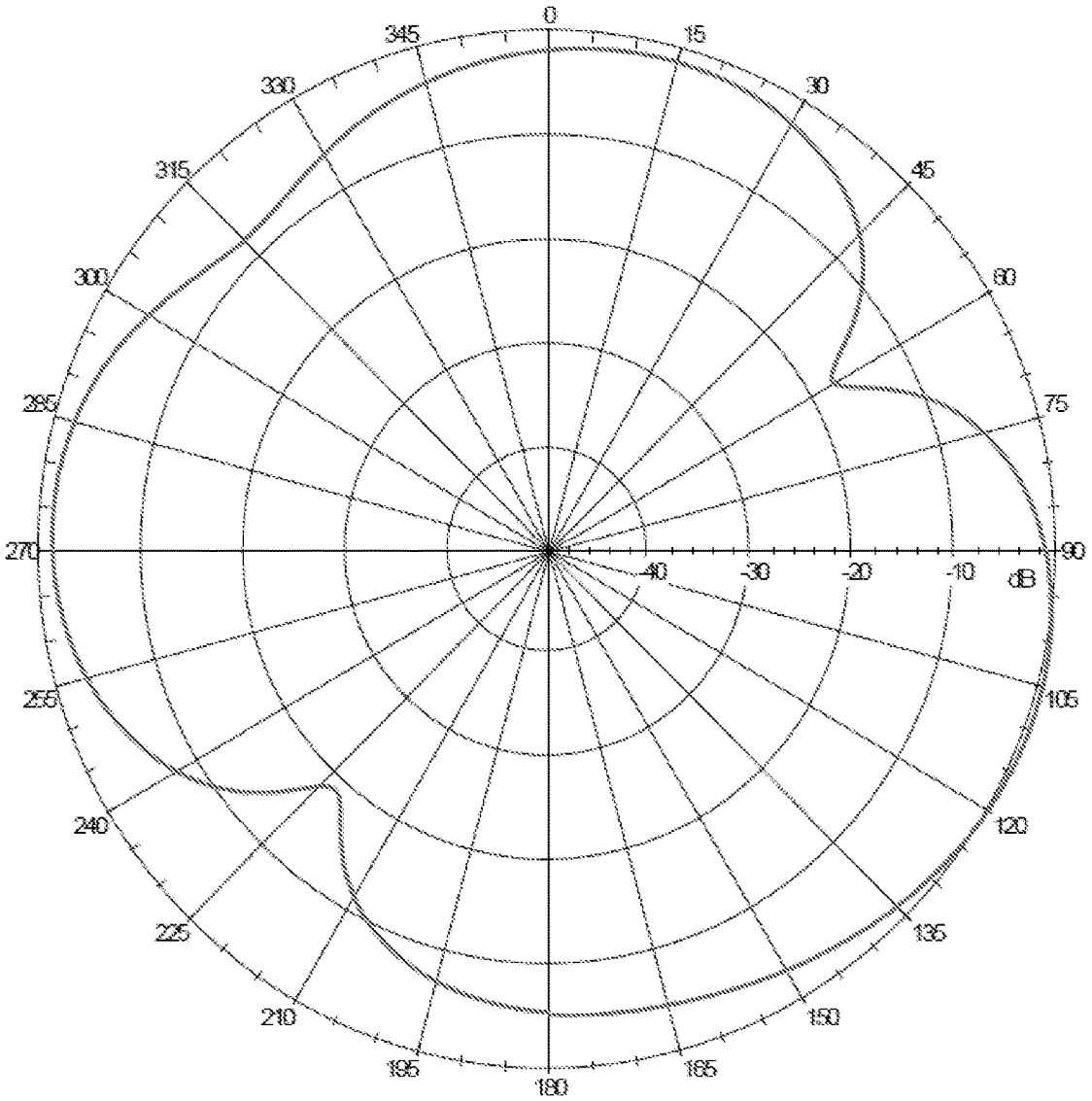
Figure 19G:
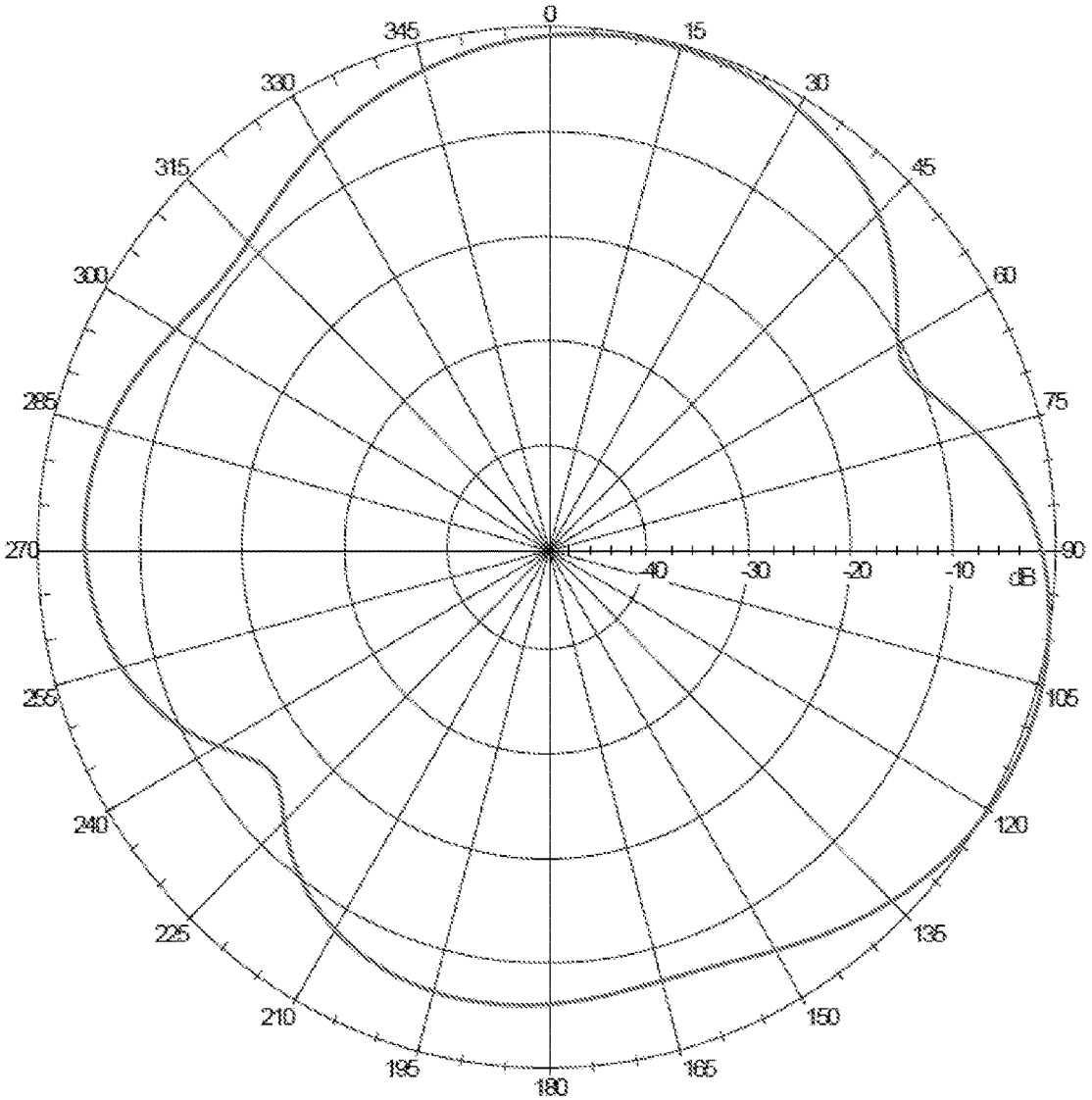

An even more preferred form of the UHF antenna element 14*b* is shown in FIG. 17 of the drawings. From the base of its pivot coupling 18 (i.e., at the top surface 16 of the antenna housing 4) to its opposite free end, the UHF antenna element 14*b* has a length of about 159 millimeters, which is the same length as the VHF antenna elements 14*a*, 14*c* for aesthetic purposes. The RG 178 coaxial cable 32 has its shield soldered to the ground plane 13 on the printed circuit board 12 within the housing 4, and then extends from its connection on the printed circuit board 12 through the pivot coupling 18 and into the open lower end of the outer cover 42. The outer cover 42 is preferably made from a rigid plastic material, such as a thermoplastic polyester elastomer (TPEE), just like the covers 30 on the VHF antenna elements 14*a*, 14*c*, and has a tapered shape with an inner diameter near its top closed free end of about 8.1 millimeters and an axial length of about 147 millimeters from its closed top end to its open bottom end where it is mounted on the pivot coupling 18 (which has a height of about 12 millimeters).

The cable 32 passes through a lower section of shrink tubing 44 within the UHF antenna element cover 42 which extends from into the pivot coupling 18 to near or into the open bottom end of the radiating sleeve 40. This first shrink tubing 44 preferably has an inner diameter of about 5 millimeters and a length of about 30 millimeters, and provides support for the coaxial cable 32 within the antenna element cover 42. The coaxial cable 32 passes, intact, through most of the axial length of the bore of the sleeve 40.

About 27 millimeters from the closed top end of the sleeve 40 is where the coaxial shield and outer protective sheath of cable 32 are terminated. For protection and strength, a second shrink tubing 46 covers the terminated end of the coaxial shield and outer sheath and extends upwardly therefrom, the length of the second shrink tubing 46 being about 10 millimeters and the inner diameter thereof being about 1.5 millimeters. The inner conductor and its inner insulative covering of the coaxial cable 32 continues upwardly therefrom. Near the top end of the sleeve 40, the inner protective insulative covering is stripped away to expose the inner conductor, which is soldered to the closed top end of the sleeve 40 on the inside surface thereof.

The sleeve 40 is made from a brass tube preferably in accordance with ASTM Standard No. C27000 and JIS Standard No. C2700. The sleeve 40 has an inner diameter of about 5.2 millimeters, and an axial length of about 71 millimeters, from its open bottom end to its closed top end. The sleeve 40 serves as a radiating element to which the inner conductor of the coaxial cable 32 is connected.

A third shrink tubing 48 is fitted over the top closed end of the sleeve 40 and extends therefrom to near the top free end of the antenna element cover 42 and within the bore thereof, and provides rigidity and support to the components of the antenna element 14*b* within the outer cover 42. This third shrink tubing 48 preferably has an inner diameter of about 5 millimeters and a length of about 60 millimeters.

The UHF antenna element 14*b* is spaced apart from the middle VHF antenna element 14*c* a distance of about 77 millimeters and from the first VHF antenna element 14*a* a distance of about 154 millimeters so that there is mutual coupling between the VHF antenna elements 14*a*, 14*c* and the UHF antenna element 14*b*. This provides the television antenna 2 of the present invention with omni-directionality, as can be seen from the signal reception antenna patterns shown in FIGS. 19A-19G.

Figure 20:
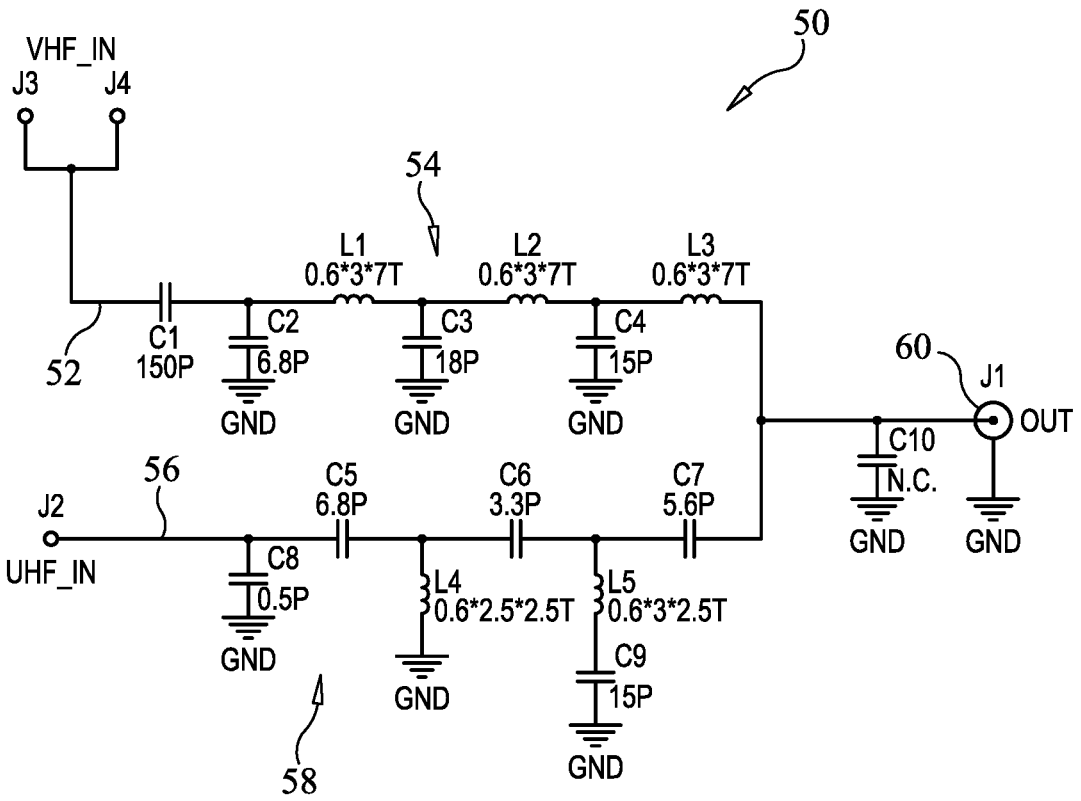
FIG. 20 is a schematic diagram of a VHF/UHF combiner and impedance matching circuit forming part of the omni-directional television antenna of the present invention shown in FIGS. 1-11.
Figure 21:
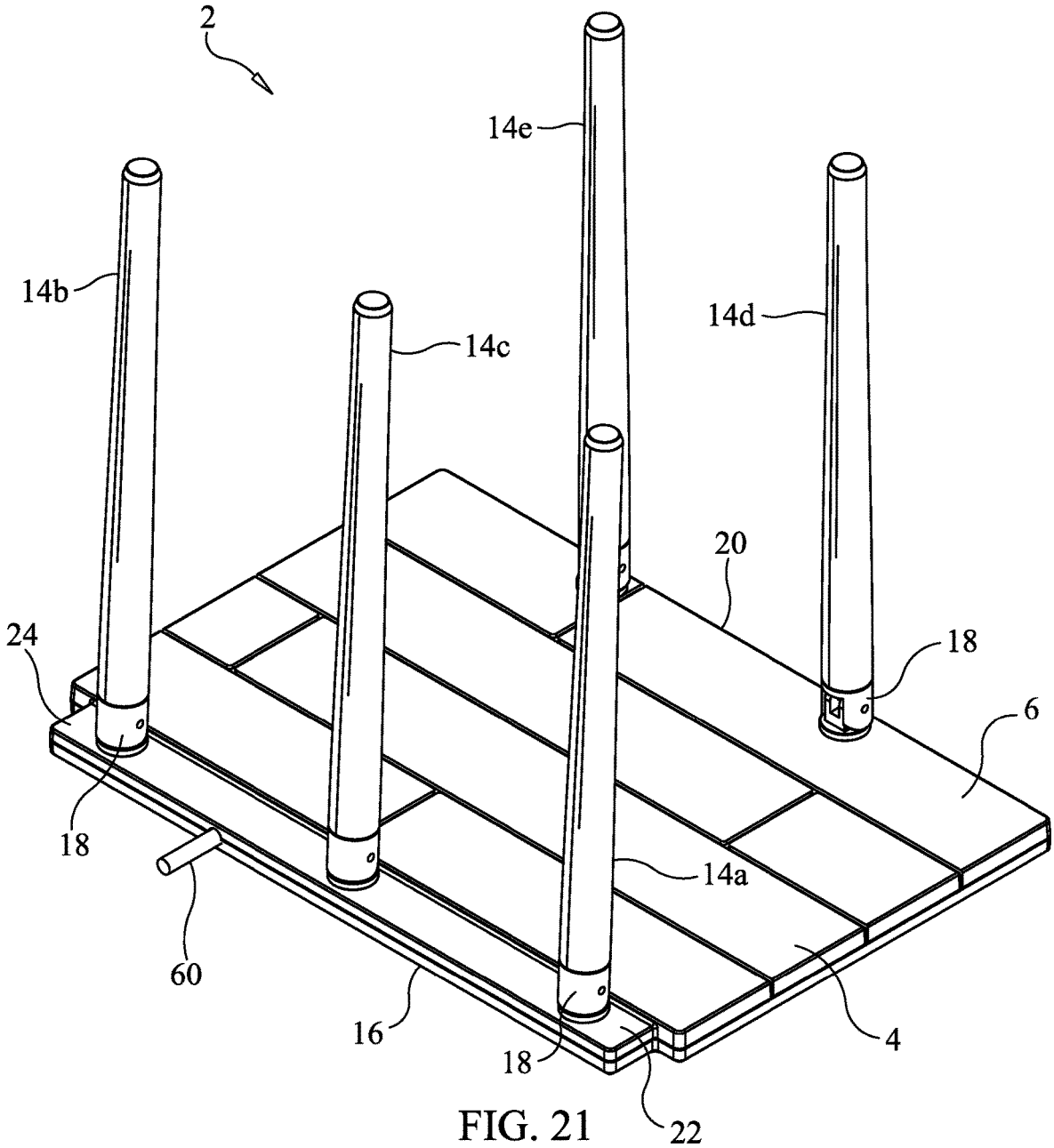
FIG. 21 is a top perspective view of an omni-directional television antenna constructed in accordance with a second form of the present invention and including five foldable antenna elements, two of which are provided for receiving VHF broadcast television signals, one of which is provided for receiving UHF broadcast television signals, and two of which are provided for receiving WiFi (Wireless Fidelity) transmitted signals, and illustrating the antenna elements thereof in an upright position.
Figure 22:
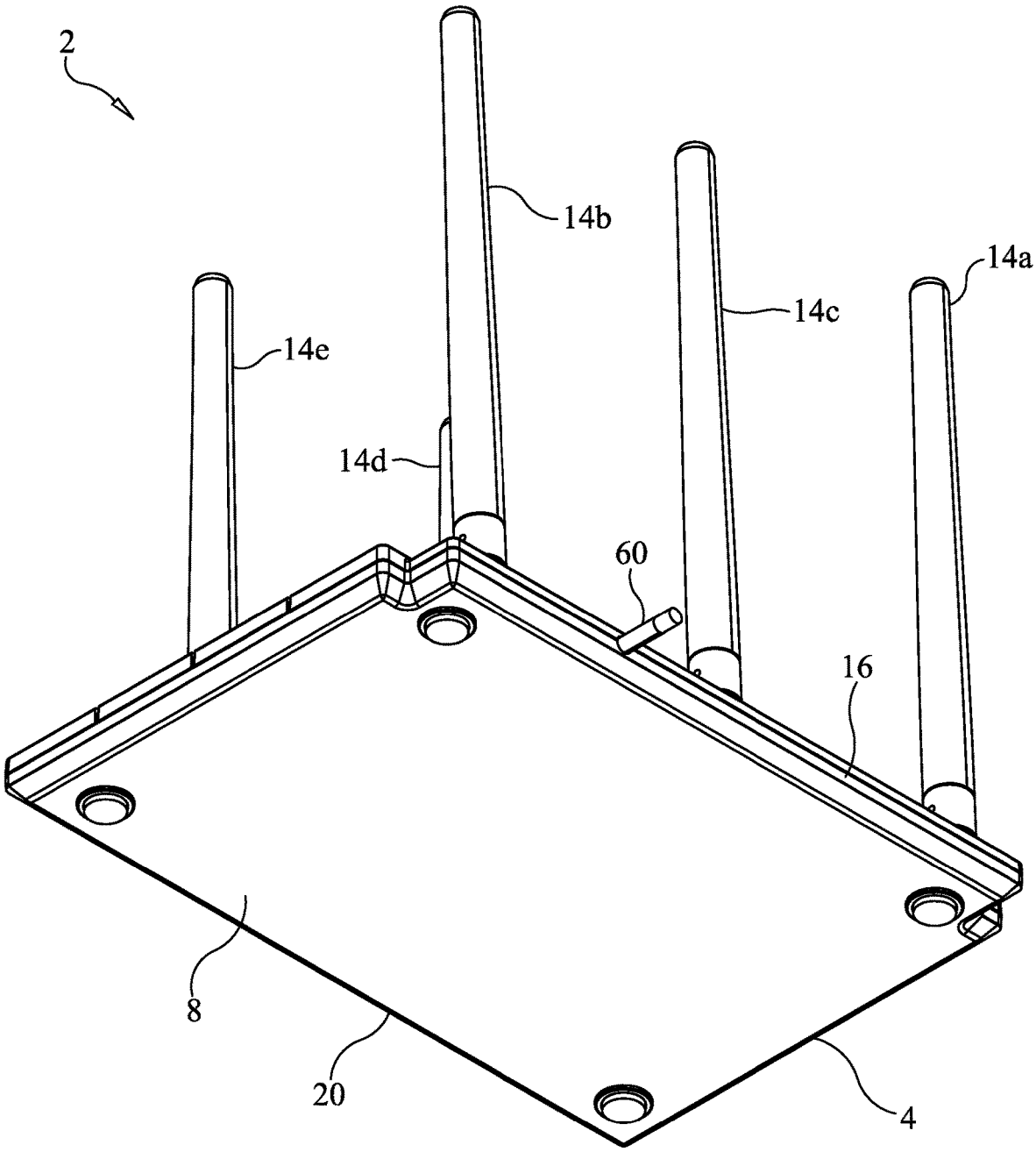
FIG. 22 is a bottom plan view of the omni-directional television antenna of the present invention shown in FIG. 21.
Figure 23:
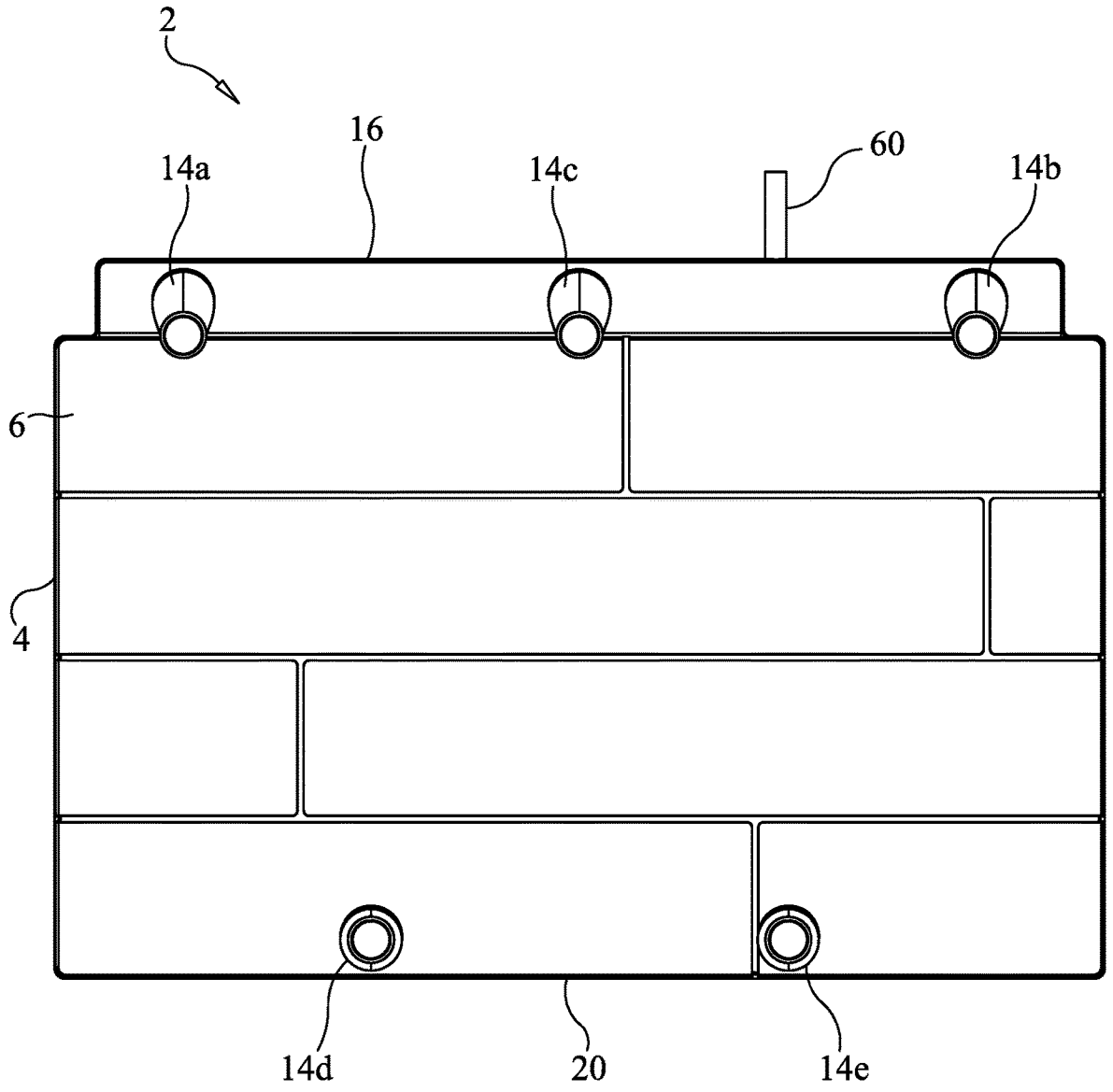
FIG. 23 is a top plan view of the omni-directional television antenna of the present invention shown in FIGS. 21 and 22.
Figure 24:
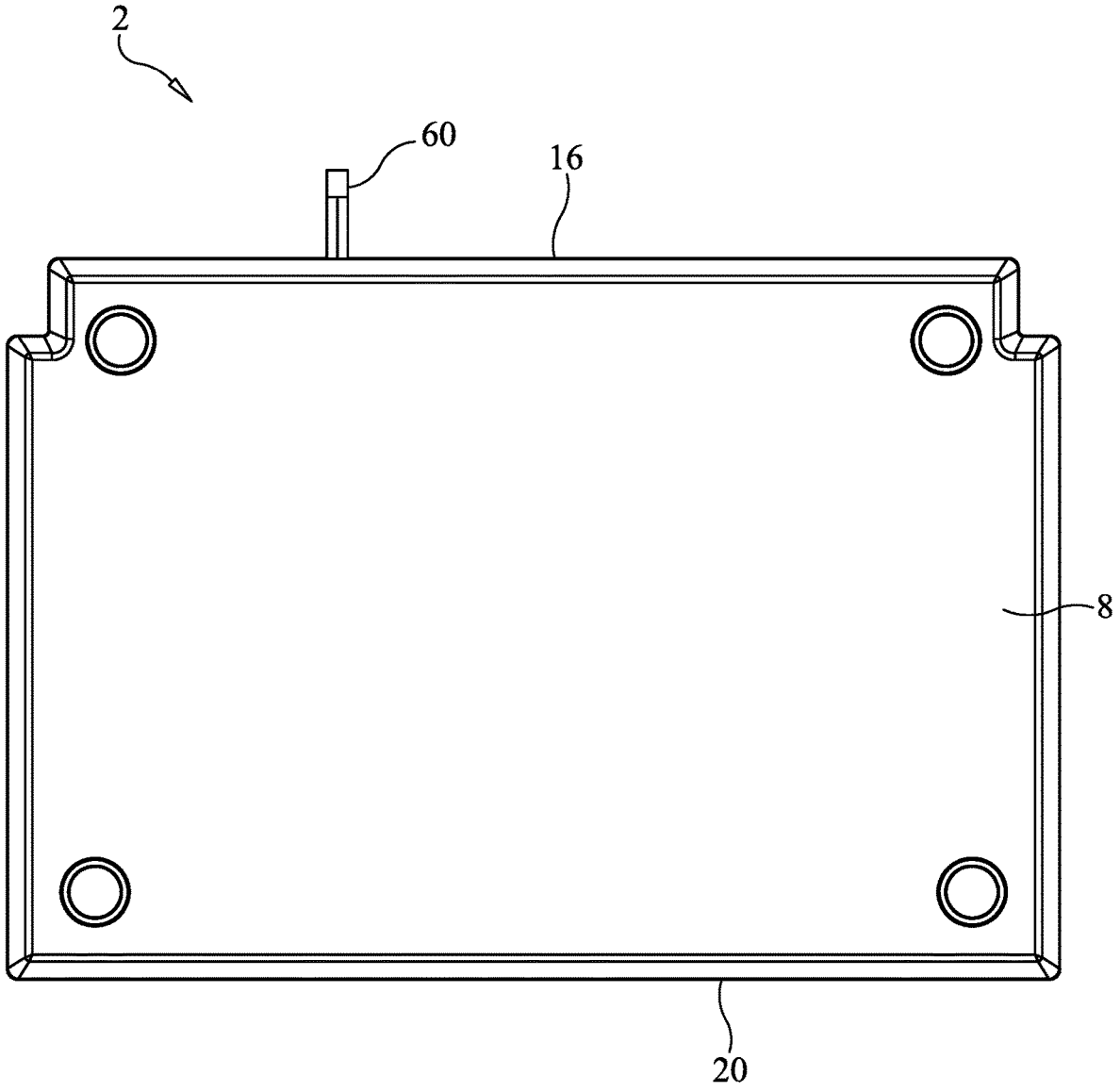
FIG. 24 is a bottom plan view of the omni-directional television antenna of the present invention shown in FIGS. 21-23.
Figure 25:
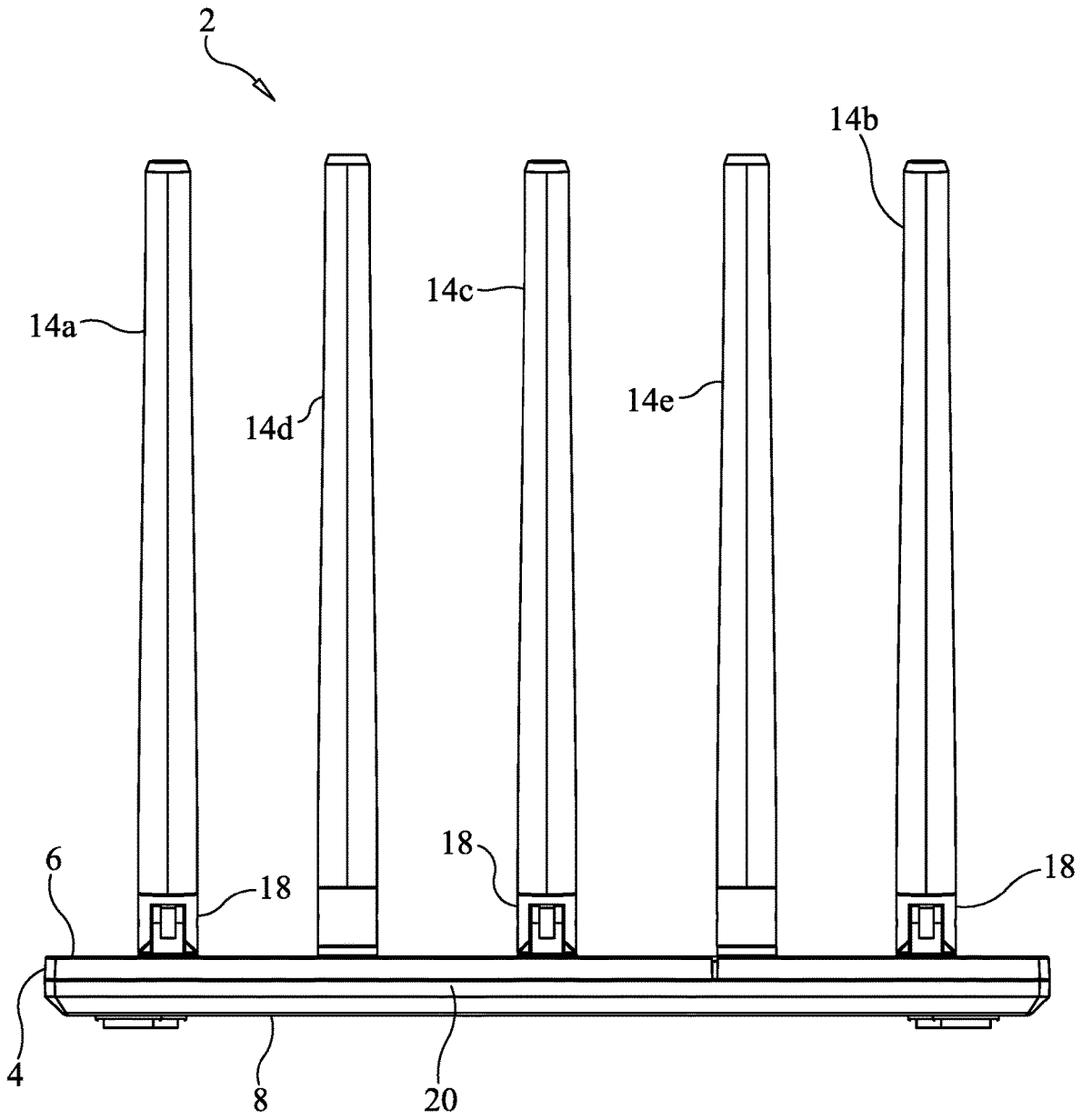
FIG. 25 is a front elevational view of the omni-directional television antenna of the present invention shown in FIGS. 21-24.
Figure 26:
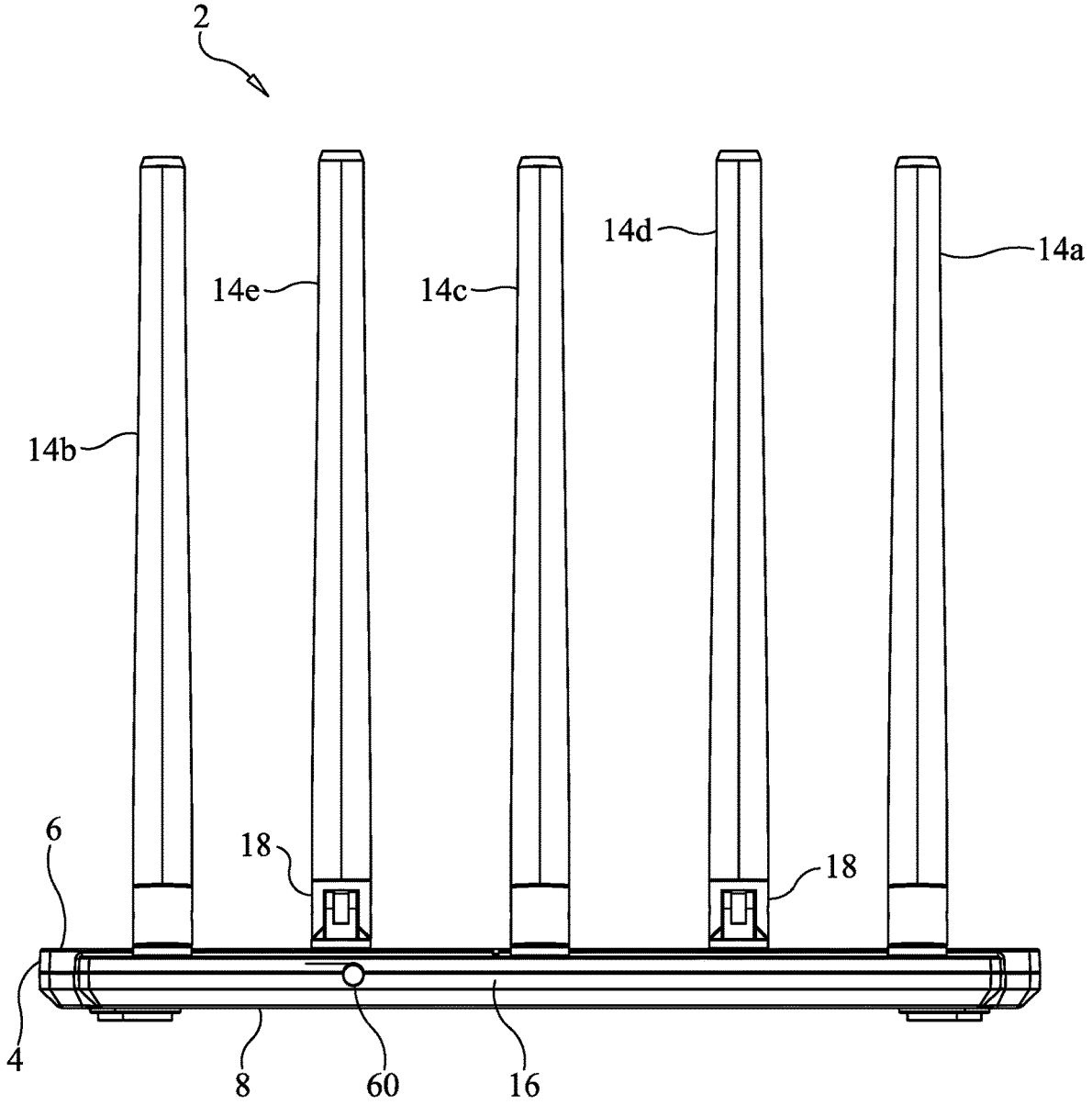
FIG. 26 is a rear elevational view of the omni-directional television antenna of the present invention shown in FIGS. 21-25.
Figure 27:
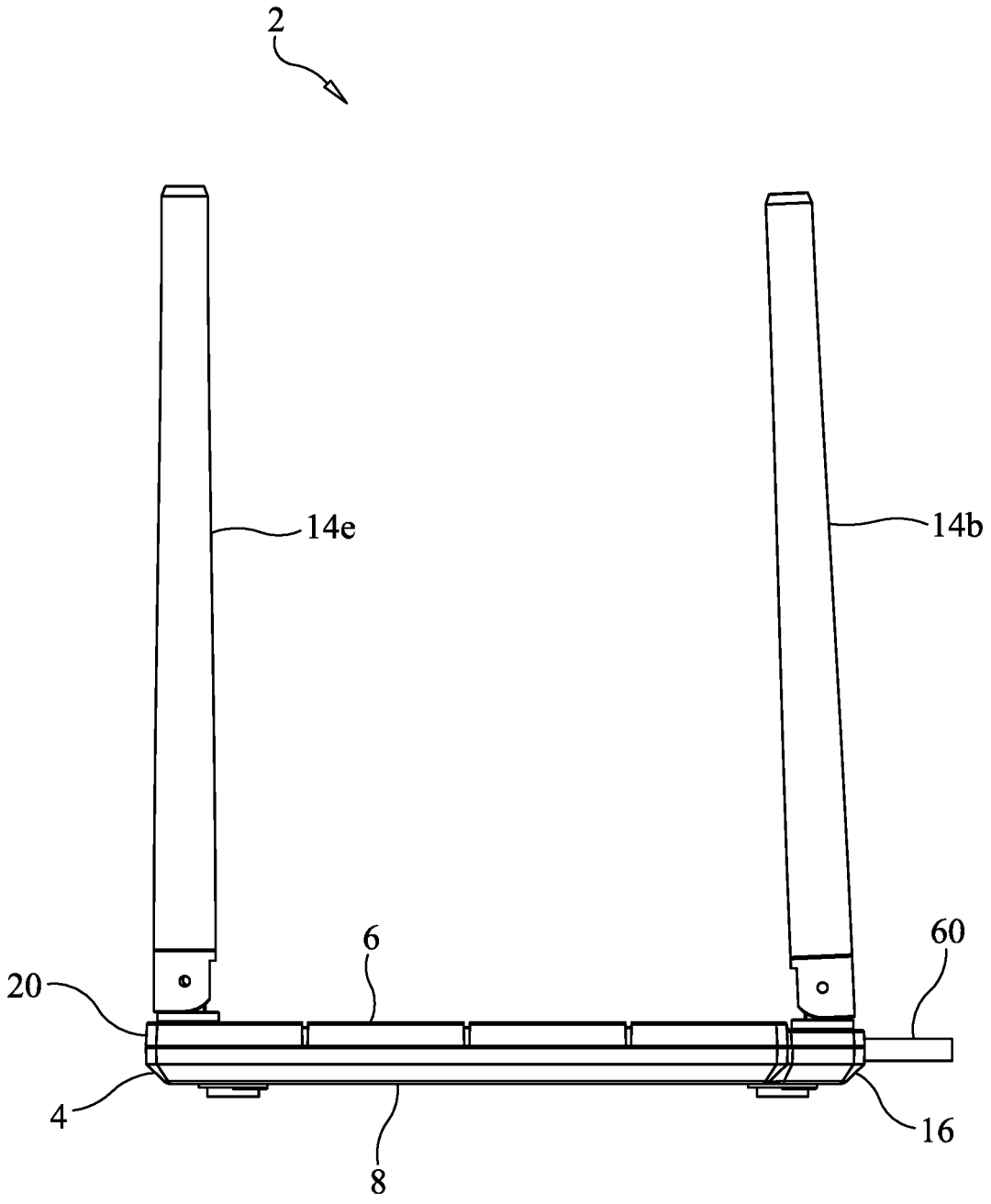
FIG. 27 is a right elevation view of the omni-directional television antenna of the present invention shown in FIGS. 21-26.
Figure 28:
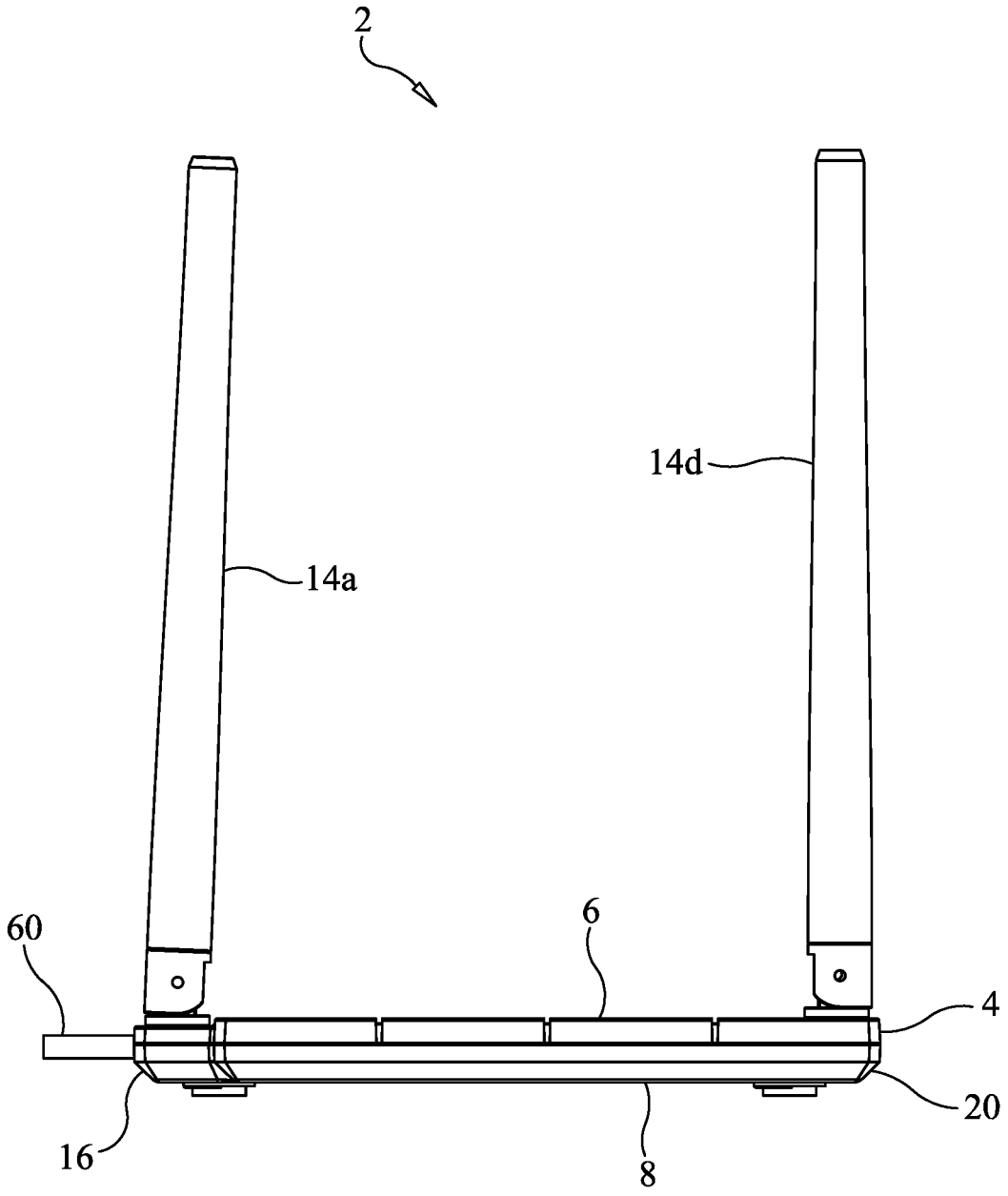
FIG. 28 is a left elevational view of the omni-directional television antenna of the present invention shown in FIGS. 21-27.
Figure 29:
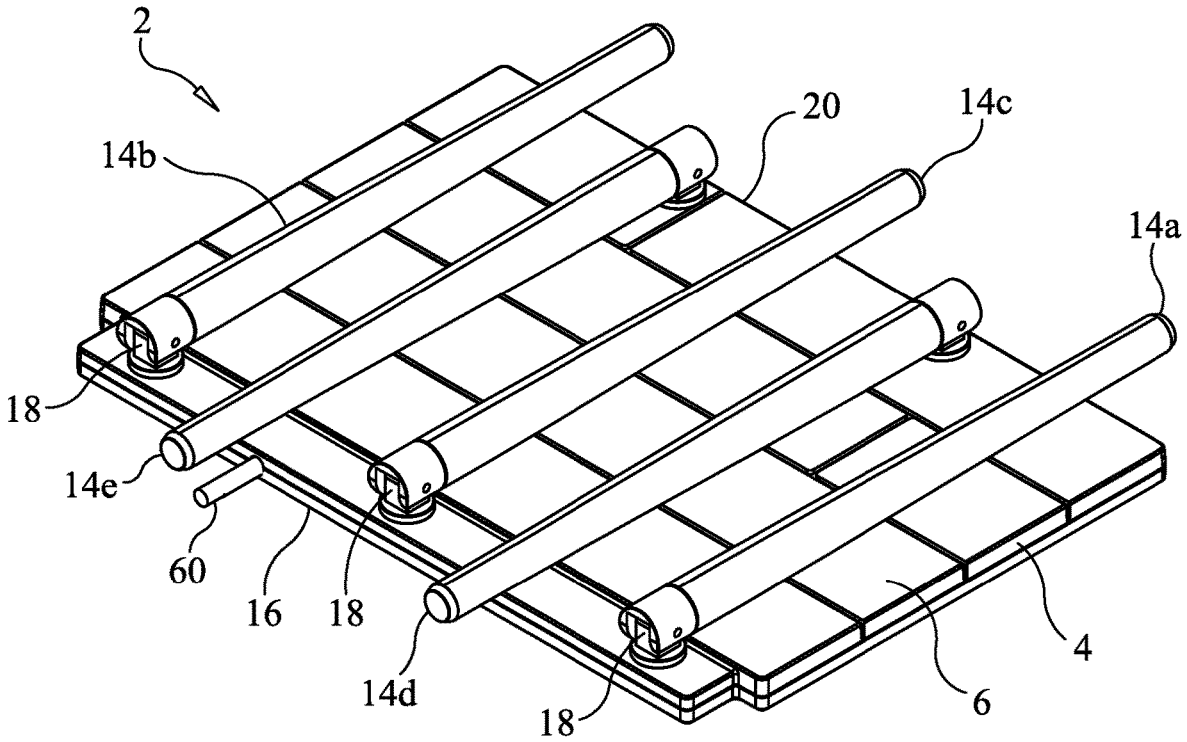
FIG. 29 is a top perceptive view of the omni-directional television antenna of the present invention shown in FIGS. 21-28, and illustrating the antenna elements thereof being folded on or in close proximity to the top surface of the housing of the antenna.
Figure 30:
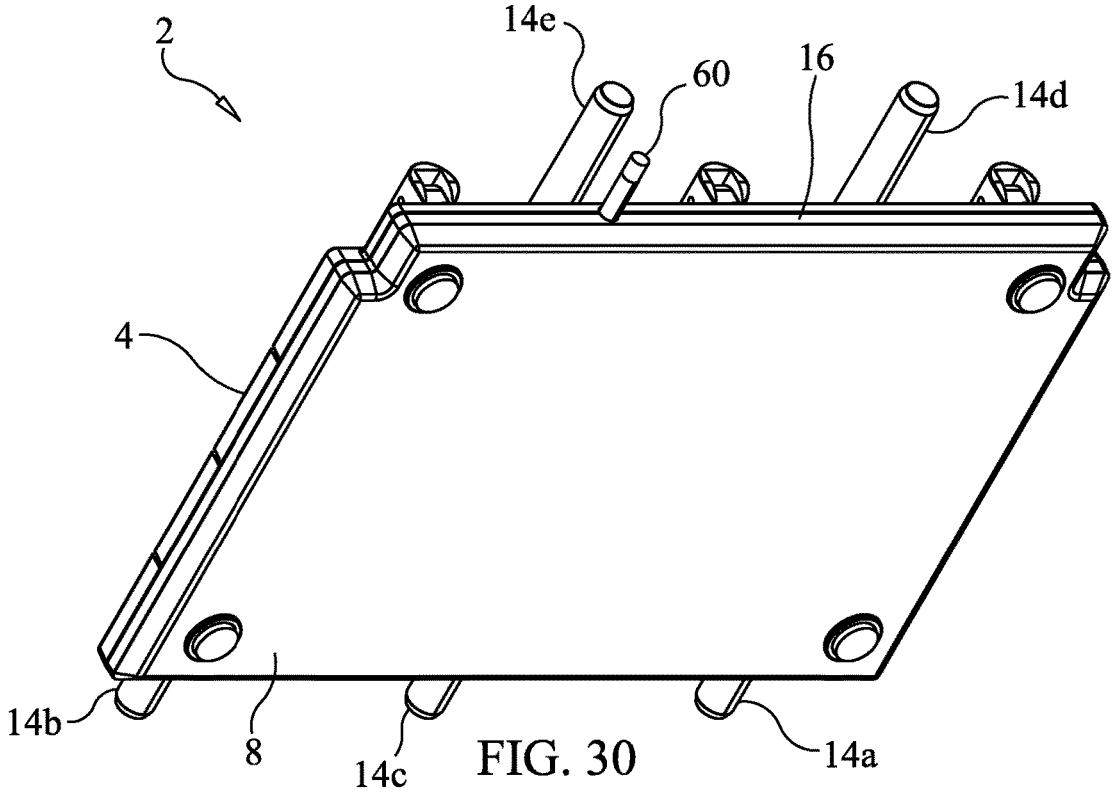
FIG. 30 is a bottom perspective view of the omni-directional television antenna of the present invention shown in FIGS. 21-29, and illustrating the antenna elements thereof in a folded position.
Figure 31:
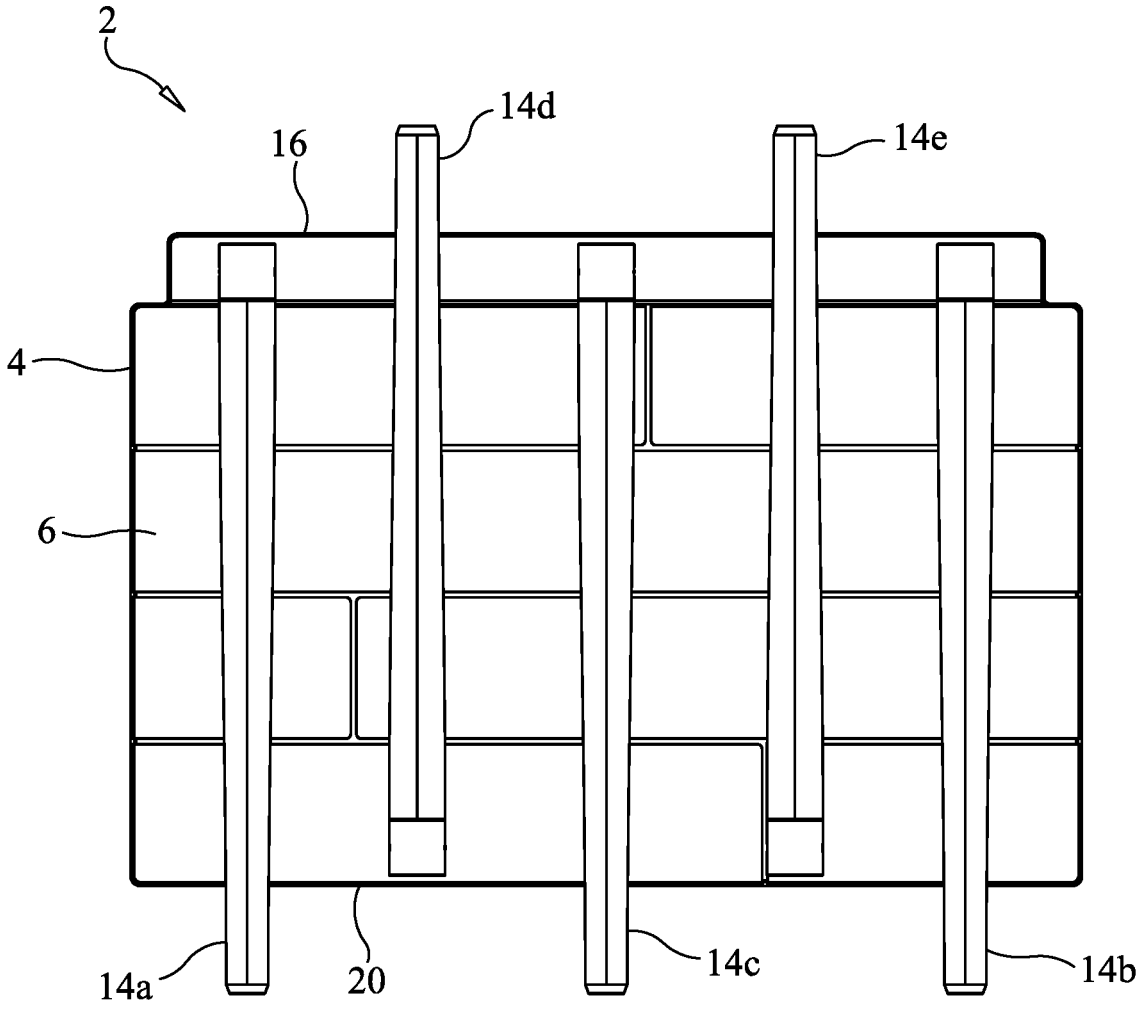
FIG. 31 is a top plan view of the omni-directional television antenna of the present invention shown in FIGS. 21-30, and illustrating the antenna elements thereof in a folded position.
Figure 32:
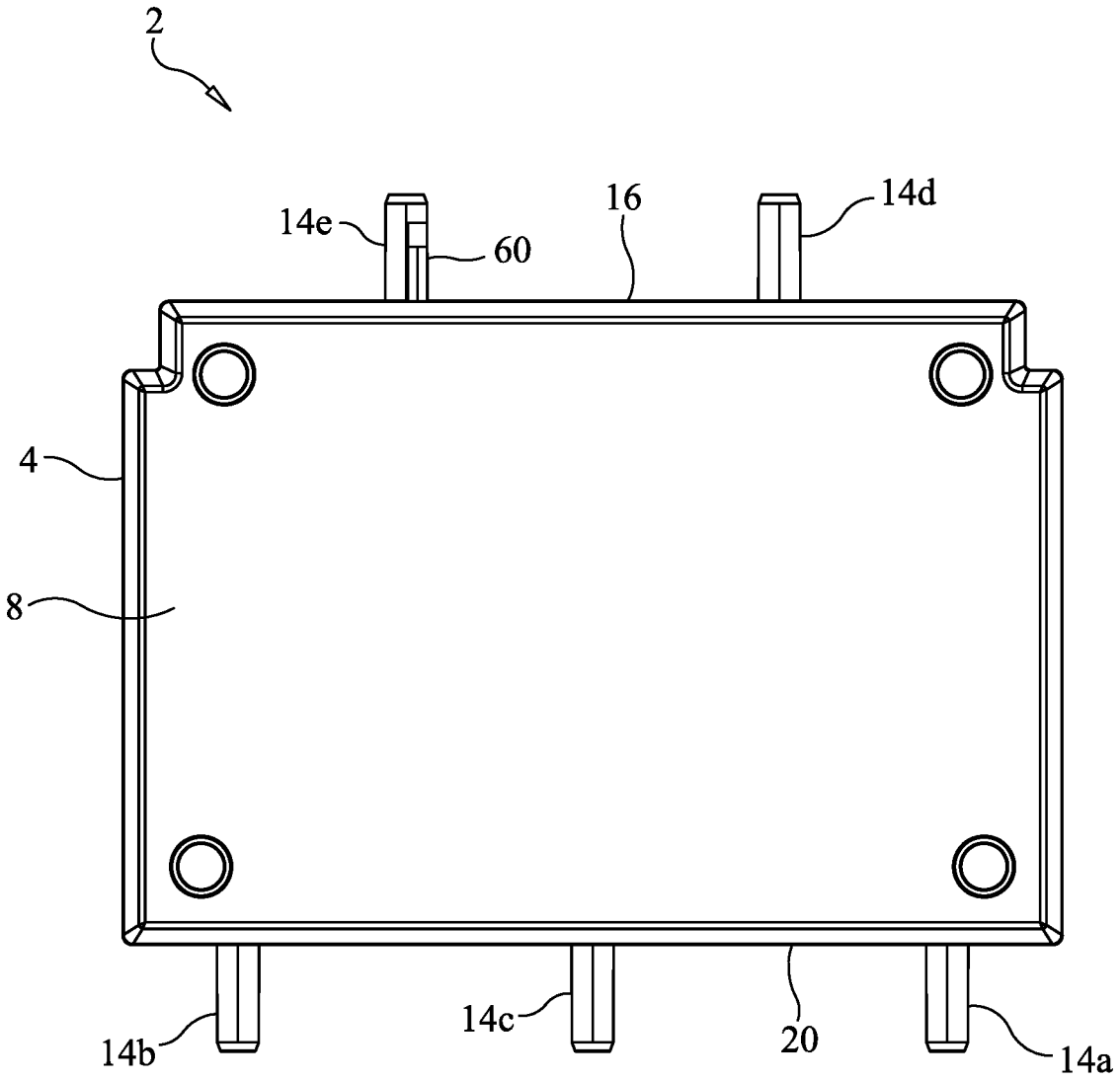
FIG. 32 is a bottom plan view of the omni-directional television antenna of the present invention shown in FIGS. 21-31, and illustrating the antenna elements thereof in a folded position.
Figure 33:
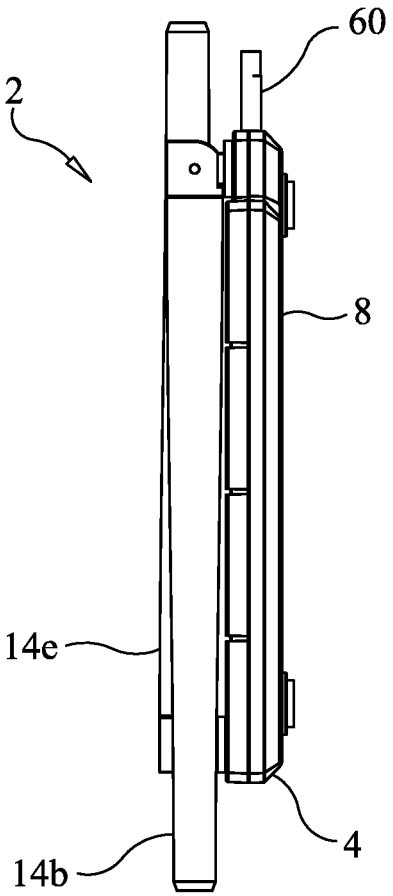
FIG. 33 is a right elevational view of the omni-directional television antenna of the present invention shown in FIGS. 21-32, and illustrating the antenna elements thereof in a folded position.
Figure 34:
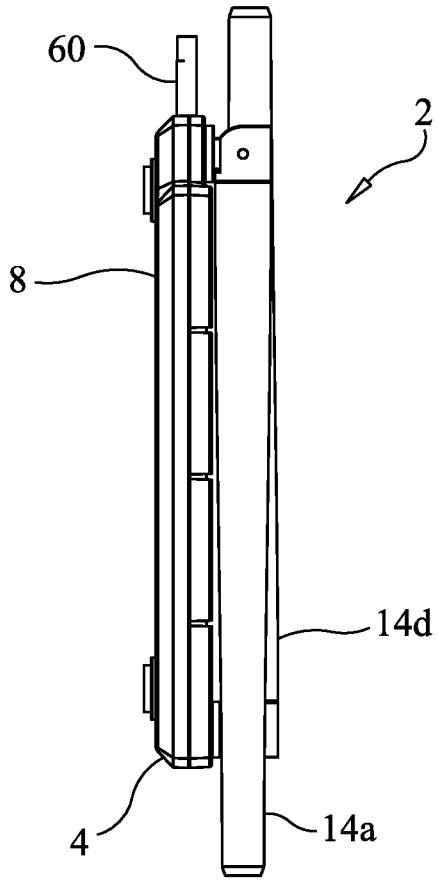
FIG. 34 is a left elevational view of the omni-directional television antenna of the present invention shown in FIGS. 21-33, and illustrating the antenna elements thereof in a folded position.
Figure 35:
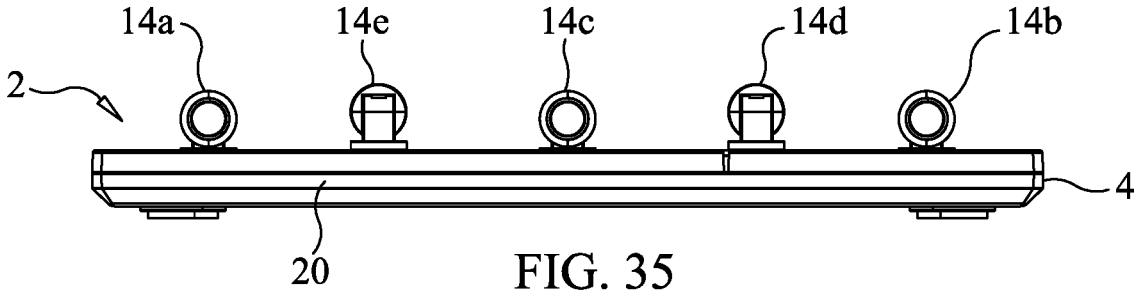
FIG. 35 is a front elevational view of the omni-directional television antenna of the present invention shown in FIGS. 21-34, and illustrating the antenna elements thereof in a folded position.
Figure 36:
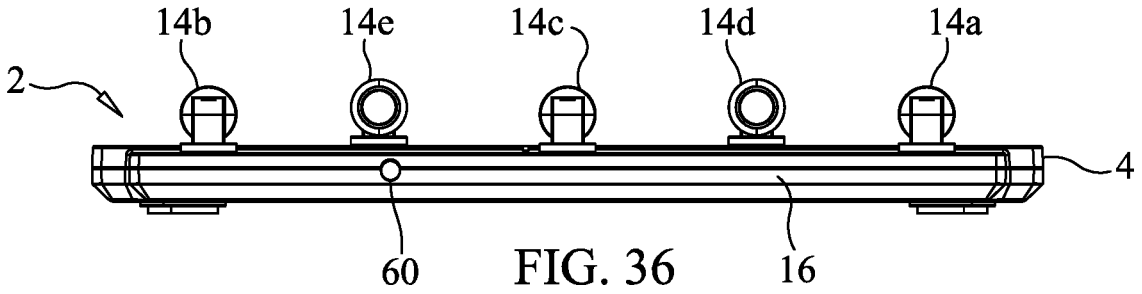
FIG. 36 is a rear elevational view of the omni-directional television antenna of the present invention shown in FIGS. 21-35, and illustrating the antenna elements thereof in a folded position.

The two VHF antenna elements 14*a*, 14*c* and the UHF antenna element 14*b* are electrically connected to a VHF/UHF combiner and impedance matching circuit 50 situated on the printed circuit board 12 within the internal cavity of the housing 4 of the television antenna 2, the combiner and impedance matching circuit 50 being shown schematically in FIG. 20 of the drawings. More specifically, the VHF leg 52 of the combiner circuit 50 to which the VHF antenna elements 14*a*, 14*c* are connected includes a tuned filter circuit 54 comprising a series of capacitors (C1-C4) and inductors (L1-L3), and the UHF leg 56 of the combiner circuit 50 to which the UHF antenna element 14*b* is connected also includes a tuned filter circuit 58 which, like the VHF tuned filter circuit 54, includes a series of capacitors (C5-C9) and inductors (L4 and L5). The output of the VHF tuned filter circuit 54 and the output of the UHF tuned filter circuit 58 are connected together to the inner conductor of an external coaxial cable 60 at one end thereof, whose outer shield is connected to the ground plane 13 on the printed circuit board 12, which cable 60 is preferably 75 ohms in impedance, the other end of which is provided with a connector so that the cable 60 carrying the broadcast VHF and UHF signals may be connected to a television or monitor.

In yet a second form of the present invention, the television antenna 2 may include a WiFi Access Point (AP) circuit, or a WiFi repeater or WiFi range extender circuit, carried on the same or different printed circuit board 12 as that used for the VHF/UHF combiner and impedance matching circuit 50 and situated within the internal cavity of the antenna housing 4. The WiFi AP circuit or WiFi repeater or WiFi range extender circuit is connected to two vertical antenna elements 14*d*, 14*e* (i.e., the fourth and fifth antenna elements) also mounted on the top surface 6 of the antenna housing 4.

More specifically, and as shown in FIGS. 21-39 of the drawings, it can be seen that two additional antenna elements 14*d*, 14*e* for receiving signals in the WiFi bands (about 2.41 GHz to about 2.48 GHz, and 5 GHz) are provided. Like the VHF and UHF antenna elements 14*a*-14*c*, the two WiFi antenna elements 14*d*, 14*e* are mounted on a hinge or pivot coupling 18 so that they may fold downwardly in a horizontal position to rest on or be in close proximity to the top surface 6 of the antenna housing 4, and so that they may be raised and held in place in a vertical disposition, perpendicular to the top surface 6 of the antenna housing 4, when the antenna 2 is being used for receiving WiFi signals. Preferably, the two WiFi antenna elements 14*d*, 14*e* are mounted in close proximity to the opposite second lateral side wall 20 of the antenna housing 4 from where the VHF and UHF antenna elements 14*a*-14*c* are mounted. One WiFi antenna element 14*d* folds downwardly between the two VHF antenna elements 14*a*, 14*c*, and the other WiFi antenna element 14*e* folds downwardly between the middle VHF antenna element 14*c* and the UHF antenna element 14*b* so that all five antenna elements 14*a*-14*e* may be folded onto the top surface 6 of the antenna housing 4 without interfering with one another.

The advantage of including the WiFi antenna elements 14*d*, 14*e* and their related circuits on the same antenna housing 4 as the VHF and UHF antenna elements 14*a*-14*c* is clearly evident. The VHF and UHF antenna elements 14*a*-14*c* receive the "over-the-air" television signals. By having a built-in WiFi AP (Access Point), or WiFi repeater or WiFi range extender, provided by the television antenna 2 of the present invention, this will help solve problems for consumers who depend on a strong WiFi signal in their home or office so that they may be able to watch live streaming video content or broadcast television signals.

Figure 38A:
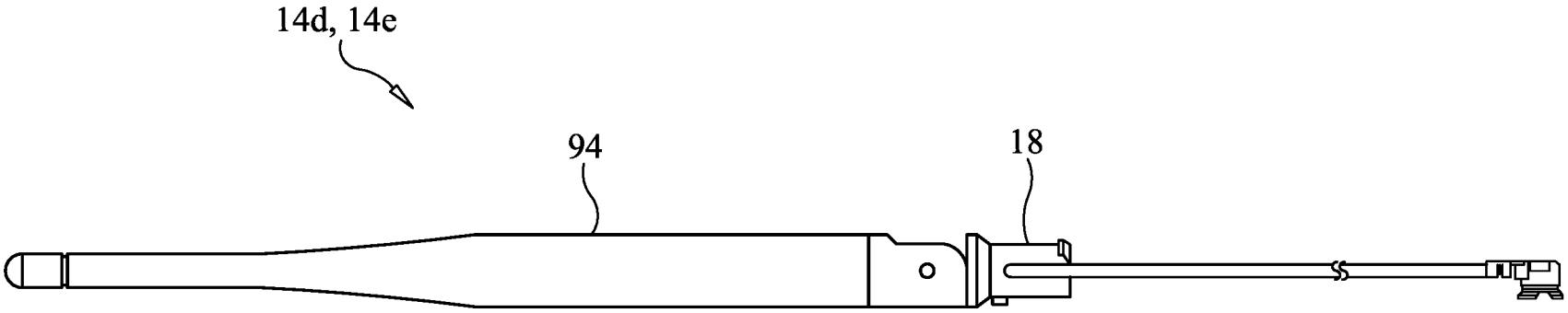
FIG. 38A is a side view of a WiFi (wireless fidelity) antenna element constructed in accordance with one form of the present invention and forming part of the omni-directional television antenna of the present invention, the antenna element being shown in an extended state.
Figure 38B:
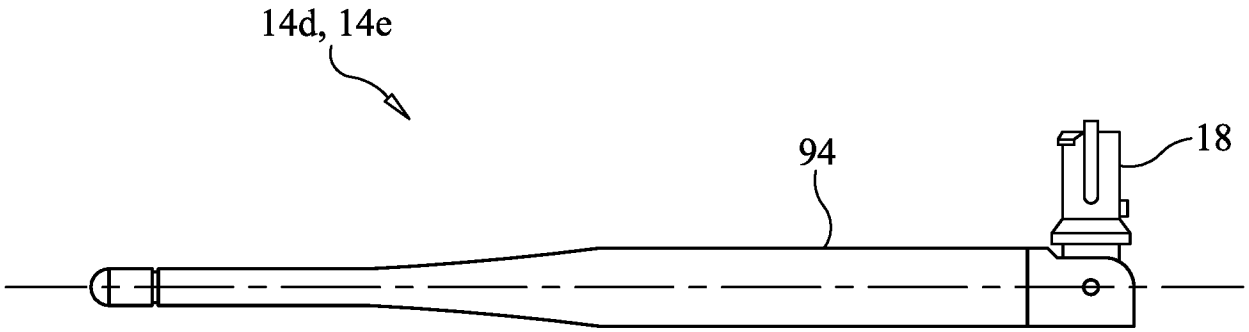
FIG. 38B is a side view of the WiFi (wireless fidelity) antenna element constructed in accordance with one form of the present invention and forming part of the omni-directional television antenna of the present invention, the antenna element being shown in a folded state.
Figure 39:
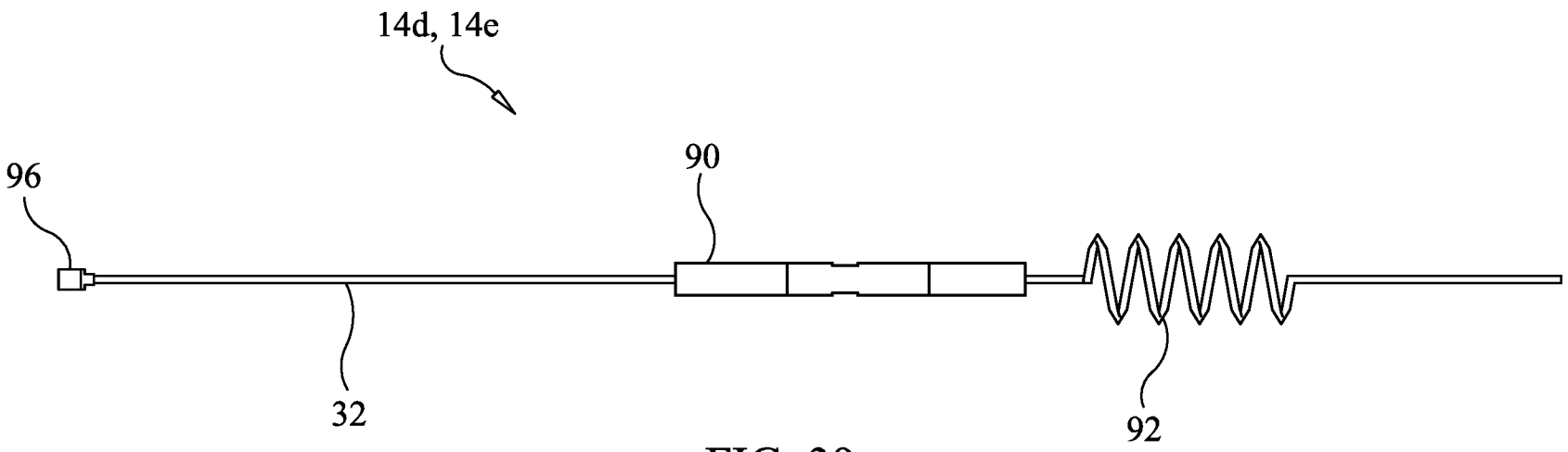
FIG. 39 is a side view of the WiFi antenna element shown in FIG. 38A, with the outer covering thereof removed.

The two WiFi antenna elements 14*d*, 14*e* preferably would be structured as a combined helical antenna and coaxial sleeve antenna (but possibly could take on the structure of the modified coaxial sleeve antenna described previously). More specifically, FIGS. 38A and 38B are side views of the WiFi antenna element 14*d*, 14*e*, and FIG. 39 shows the inner structure of the WiFi antenna element 14*d*, 14*e* with the outer cover 94 thereof removed. As shown in FIGS. 38A and 38B, the WiFi antenna element 14*d*, 14*e* has an overall length measured from the top free end thereof to the pivot point where it is coupled to the pivot coupling 18 of about 165 millimeters. The overall length of the WiFi antenna element 14*d*, 14*e*, including the length of the coaxial cable 32 to which it is connected, measured from the top free end of the outer cover 94 to the connection point of the coaxial cable 32 on the printed circuit board of the WiFi circuit (or the printed circuit board 12 for the VHF/UHF combiner circuit 50) is about 240 millimeters. The outer cover 94 of the WiFi antenna elements 14*d*, 14*e* is similar in shape and constructed from similar material as that of the outer covers 30, 42 of the VHF and UHF antenna elements 14*a*-14*c*. The outer cover 94 preferably has an inner diameter of about 13 millimeters. Not including the outer cover 94, each of the WiFi antenna elements 14*d*, 14*e* is preferably about 220.0 millimeters in overall length measured from its point of connection to the WiFi printed circuit board to the free end of the antenna element. The coaxial cable 32, which may also be an RG 178 cable but is more preferably an RG 113 cable, passes from the printed circuit board of the WiFi circuit (or the printed circuit board 12 for the VHF/UHF combiner circuit 50) through the pivot coupling 18 to a brass cylindrical sleeve 90, to which the outer shield of the coaxial cable 32 is electrically connected by soldering or the like. The sleeve 90 is preferably positioned such that its open bottom end is about 84 millimeters from the plug connector 96 at the lower axial end of the coaxial cable 32, which is used to connect the coaxial cable 32 to the WiFi printed circuit board. The sleeve 90 preferably has an inner diameter of about 5.0 millimeters and a longitudinal length of about 52 millimeters.

The inner conductor of the coaxial cable 32 passes through an opening in the top end of the sleeve 90 and extends axially therefrom for about another 84 millimeters to the top free end of the antenna element 14*d*, 14*e* (not including the outer cover 94), and the diameter of the inner conductor over this section is about 1.2 millimeters.

At about 10 millimeters above the top end of the sleeve 90, the inner conductor is formed as a helix 92. This helical section 92 has an axial length of about 25.0 millimeters and an inner diameter of about 5.5 millimeters. The inner conductor continues from the top end of the helical section 92 in an axial direction within the outer cover 32 for about another 49 millimeters to the free end of the WiFi antenna element 14*d*, 14*e*, not including the outer cover 94.

The frequency range of the WiFi antenna elements 14*d*, 14*e* is preferably about 2.4 GHz to about 2.49 GHz, and about 4.9 GHz to about 5.9 GHz. The impedance of the antenna elements 14*d*, 14*e* is about 50 ohms, and the voltage standing wave ratio (VSWR) is about 2:1. The radiation pattern is omni-directional, and the peak gain is about 8 dBi at about 2.4 GHz, and 10 dBi at about 5.66 GHz. Polarization is linear. Preferably, the connector 96 used for connecting the coaxial cable 32 for the WiFi element 14*d*, 14*e* to the WiFi printed circuit board is an Ipex plug connector.

As with the VHF and UHF antenna elements 14*a*-14*c*, the two WiFi antenna elements 14*d*, 14*e* are spaced apart from each other a distance of about 81 millimeters, so that they are mutually coupled and, together, provide an omni-directional signal receiving antenna pattern.

Figure 37:
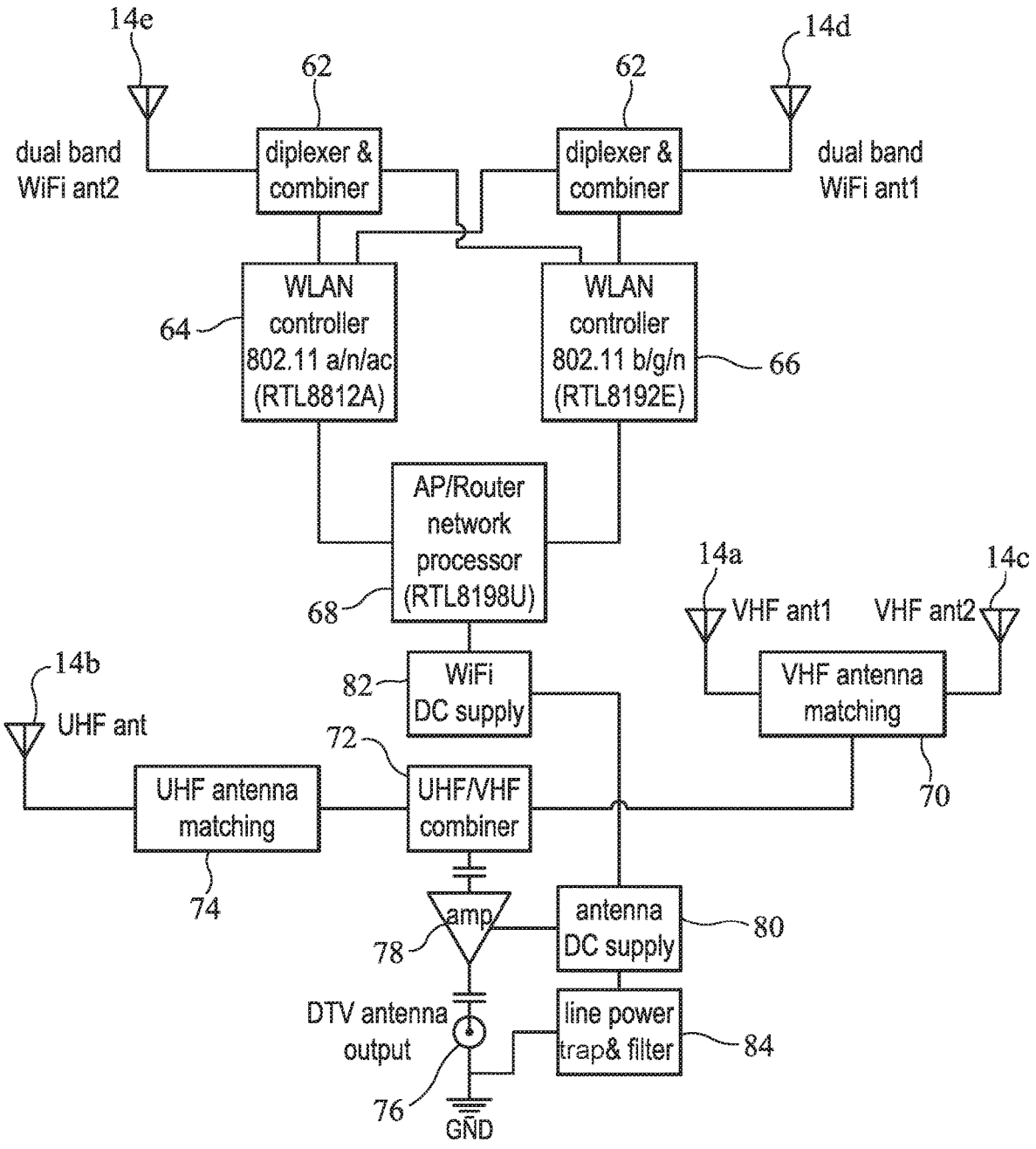
FIG. 37 is a block diagram of an electrical circuit forming part of the omni-directional television antenna of the present invention shown in FIGS. 21-36, including WiFi access point circuitry.

FIG. 37 shows an overall block diagram of not only the circuit for the WiFi Access Point, but also the combiner and impedance matching circuit 50 for the VHF and UHF antenna elements 14*a*-14*c*. The two WiFi antenna elements 14*d*, 14*e* are shown in FIG. 37 and labeled as "Dual Band WiFi ANT 1" and "Dual Band WiFi ANT 2", respectively. Each WiFi antenna element 14*d*, 14*e* is connected to the input of a diplexer and combiner circuit 62. There are two outputs from each of the two diplexer and combiner circuits 62. One output from each of the diplexer and combiner circuits 62 is provided to a first WLAN controller circuit 64 for IEEE Standard 802.11 a/n/ac reception (for example, Part No. RTL8812A manufactured by Realtek Semiconductor Corp. of Taiwan). The other output from each of the two diplexer and combiner circuits 62 is provided to a second WLAN controller circuit 66, this one providing reception under IEEE Standard 802.11 b/g/n (for example, Part Number RTL8192E manufactured by Realtek Semiconductor Corp. of Taiwan).

The output of each of the two WLAN controller circuits 64, 66 is provided to an AP/router network processor circuit 68 (for example, Part Number RTL8198U manufactured by Realtek Semiconductor Corp. of Taiwan), and the output of the AP/router network processor circuit 68 is provided to an output port or connector on the antenna housing 4, which accepts a compatible connector of a cable to provide WiFi signals received by the WiFi antenna elements 14*d*, 14*e* and processed by the WiFi circuitry to a television or monitor to which the opposite end of the cable is connected. Alternatively, the WiFi signals may be provided on the same cable 60 that carries the VHF and UHF signals to the television or monitor.

As also shown in FIG. 37, the two VHF antenna elements 14*a*, 14*c* are connected to a VHF antenna impedance matching circuit 70, whose output is provided to a UHF/VHF combiner circuit 72, such as described previously. The UHF antenna element 14*b* is connected to a UHF antenna matching circuit 74, whose output is also connected to the UHF/VHF combiner circuit 72. The output of the UHF/VHF combiner circuit 72 is provided to a DTV (Digital Television) antenna output connector 76 situated on the antenna housing 4 for connection via a coaxial cable 60 to a television or monitor, or may be provided directly to one end of the cable 60, without connector 76, which end is electrically connected to the printed circuit board (board 12, for example) on which the circuit shown in FIG. 37 is mounted.

The television antenna 2 of the present invention may also include an amplifier circuit 78, either situated on a printed circuit board 12 within the internal cavity of the antenna housing 4, or situated in an external housing and connected by appropriate coaxial cables to the output connector 76 of the television antenna 2. An AC-to-DC power supply 80 provides a DC voltage to not only the amplifier circuit 78 but also a WiFi DC supply circuit 82, which may include a step down voltage converter for providing a DC voltage to the various electrical components of the WiFi circuit. The AC-to-DC power converter circuit 80 also preferably includes a filter circuit 84, or FM trap, to block FM interference and provide a clean and regulated DC voltage to the circuitry of the television antenna 2.

Figure 37A:
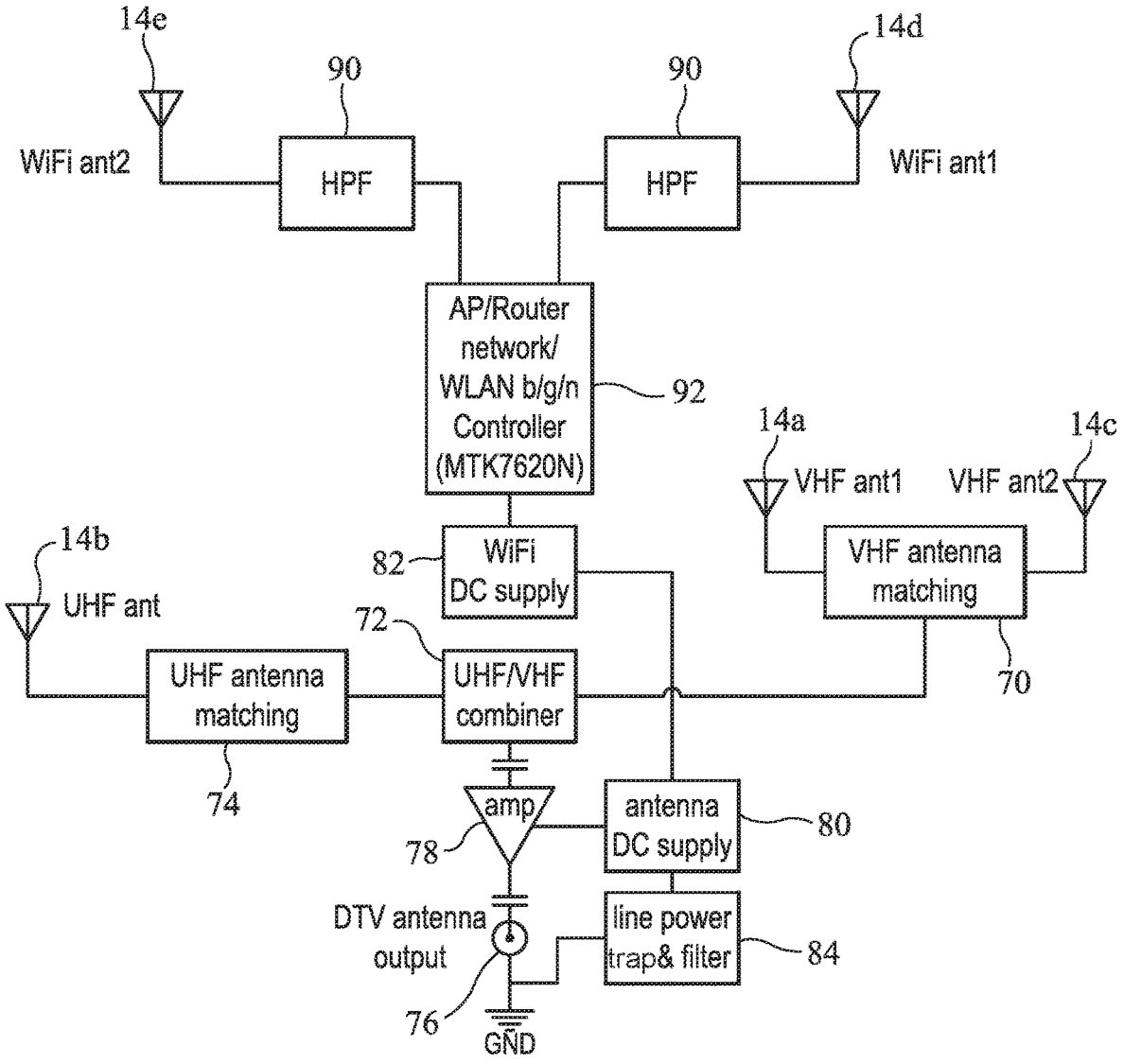
FIG. 37A is a block diagram of an electrical circuit forming part of the omni-directional television antenna of the present invention shown in FIGS. 21-36, including a first form of WiFi extender circuitry.
Figure 37B:
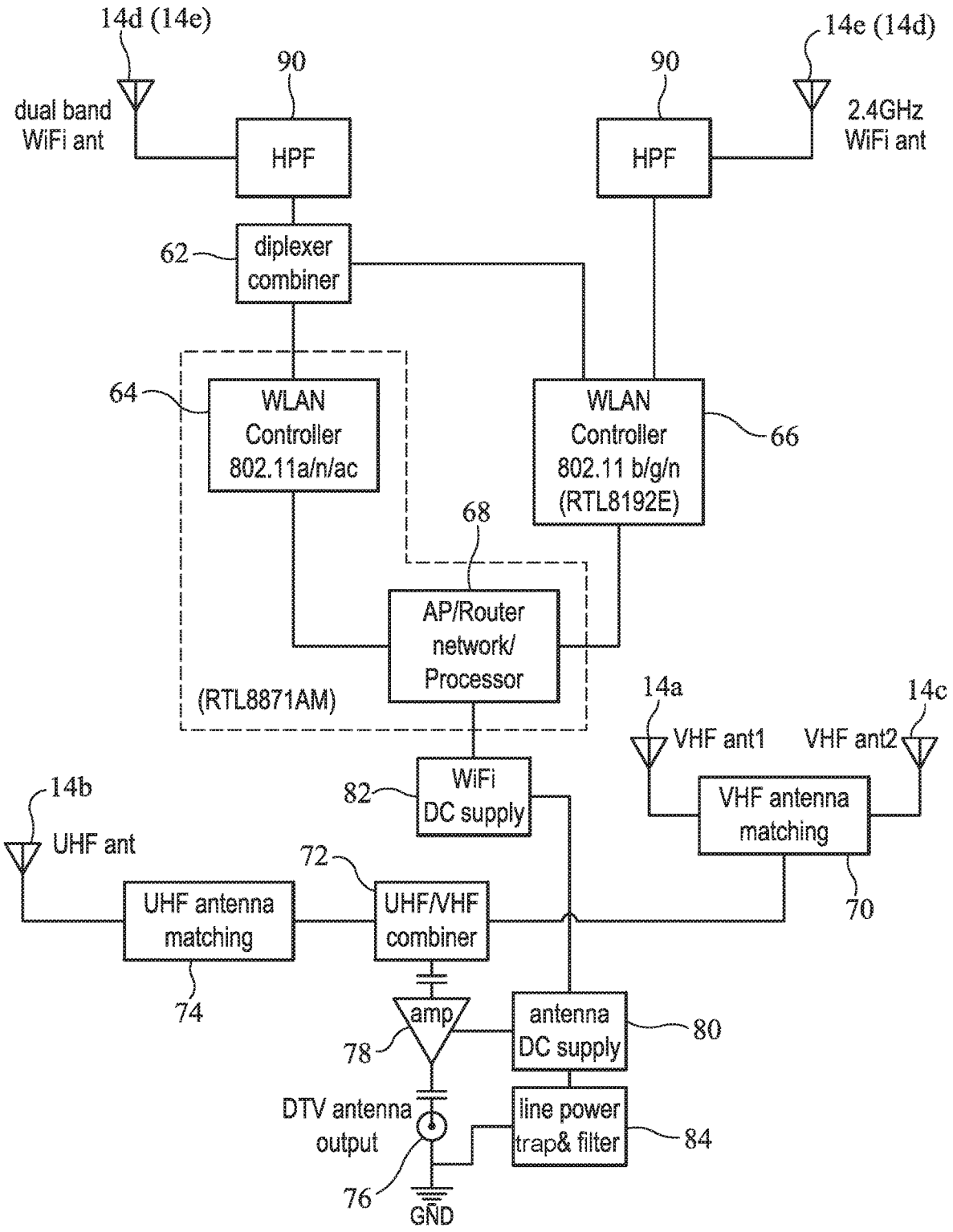
FIG. 37B is a block diagram of an electrical circuit forming part of the omni-directional television antenna of the present invention shown in FIGS. 21-36, including a second form of WiFi extender circuitry.

As mentioned previously, the television antenna 2 of the present invention may include a WiFi extender or repeater circuit for rebroadcasting WiFi signals received by the WiFi antenna elements 14*d*, 14*e*. Two such circuits are shown in FIGS. 37A and 37B. Such extender/repeater circuits may include the same or similar components of the television antenna 2 of the present invention having WiFi access point circuitry such as shown in FIG. 37 and described previously, and like reference numbers used in FIGS. 37, 37A and 37B denote the same or similar components.

The circuit shown in FIG. 37A is designed for operation in the 2.4 GHz WiFi signal frequency range. One or both of the WiFi antenna elements 14*d*, 14*e* act as transceiver antennas, to receive and retransmit WiFi frequency signals in the 2.4 GHz frequency band. The WiFi antenna elements 14*d*, 14*e* are electrically coupled to high pass filter circuits 90, and the filtered signals from the high pass filter circuits 90 are provided to an AP/router network WLAN big/n controller circuit 92, such as Part No. MTK7620N manufactured by Ralink Technology Corp. of Taiwan, which preferably operates in accordance with IEEE Standard 802.11b, 802.11g and 802.11n. Circuit 92 acts as an extender/repeater and will rebroadcast WiFi signals received by the WiFi antenna elements 14*d*, 14*e* through one or both of the same WiFi antenna elements 14*d*, 14*e*. The controller circuit 92 is powered by a WiFi DC supply circuit 82 in the same manner as the television antenna circuit shown in FIG. 37. The other components of the extender/repeater circuit of FIG. 37A, and their operation and connection, are the same as or similar to those of the WiFi access point circuit shown in FIG. 37 and described previously.

FIG. 37B shows an alternative WiFi signal extender/repeater circuit of the television antenna 2 of the present invention. The circuit is designed to receive and retransmit WiFi signals in dual frequency bands, that is, 2.4 GHz and 5 GHz. One of the WiFi antenna elements 14*d*, 14*e* is capable of receiving and transmitting dual frequency band signals mentioned above, while the other of the WiFi antenna elements 14*d*, 14*e* is capable of receiving and transmitting signals in the 2.4 GHz frequency band. Thus, one or both WiFi antenna elements 14*d*, 14*e* preferably act as transceiver antennas.

The WiFi antenna elements 14*d*, 14*e* are electrically coupled to high pass filter circuits 90. The filtered signal from the high pass filter circuit 90 of the dual band WiFi antenna element 14*d* or 14*e* is provided to a diplexer and combiner circuit 62. A first output signal from the diplexer and combiner circuit 62 is provided to a first WLAN a/n/ac controller circuit 64 which operates in accordance with IEEE Standard 802.11a, 802.11n and 802.11ac. A second output signal from the diplexer and combiner circuit 62 is provided to one input of a second WLAN b/g/n controller circuit 66, which operates in accordance with IEEE Standard 802.11b, 802.11g and 802.11n. The filtered signal from the other high pass filter circuit 90 connected to the single band WiFi antenna element 14*d*, 14*e* is provided to a second input of the second WLAN b/g/n controller circuit 66. The output signals from the first WLAN controller circuit 64 and the second WLAN controller circuit 66 are provided to the inputs of an AP/router network processor circuit 68. A combination of the first WLAN controller circuit 64 and the AP/router network processor circuit 68 may be embodied as Part No. RTL8871AM manufactured by Realtek Semiconductor Corp. of Taiwan. The AP/router network processor circuit 68 is powered by a WiFi DC supply circuit 82 in the same manner as the television antenna circuit shown in FIG. 37. The other components of the extender/repeater circuit of FIG. 37B, and of FIG. 37A, and their operation and connection, are the same as or similar to those of the WiFi access point circuit shown in FIG. 37 and described previously.

The television antenna 2, with or without a WiFi Access Point or WiFi repeater or WiFi range extender, is easy to operate and requires no adjustment by the user other than to raise the various antenna elements 14*a*-14*e* to an upright, vertical position. There is no adjustment to the antenna elements 14*a*-14*e* required, other than to place the elements in a vertical position, and the mutual coupling between the antenna elements 14*a*-14*e* provides omni-directional reception of "over-the-air" (broadcast) high definition television signals and omni-directional WiFi signal reception and a WiFi Access Point or WiFi repeater or WiFi extender, all in the same television antenna 2. Also, all of the antenna elements 14*a*-14*e* may be folded flat onto or near the top surface 6 of the antenna housing 4 for compact storage when not in use, so that the antenna 2 of the present invention may be received by a smaller package for shipping from the manufacturer to the retailer and for display on the retailer's merchandise shelves.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. A television antenna, which comprises:

an antenna housing, the antenna housing defining an interior cavity, the antenna housing being in the form of a planar member and having a top surface and a bottom surface situated opposite the top surface;

at least one sleeved UHF (ultra high frequency) antenna element mounted on the top surface of the antenna housing and being positionable substantially perpendicularly thereto, the at least one UHF antenna element receiving television signals broadcast over the air in the UHF band and providing an output signal corresponding thereto;

an array of at least two helical VHF (very high frequency) antenna elements mounted on the top surface of the antenna housing and being positionable substantially perpendicularly thereto, each of the at least two VHF antenna elements receiving television signals broadcast over the air in the VHF band and providing an output signal corresponding thereto;

antenna circuitry, the antenna circuitry being situated within the interior cavity of the antenna housing, the antenna circuitry being responsive to the output signals of the at least two VHF antenna elements and the at least one UHF antenna element, the antenna circuitry providing an output signal; and at least one output connector, the at least one output connector being mounted on or extending from the antenna housing, the at least one output connector providing the output signal from the antenna circuitry thereon.

2. A television antenna as defined by claim 1, wherein the at least one UHF antenna element and the at least two VHF antenna elements are selectively adjustable between at least a first position in which the UHF and VHF antenna elements are disposed in a substantially perpendicular position with respect to the top surface of the housing and a second position in which the UHF and VHF antenna elements are disposed in a folded position such that the UHF and VHF antenna elements are substantially parallel with and in close proximity to the top surface of the housing.

3. A television antenna as defined by claim 2, wherein each of the at least one UHF antenna element and the at least two VHF antenna elements include a pivoting mounting connector joining each antenna element to the housing on the top surface thereof, the pivoting mounting connectors being selectively lockable to maintain the UHF and VHF antenna elements in the at least first position.

4. A television antenna as defined by claim 2, wherein the housing further includes a first lateral side wall and a second lateral side wall situated opposite the first lateral side wall, the at least one UHF antenna element and the at least two VHF antenna elements being mounted to the antenna housing in close proximity to at least one of the first lateral side wall and the second lateral side wall.

5. A television antenna as defined by claim 4, wherein the first lateral side wall of the housing includes a first end and a second end situated opposite the first end; and wherein the at least one UHF antenna element and the at least two VHF antenna elements are mounted to the antenna housing along the first lateral side wall, the at least one UHF antenna element being situated in proximity to the first end of the first lateral side wall, one of the at least two VHF antenna elements being situated in proximity to the second end of the first lateral side wall, and another of the at least two VHF antenna elements being situated therebetween.

6. A television antenna as defined by claim 1, wherein the at least two VHF antenna elements are spaced sufficiently close to one another so that the VHF antennas are mutually electromagnetically coupled to help provide an omni-directional antenna pattern for receiving broadcast signals.

7. A television antenna as defined by claim 6, wherein the at least one UHF antenna element is electromagnetically coupled to one or both of the at least two VHF antenna elements to help provide an omni-directional antenna pattern for receiving broadcast signals.

8. A television antenna as defined by claim 1, wherein the antenna circuitry comprises:

a VHF antenna impedance matching circuit, the VHF antenna impedance matching circuit being responsive to the output signals of the at least two VHF antenna elements, the VHF antenna impedance matching circuit providing an output signal corresponding thereto;

a UHF antenna impedance matching circuit, the UHF antenna impedance matching circuit being responsive to the output signal of the at least one UHF antenna element, the UHF antenna impedance matching circuit providing an output signal corresponding thereto; and a UHF/VHF combiner circuit, the UHF/VHF combiner circuit being responsive to the output signals of the VHF antenna impedance matching circuit and the UHF antenna impedance matching circuit and providing an output signal to the at least one output connector in response thereto.

9. A television antenna as defined by claim 1, wherein at least one of the UHF and VHF antenna elements is formed as a modified coaxial sleeve antenna element, the modified coaxial sleeve antenna element including a cylindrical sleeve having a closed top end and an open bottom end situated axially opposite the closed top end and defining a bore extending between the open bottom end and the closed top end, and an electrical signal cable extending through the open bottom end and through the bore of the cylindrical sleeve, the electrical signal cable having an inner conductor which is electrically connected to and terminates at the closed top end of the cylindrical sleeve such that it does not extend beyond the closed top end of the cylindrical sleeve, the electrical signal cable further having a radially outer coaxial shield situated at least partially axially below the open bottom end of the cylindrical sleeve, the outer coaxial shield of the electrical signal cable situated axially below the open bottom end of the cylindrical sleeve acting as a first lower radiating element, and the cylindrical sleeve acting as a second upper radiating element.

10. A television antenna, which comprises:

an antenna housing, the antenna housing defining an interior cavity, the antenna housing being in the form of a planar member and having a top surface and a bottom surface situated opposite the top surface;

at least one sleeved UHF (ultra high frequency) antenna element mounted on the top surface of the antenna housing and being positionable substantially perpendicularly thereto, the at least one UHF antenna element receiving television signals broadcast over the air in the UHF band and providing an output signal corresponding thereto;

an array of at least two helical VHF (very high frequency) antenna elements mounted on the top surface of the antenna housing and being positionable substantially perpendicularly thereto, each of the at least two VHF antenna elements receiving television signals broadcast over the air in the VHF band and providing an output signal corresponding thereto, at least two WiFi antenna elements mounted on the top surface of the antenna housing and being positionable substantially perpendicularly thereto, each of the at least two WiFi antenna elements receiving WiFi signals from an internet source and providing an output signal corresponding thereto;

antenna circuitry, the antenna circuitry being situated within the interior cavity of the antenna housing, the antenna circuitry being responsive to the output signals of the at least two VHF antenna elements, the at least one UHF antenna element and the at least two WiFi antenna elements, the antenna circuitry providing an output signal; and at least one output connector, the at least one output connector being mounted on or extending from the antenna housing, the at least one output connector providing the output signal from the antenna circuitry thereon.

11. A television antenna as defined by claim 10, wherein the at least one UHF antenna element, the at least two VHF antenna elements and the at least two WiFi antenna elements are selectively adjustable between at least a first position in which the UHF, VHF and WiFi antenna elements are disposed in a substantially perpendicular position with respect to the top surface of the housing and a second position in which the UHF, VHF and WiFi antenna elements are disposed in a folded position such that the UHF, VHF and WiFi antenna elements are substantially parallel with and in close proximity to the top surface of the housing.

12. A television antenna as defined by claim 11, wherein each of the at least one UHF antenna element, the at least two VHF antenna elements and the at least two WiFi antenna elements includes a pivoting mounting connector joining each antenna element to the housing on the top surface thereof, the pivoting mounting connectors being selectively lockable to maintain the UHF, VHF and WiFi antenna elements in the at least first position.

13. A television antenna as defined by claim 11, wherein the housing further includes a first lateral side wall and a second lateral side wall situated opposite the first lateral side wall, the at least one UHF antenna element and the at least two VHF antenna elements being mounted to the antenna housing in close proximity to the first lateral side wall and the at least two WiFi antenna elements being mounted to the antenna housing in close proximity to the second lateral side wall.

14. A television antenna as defined by claim 13, wherein the first lateral side wall of the housing includes a first end and a second end situated opposite the first end;

wherein the at least one UHF antenna element and the at least two VHF antenna elements are mounted to the antenna housing along the first lateral side wall, the at least one UHF antenna element being situated in proximity to the first end of the first lateral side wall, one of the at least two VHF antenna elements being situated in proximity to the second end of the first lateral side wall, and another of the at least two VHF antenna elements being situated therebetween; and wherein the at least two WiFi antenna elements are mounted to the antenna housing along the second lateral side wall, the at least two WiFi antenna elements being situated in proximity to the second lateral side wall so that, when the UHF, VHF and WiFi antenna elements are in the second, folded position, at least one of the WiFi antenna elements is disposed between the at least one UHF antenna element and one of the least two VHF antenna elements, and the other of the at least two WiFi antenna elements is disposed between the at least two VHF antenna elements.

15. A television antenna as defined by claim 10, wherein the antenna circuitry comprises:

a WiFi access point circuit, the WiFi access point circuit being responsive to the output signals of the WiFi antenna elements and providing an output signal to the at least one output connector in response thereto.

16. A television antenna as defined by claim 10, wherein each of the at least two WiFi antenna elements is formed as a combination of a helix antenna and a coaxial sleeve antenna.

17. A television antenna as defined by claim 10, wherein the antenna circuitry comprises:

a VHF antenna impedance matching circuit, the VHF antenna impedance matching circuit being responsive to the output signals of the at least two VHF antenna elements, the VHF antenna impedance matching circuit providing an output signal corresponding thereto;

a UHF antenna impedance matching circuit, the UHF antenna impedance matching circuit being responsive to the output signal of the at least one UHF antenna element, the UHF antenna impedance matching circuit providing an output signal corresponding thereto;

a UHF/VHF combiner circuit, the UHF/VHF combiner circuit being responsive to the output signals of the VHF antenna impedance matching circuit and the UHF antenna impedance matching circuit and providing an output signal to the at least one output connector in response thereto;

at least a first WiFi diplexer and combiner circuit and a second WiFi diplexer and combiner circuit, the first WiFi diplexer and combiner circuit and the second WiFi diplexer and combiner circuit being responsive to the output signal of a respective one of the at least two WiFi antenna elements, each of the first WiFi diplexer and combiner circuit and the second WiFi diplexer and combiner circuit providing a first output signal and a second output signal;

at least two WLAN (wireless local area network) controllers, one of the at least two WLAN controllers being responsive to the first output signal of the first WiFi diplexer and combiner circuit and the first output signal of the second WiFi diplexer and combiner circuit, and the other of the at least two WLAN controllers being responsive to the second output signal of the first WiFi diplexer and combiner circuit and the second output signal of the second WiFi diplexer and combiner circuit, each of the at least two WLAN controllers providing an output signal; and at least one access point network processor, the at least one access point network processor being responsive to the output signals of the at least two WLAN controllers, the at least one access point network processor providing a output signal to the at least one output connector in response thereto.

18. A television antenna as defined by claim 17, wherein the antenna circuitry further comprises:

an amplifier circuit, the amplifier circuit being responsive to the output signal provided by the UHF/VHF combiner circuit and providing an amplified output signal corresponding thereto, the amplified output signal being provided to the at least one output connector; and a power supply circuit, the power supply circuit providing power to at least one of the amplifier circuit, the at least one access point network processor and the at least two WLAN controllers.

19. A television antenna as defined by claim 10, wherein the antenna circuitry includes at least one printed circuit board, the at least one printed circuit board having at least one ground plane that acts as a reflective element for at least one of the UHF antenna element, the VHF antenna elements and the WiFi antenna elements.

20. A television antenna as defined by claim 10, wherein the antenna circuitry comprises:

a VHF antenna impedance matching circuit, the VHF antenna impedance matching circuit being responsive to the output signals of the at least two VHF antenna elements, the VHF antenna impedance matching circuit providing an output signal corresponding thereto;

a UHF antenna impedance matching circuit, the UHF antenna impedance matching circuit being responsive to the output signal of the at least one UHF antenna element, the UHF antenna impedance matching circuit providing an output signal corresponding thereto;

a UHF/VHF combiner circuit, the UHF/VHF combiner circuit being responsive to the output signals of the VHF antenna impedance matching circuit and the UHF antenna impedance matching circuit and providing an output signal to the at least one output connector in response thereto; and an amplifier circuit, the amplifier circuit being responsive to the output signal provided by the UHF/VHF combiner circuit and providing an amplified output signal corresponding thereto, the amplified output signal being provided to the at least one output connector.

21. A television antenna as defined by claim 10, wherein at least one of the UHF, VHF and WiFi antenna elements is formed as a modified coaxial sleeve antenna element, the modified coaxial sleeve antenna element including a cylindrical sleeve having a closed top end and an open bottom end situated axially opposite the closed top end and defining a bore extending between the open bottom end and the closed top end, and an electrical signal cable extending through the open bottom end and through the bore of the cylindrical sleeve, the electrical signal cable having an inner conductor which is electrically connected to and terminates at the closed top end of the cylindrical sleeve such that it does not extend beyond the closed top end of the cylindrical sleeve, the electrical signal cable further having a radially outer coaxial shield situated at least partially axially below the open bottom end of the cylindrical sleeve, the outer coaxial shield of the electrical signal cable situated axially below the open bottom end of the cylindrical sleeve acting as a first lower radiating element, and the cylindrical sleeve acting as a second upper radiating element.

22. A television antenna as defined by claim 10, wherein the antenna circuitry comprises:

a WiFi extender/repeater circuit, the WiFi extender/repeater circuit being responsive to the output signals of the at least two WiFi antenna elements and providing rebroadcast WiFi signals to at least one of the at least two WiFi antenna elements for transmission of the rebroadcast WiFi signals.

23. A television antenna as defined by claim 22, wherein the WiFi extender/repeater circuit includes:

at least two high pass filter circuits, each of the at least two high pass filter circuits being responsive to the output signal of a respective WiFi antenna element of the at least two WiFi antenna elements and providing a filtered output signal in response thereto; and an access point/router network controller circuit, the access point/router network controller circuit being responsive to the filtered output signals of the at least two high pass filter circuits and generating the rebroadcast WiFi signals in response thereto.

24. A television antenna as defined by claim 23, wherein the access point/router network controller circuit operates in accordance with IEEE (Institute of Electrical and Electronics Engineers) Standard 802.11b, 802.11g and 802.11n.

25. A television antenna as defined by claim 22, wherein the WiFi extender/repeater circuit includes:

at least a first high pass filter circuit and a second high pass filter circuit, the first high pass filter circuit of the at least first and second high pass filter circuits being responsive to the output signal of one of the WiFi antenna elements of the at least two WiFi antenna elements and providing a first filtered output signal in response thereto, the second high pass filter circuit of the at least first and second high pass filter circuits being responsive to the output signal of another of the WiFi antenna elements of the at least two WiFi antenna elements and providing a second filtered output signal in response thereto;

a WiFi diplexer and combiner circuit, the WiFi diplexer and combiner circuit being responsive to the first filtered output signal of the first high pass filter circuit and providing a first output signal and a second output signal in response thereto;

a first WLAN (wireless local area network) controller, the first WLAN controller being responsive to the first output signal provided by the diplexer and combiner circuit and providing an output signal in response thereto;

a second WLAN controller, the second WLAN controller being responsive to the second output signal provided by the diplexer and combiner circuit and the second filtered output signal of the second high pass filter circuit and providing an output signal in response thereto; and an access point/router network processor, the access point/router network processor being responsive to the output signal provided by the first WLAN controller and the output signal provided by the second WLAN controller and generating the rebroadcast WiFi signals in response thereto.

26. A television antenna as defined by claim 25, wherein the first WLAN controller operates in accordance with the IEEE (Institute of Electrical and Electronics Engineers) Standard 802.11a, 802.11n and 802.11ac; and wherein the second WLAN controller operates in accordance with IEEE Standard 802.11b, 802.11g and 802.11n.

27. A television antenna as defined by claim 22, wherein at least one WiFi antenna element of the at least two WiFi antenna elements is a dual band antenna element capable of receiving WiFi signals in two frequency bands.

28. A television antenna as defined by claim 22, wherein at least one WiFi antenna element of the at least two WiFi antenna elements is capable of receiving WiFi signals in about a 2.4 GHz frequency band and in about a 5 GHz frequency band; and wherein at least another WiFi antenna element of the at least two WiFi antenna elements is capable of receiving WiFi signals in about a 2.4 GHz frequency band.

* * * * *